US008844652B2

(12) United States Patent
Sokol et al.

(10) Patent No.: US 8,844,652 B2
(45) Date of Patent: Sep. 30, 2014

(54) INTERLOCKING LOW PROFILE ROTATING CONTROL DEVICE

(75) Inventors: Jonathan P. Sokol, New York, NY (US); Danny W. Wagoner, Cypress, TX (US); Thomas F. Bailey, Houston, TX (US); Aristeo Rios, III, Houston, TX (US); James W. Chambers, Hackett, AR (US); Don M. Hannegan, Fort Smith, AR (US)

(73) Assignee: Weatherford/Lamb, Inc., Houston, TX (US)

( * ) Notice: Subject to any disclaimer, the term of this patent is extended or adjusted under 35 U.S.C. 154(b) by 298 days.

(21) Appl. No.: 12/893,391

(22) Filed: Sep. 29, 2010

(65) Prior Publication Data

US 2011/0036638 A1 Feb. 17, 2011

Related U.S. Application Data

(63) Continuation-in-part of application No. 11/975,946, filed on Oct. 23, 2007, now Pat. No. 8,286,734.

(51) Int. Cl.

| | |
|---|---|
| ***E21B 33/03*** | (2006.01) |
| ***E21B 21/10*** | (2006.01) |
| ***E21B 33/08*** | (2006.01) |
| ***E21B 33/06*** | (2006.01) |
| ***E21B 7/02*** | (2006.01) |
| *E21B 21/00* | (2006.01) |

(52) U.S. Cl.

CPC ..... *E21B 7/02* (2013.01); *E21B 21/106* (2013.01); *E21B 33/085* (2013.01); *E21B 2021/006* (2013.01); *E21B 33/06* (2013.01)

USPC ..... 175/214; 166/85.3; 166/84.2

(58) Field of Classification Search

USPC ..... 166/85.3, 84.1, 84.2; 175/195, 207, 214

See application file for complete search history.

(56) References Cited

U.S. PATENT DOCUMENTS

| | | | |
|---|---|---|---|
| 517,509 | A | 4/1894 | Williams |
| 1,157,644 | A | 10/1915 | London |

(Continued)

FOREIGN PATENT DOCUMENTS

| | | | |
|---|---|---|---|
| AU | 199927822 | B2 | 9/1999 |
| AU | 200028183 | A1 | 9/2000 |

(Continued)

OTHER PUBLICATIONS

US 6,708,780, 11/15/2001, Bourgoyne, et al. (withdrawn).

(Continued)

*Primary Examiner* — David Andrews

(74) *Attorney, Agent, or Firm* — Strasburger & Price, LLP

(57) ABSTRACT

A system and method is provided for a low profile rotating control device (LP-RCD) and its housing mounted on or integral with an annular blowout preventer seal, casing, or other housing. The LP-RCD and LP-RCD housing can fit within a limited space available on drilling rigs. An embodiment allows a LP-RCD to be removably disposed with a LP-RCD housing by rotating a bearing assembly rotating plate. A sealing element may be removably disposed with the LP-RCD bearing assembly by rotating a seal retainer ring. Alternatively, a sealing element may be removably disposed with the LP-RCD bearing assembly with a seal support member threadedly attached with the LP-RCD bearing assembly. The seal support member may be locked in position with a seal locking ring removably attached with threads with the LP-RCD bearing assembly over the seal support member. Spaced apart accumulators may be disposed radially outward of the bearings in the bearing assembly to provide self lubrication to the bearings.

37 Claims, 20 Drawing Sheets

(56) References Cited

U.S. PATENT DOCUMENTS 1,472,952 A 11/1923 Anderson
1,503,476 A 8/1924 Childs et al.
1,528,560 A 3/1925 Myers et al.
1,546,467 A 7/1925 Bennett
1,560,763 A 11/1925 Collins
1,700,894 A 2/1929 Joyce et al.
1,708,316 A 4/1929 MacClatchie
1,769,921 A 7/1930 Hansen
1,776,797 A 9/1930 Sheldon
1,813,402 A 7/1931 Hewitt
2,038,140 A 7/1931 Stone
1,831,956 A 11/1931 Harrington
1,836,470 A 12/1931 Humason et al.
1,902,906 A 3/1933 Seamark
1,942,366 A 1/1934 Seamark
2,036,537 A 4/1936 Otis
2,071,197 A 2/1937 Burns et al.
2,085,777 A 7/1937 Williams
2,124,015 A 7/1938 Stone et al.
2,126,007 A 8/1938 Gulberson et al.
2,144,682 A 1/1939 MacClatchie
2,148,844 A 2/1939 Stone et al.
2,163,813 A 6/1939 Stone et al.
2,165,410 A 7/1939 Penick et al.
2,170,915 A 8/1939 Schweitzer
2,170,916 A 8/1939 Schweitzer et al.
2,175,648 A 10/1939 Roach
2,176,355 A 10/1939 Otis
2,185,822 A 1/1940 Young
2,199,735 A 5/1940 Beckman
2,211,122 A 8/1940 Howard
2,222,082 A 11/1940 Leman et al.
2,233,041 A 2/1941 Alley
2,243,340 A 5/1941 Hild
2,243,439 A 5/1941 Pranger et al.
2,287,205 A 6/1942 Stone
2,303,090 A 11/1942 Pranger et al.
2,313,169 A 3/1943 Penick et al.
2,325,556 A 7/1943 Taylor, Jr. et al.
2,338,093 A 1/1944 Caldwell
2,480,955 A 9/1949 Penick
2,506,538 A 5/1950 Bennett
2,529,744 A 11/1950 Schweitzer, Jr.
2,609,836 A 9/1952 Knox
2,628,852 A 2/1953 Voytech
2,646,999 A 7/1953 Barske
2,649,318 A 8/1953 Skillman
2,731,281 A 1/1956 Knox
2,746,781 A 5/1956 Jones
2,760,750 A 8/1956 Schweitzer, Jr. et al.
2,760,795 A 8/1956 Vertson
2,764,999 A 10/1956 Stanbury
2,808,229 A 10/1957 Bauer et al.
2,808,230 A 10/1957 McNeil et al.
2,846,178 A 8/1958 Minor
2,846,247 A 8/1958 Davis
2,853,274 A 9/1958 Collins
2,862,735 A 12/1958 Knox
2,886,350 A 5/1959 Horne
2,904,357 A 9/1959 Knox
2,927,774 A 3/1960 Ormsby
2,929,610 A 3/1960 Stratton
2,962,096 A 11/1960 Knox
2,995,196 A 8/1961 Gibson et al.
3,023,012 A 2/1962 Wilde
3,029,083 A 4/1962 Wilde
3,032,125 A 5/1962 Hiser et al.
3,033,011 A 5/1962 Garrett
3,052,300 A 9/1962 Haixtpton
3,096,999 A 7/1963 Ahlstone et al.
3,100,015 A 8/1963 Regan
3,128,614 A * 4/1964 Auer ..... 464/163
3,134,613 A 5/1964 Regan
3,176,996 A 4/1965 Barnett
3,203,358 A 8/1965 Regan et al.
3,209,829 A 10/1965 Haeber
3,216,731 A 11/1965 Dollison
3,225,831 A 12/1965 Knox
3,259,198 A 7/1966 Montgomery et al.
3,268,233 A 8/1966 Brown
3,285,352 A 11/1966 Hunter
3,288,472 A 11/1966 Watkins
3,289,761 A 12/1966 Smith et al.
3,294,112 A 12/1966 Watkins
3,302,048 A 1/1967 Gray
3,313,345 A 4/1967 Fischer
3,313,358 A 4/1967 Postlewaite et al.
3,323,773 A 6/1967 Walker
3,333,870 A 8/1967 Watkins
3,347,567 A 10/1967 Watkins
3,360,048 A 12/1967 Watkins
3,372,761 A 3/1968 van Gils
3,387,851 A 6/1968 Cugini
3,397,928 A 8/1968 Galle
3,400,938 A 9/1968 Williams
3,401,600 A 9/1968 Wood
3,405,763 A 10/1968 Pitts et al.
3,421,580 A 1/1969 Fowler et al.
3,424,197 A 1/1969 Yanagisawa
3,443,643 A 5/1969 Jones
3,445,126 A 5/1969 Watkins
3,452,815 A 7/1969 Watkins
3,472,518 A 10/1969 Harlan
3,476,195 A 11/1969 Galle
3,481,610 A 12/1969 Slator et al.
3,485,051 A 12/1969 Watkins
3,492,007 A 1/1970 Jones
3,493,043 A 2/1970 Watkins
3,503,460 A 3/1970 Gadbois
3,522,709 A 8/1970 Vilain
3,529,835 A 9/1970 Lewis
3,561,723 A 2/1971 Cugini
3,583,480 A 6/1971 Regan
3,587,734 A 6/1971 Shaffer
3,603,409 A 9/1971 Watkins
3,621,912 A 11/1971 Wooddy, Jr.
3,631,834 A 1/1972 Gardner et al.
3,638,721 A 2/1972 Harrison
3,638,742 A 2/1972 Wallace
3,653,350 A 4/1972 Koons et al.
3,661,409 A 5/1972 Brown et al.
3,664,376 A 5/1972 Watkins
3,667,721 A 6/1972 Vujasinovic
3,677,353 A 7/1972 Baker
3,724,862 A 4/1973 Biffle
3,741,296 A 6/1973 Murman et al.
3,779,313 A 12/1973 Regan
3,815,673 A 6/1974 Bruce et al.
3,827,511 A 8/1974 Jones
3,847,215 A 11/1974 Herd
3,868,832 A 3/1975 Biffle
3,872,717 A 3/1975 Fox
3,924,678 A 12/1975 Ahlstone
3,934,887 A 1/1976 Biffle
3,952,526 A 4/1976 Watkins et al.
3,955,622 A 5/1976 Jones
3,965,987 A 6/1976 Biffle
3,976,148 A 8/1976 Maus et al.
3,984,990 A 10/1976 Jones
3,992,889 A 11/1976 Watkins et al.
3,999,766 A 12/1976 Barton
4,037,890 A 7/1977 Kurita et al.
4,046,191 A 9/1977 Neath
4,052,703 A 10/1977 Collins, Sr. et al.
4,053,023 A 10/1977 Herd et al.
4,063,602 A 12/1977 Howell et al.
4,087,097 A 5/1978 Bossens et al.
4,091,881 A 5/1978 Maus
4,098,341 A 7/1978 Lewis
4,099,583 A 7/1978 Maus
4,109,712 A 8/1978 Regan
4,143,880 A 3/1979 Bunting et al.
4,143,881 A 3/1979 Bunting
4,149,603 A 4/1979 Arnold

(56) References Cited

U.S. PATENT DOCUMENTS

| | | | |
|---|---|---|---|
| 4,154,448 | A | 5/1979 | Biffle |
| 4,157,186 | A | 6/1979 | Murray et al. |
| 4,183,562 | A | 1/1980 | Watkins et al. |
| 4,200,312 | A | 4/1980 | Watkins |
| 4,208,056 | A | 6/1980 | Biffle |
| 4,216,835 | A | 8/1980 | Nelson |
| 4,222,590 | A | 9/1980 | Regan |
| 4,249,600 | A | 2/1981 | Bailey |
| 4,281,724 | A | 8/1981 | Garrett |
| 4,282,939 | A | 8/1981 | Maus et al. |
| 4,285,406 | A | 8/1981 | Garrett et al. |
| 4,291,772 | A | 9/1981 | Beynet |
| 4,293,047 | A | 10/1981 | Young |
| 4,304,310 | A | 12/1981 | Garrett |
| 4,310,058 | A | 1/1982 | Bourgoyne, Jr. |
| 4,312,404 | A | 1/1982 | Morrow |
| 4,313,054 | A | 1/1982 | Martini |
| 4,326,584 | A | 4/1982 | Watkins |
| 4,335,791 | A | 6/1982 | Evans |
| 4,336,840 | A | 6/1982 | Bailey |
| 4,337,653 | A | 7/1982 | Chauffe |
| 4,345,769 | A | 8/1982 | Johnston |
| 4,349,204 | A | 9/1982 | Malone |
| 4,353,420 | A | 10/1982 | Miller |
| 4,355,784 | A | 10/1982 | Cain |
| 4,361,185 | A | 11/1982 | Biffle |
| 4,363,357 | A | 12/1982 | Hunter |
| 4,367,795 | A | 1/1983 | Biffle |
| 4,378,849 | A | 4/1983 | Wilks |
| 4,383,577 | A | 5/1983 | Pruitt |
| 4,384,724 | A | 5/1983 | Derman |
| 4,386,667 | A | 6/1983 | Millsapps, Jr. |
| 4,387,771 | A | 6/1983 | Jones |
| 4,398,599 | A | 8/1983 | Murray |
| 4,406,333 | A | 9/1983 | Adams |
| 4,407,375 | A | 10/1983 | Nakamura |
| 4,413,653 | A | 11/1983 | Carter, Jr. |
| 4,416,340 | A | 11/1983 | Bailey |
| 4,423,776 | A | 1/1984 | Wagoner et al. |
| 4,424,861 | A | 1/1984 | Carter, Jr. et al. |
| 4,427,072 | A | 1/1984 | Lawson |
| 4,439,068 | A | 3/1984 | Pokladnik |
| 4,440,232 | A | 4/1984 | LeMoine |
| 4,440,239 | A | 4/1984 | Evans |
| 4,441,551 | A | 4/1984 | Biffle |
| 4,444,250 | A | 4/1984 | Keithahn et al. |
| 4,444,401 | A | 4/1984 | Roche et al. |
| 4,448,255 | A | 5/1984 | Shaffer et al. |
| 4,456,062 | A | 6/1984 | Roche et al. |
| 4,456,063 | A | 6/1984 | Roche |
| 4,457,489 | A | 7/1984 | Gilmore |
| 4,478,287 | A | 10/1984 | Hynes et al. |
| 4,480,703 | A | 11/1984 | Garrett |
| 4,484,753 | A | 11/1984 | Kalsi |
| 4,486,025 | A | 12/1984 | Johnston |
| 4,488,703 | A | 12/1984 | Jones |
| 4,497,592 | A | 2/1985 | Lawson |
| 4,500,094 | A | 2/1985 | Biffle |
| 4,502,534 | A | 3/1985 | Roche et al. |
| 4,508,313 | A | 4/1985 | Jones |
| 4,509,405 | A | 4/1985 | Bates |
| 4,519,577 | A | 5/1985 | Jones |
| 4,524,832 | A | 6/1985 | Roche et al. |
| 4,526,243 | A | 7/1985 | Young |
| 4,527,632 | A | 7/1985 | Chaudot |
| 4,529,210 | A | 7/1985 | Biffle |
| 4,531,580 | A | 7/1985 | Jones |
| 4,531,591 | A | 7/1985 | Johnston |
| 4,531,593 | A | 7/1985 | Elliott et al. |
| 4,531,951 | A | 7/1985 | Burt et al. |
| 4,533,003 | A | 8/1985 | Bailey et al. |
| 4,540,053 | A | 9/1985 | Baugh et al. |
| 4,546,828 | A | 10/1985 | Roche |
| 4,553,591 | A | 11/1985 | Mitchell |
| D282,073 | S | 1/1986 | Bearden et al. |
| 4,566,494 | A | 1/1986 | Roche |
| 4,575,426 | A | 3/1986 | Bailey |
| 4,595,343 | A | 6/1986 | Thompson et al. |
| 4,597,447 | A | 7/1986 | Roche et al. |
| 4,597,448 | A | 7/1986 | Baugh |
| 4,610,319 | A | 9/1986 | Kalsi |
| 4,611,661 | A | 9/1986 | Hed et al. |
| 4,615,544 | A | 10/1986 | Baugh |
| 4,618,314 | A | 10/1986 | Hailey |
| 4,621,655 | A | 11/1986 | Roche |
| 4,623,020 | A | 11/1986 | Nichols |
| 4,626,135 | A | 12/1986 | Roche |
| 4,630,680 | A | 12/1986 | Elkins |
| 4,632,188 | A | 12/1986 | Schuh et al. |
| 4,646,826 | A | 3/1987 | Bailey et al. |
| 4,646,844 | A | 3/1987 | Roche et al. |
| 4,651,830 | A | 3/1987 | Crotwell |
| 4,660,863 | A | 4/1987 | Bailey |
| 4,688,633 | A | 8/1987 | Barkley |
| 4,690,220 | A | 9/1987 | Braddick |
| 4,697,484 | A | 10/1987 | Klee et al. |
| 4,709,900 | A | 12/1987 | Dyer |
| 4,712,620 | A | 12/1987 | Lim et al. |
| 4,719,937 | A | 1/1988 | Roche et al. |
| 4,722,615 | A | 2/1988 | Bailey et al. |
| 4,727,942 | A | 3/1988 | Galle et al. |
| 4,736,799 | A | 4/1988 | Ahlstone |
| 4,745,970 | A | 5/1988 | Bearden et al. |
| 4,749,035 | A | 6/1988 | Cassity |
| 4,754,820 | A | 7/1988 | Watts et al. |
| 4,757,584 | A | 7/1988 | Pav et al. |
| 4,759,413 | A | 7/1988 | Bailey et al. |
| 4,765,404 | A | 8/1988 | Bailey et al. |
| 4,783,084 | A | 11/1988 | Biffle |
| 4,807,705 | A | 2/1989 | Henderson et al. |
| 4,813,495 | A | 3/1989 | Leach |
| 4,817,724 | A | 4/1989 | Funderburg, Jr. et al. |
| 4,822,212 | A | 4/1989 | Hall et al. |
| 4,825,938 | A | 5/1989 | Davis |
| 4,828,024 | A | 5/1989 | Roche |
| 4,832,126 | A | 5/1989 | Roche |
| 4,836,289 | A | 6/1989 | Young |
| 4,844,406 | A | 7/1989 | Wilson |
| 4,865,137 | A | 9/1989 | Bailey |
| 4,882,830 | A | 11/1989 | Carstensen |
| 4,909,327 | A | 3/1990 | Roche |
| 4,949,796 | A | 8/1990 | Williams |
| 4,955,436 | A | 9/1990 | Johnston |
| 4,955,949 | A | 9/1990 | Bailey et al. |
| 4,962,819 | A | 10/1990 | Bailey et al. |
| 4,971,148 | A | 11/1990 | Roche et al. |
| 4,984,636 | A | 1/1991 | Bailey et al. |
| 4,995,464 | A | 2/1991 | Watkins et al. |
| 5,009,265 | A | 4/1991 | Bailey et al. |
| 5,022,472 | A | 6/1991 | Bailey et al. |
| 5,028,056 | A | 7/1991 | Bemis et al. |
| 5,035,292 | A | 7/1991 | Bailey |
| 5,040,600 | A | 8/1991 | Bailey et al. |
| 5,048,621 | A | 9/1991 | Bailey |
| 5,062,450 | A | 11/1991 | Bailey |
| 5,062,479 | A | 11/1991 | Bailey et al. |
| 5,072,795 | A | 12/1991 | Delgado et al. |
| 5,076,364 | A | 12/1991 | Hale et al. |
| 5,082,020 | A | 1/1992 | Bailey |
| 5,085,277 | A | 2/1992 | Hopper |
| 5,101,897 | A | 4/1992 | Leismer et al. |
| 5,137,084 | A | 8/1992 | Gonzales et al. |
| 5,147,559 | A | 9/1992 | Brophey et al. |
| 5,154,231 | A | 10/1992 | Bailey et al. |
| 5,163,514 | A | 11/1992 | Jennings |
| 5,165,480 | A | 11/1992 | Wagoner et al. |
| 5,178,215 | A | 1/1993 | Yenulis et al. |
| 5,182,979 | A | 2/1993 | Morgan |
| 5,184,686 | A | 2/1993 | Gonzalez |
| 5,195,754 | A | 3/1993 | Dietle |
| 5,205,165 | A | 4/1993 | Jardine et al. |
| 5,213,158 | A | 5/1993 | Bailey et al. |
| 5,215,151 | A | 6/1993 | Smith et al. |
| 5,224,557 | A | 7/1993 | Yenulis et al. |

(56) References Cited

U.S. PATENT DOCUMENTS 5,230,520 A 7/1993 Dietle et al.
5,243,187 A 9/1993 Hettlage
5,251,869 A 10/1993 Mason
5,255,745 A 10/1993 Czyrek
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,375,476 A 12/1994 Gray
5,427,179 A 6/1995 Bailey
5,431,220 A 7/1995 Bailey
5,443,129 A 8/1995 Bailey et al.
5,495,872 A 3/1996 Gallagher et al.
5,529,093 A 6/1996 Gallagher et al.
5,588,491 A 12/1996 Tasson et al.
5,607,019 A 3/1997 Kent
5,647,444 A 7/1997 Williams
5,657,820 A 8/1997 Bailey
5,662,171 A 9/1997 Brugman et al.
5,662,181 A 9/1997 Williams et al.
5,671,812 A 9/1997 Bridges
5,678,829 A 10/1997 Kalsi et al.
5,735,502 A 4/1998 Levett et al.
5,738,358 A 4/1998 Kalsi et al.
5,755,372 A 5/1998 Cimbura
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
5,952,569 A 9/1999 Jervis
5,960,881 A 10/1999 Allamon et al.
6,007,105 A 12/1999 Dietle et al.
6,016,880 A 1/2000 Hall et al.
6,017,168 A 1/2000 Fraser, Jr.
6,036,192 A 3/2000 Dietle et al.
6,039,118 A 3/2000 Carter et al.
6,050,348 A 4/2000 Richarson et al.
6,070,670 A 6/2000 Carter et al.
6,076,606 A 6/2000 Bailey
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey
6,120,036 A 9/2000 Kalsi et al.
6,129,152 A 10/2000 Hosie et al.
6,138,774 A 10/2000 Bourgoyne, Jr. et al.
6,170,576 B1 1/2001 Bailey
6,202,745 B1 3/2001 Reimert et al.
6,209,663 B1 4/2001 Hosie
6,213,228 B1 4/2001 Saxman
6,227,547 B1 5/2001 Dietle et al.
6,230,824 B1 5/2001 Peterman et al.
6,244,359 B1 6/2001 Bridges et al.
6,263,982 B1 7/2001 Hannegan et al.
6,273,193 B1 8/2001 Hermann
6,315,302 B1 11/2001 Conroy et al.
6,315,813 B1 11/2001 Morgan et al.
6,325,159 B1 12/2001 Peterman et al.
6,334,619 B1 1/2002 Dietle et al.
6,352,129 B1 3/2002 Best
6,354,385 B1 3/2002 Ford et al.
6,361,830 B1 3/2002 Schenk
6,375,895 B1 4/2002 Daemen
6,382,634 B1 5/2002 Dietle et al.
6,386,291 B1 5/2002 Short
6,413,297 B1 7/2002 Morgan et al.
6,450,262 B1 9/2002 Regan
6,454,007 B1 9/2002 Bailey
6,457,529 B2 10/2002 Calder et al.
6,470,975 B1 10/2002 Bourgoyne et al.
6,478,303 B1 11/2002 Radcliffe
6,494,462 B2 12/2002 Dietle
6,504,982 B1 1/2003 Greer, IV
6,505,691 B2 1/2003 Judge
6,520,253 B2 2/2003 Calder
6,536,520 B1 3/2003 Snider et al.
6,536,525 B1 3/2003 Haugen et al.
6,547,002 B1 4/2003 Bailey et al.
6,554,016 B2 4/2003 Kinder
6,561,520 B2 5/2003 Kalsi et al.
6,581,681 B1 6/2003 Zimmerman et al.
6,607,042 B2 8/2003 Hoyer et al.
RE38,249 E 9/2003 Tasson et al.
6,655,460 B2 12/2003 Bailey et al.
6,685,194 B2 2/2004 Dietle et al.
6,702,012 B2 3/2004 Bailey et al.
6,708,762 B2 3/2004 Haugen et al.
6,720,764 B2 4/2004 Relton et al.
6,725,951 B2 4/2004 Looper
6,732,804 B2 5/2004 Hosie et al.
6,749,172 B2 6/2004 Kinder
6,767,016 B2 7/2004 Gobeli et al.
6,843,313 B2 1/2005 Hult
6,851,476 B2 2/2005 Gray et al.
6,877,565 B2 4/2005 Edvardsen
6,886,631 B2 5/2005 Wilson et al.
6,896,048 B2 5/2005 Mason et al.
6,896,076 B2 5/2005 Nelson et al.
6,904,981 B2 6/2005 van Riet
6,913,092 B2 7/2005 Bourgoyne et al.
6,945,330 B2 9/2005 Wilson et al.
7,004,444 B2 2/2006 Kinder
7,007,913 B2 3/2006 Kinder
7,011,167 B2 3/2006 Ebner et al.
7,025,130 B2 4/2006 Bailey et al.
7,028,777 B2 4/2006 Wade et al.
7,032,691 B2 4/2006 Humphreys
7,040,394 B2 5/2006 Bailey et al.
7,044,237 B2 5/2006 Leuchtenberg
7,073,580 B2 7/2006 Wilson et al.
7,077,212 B2 7/2006 Roesner et al.
7,080,685 B2 7/2006 Bailey et al.
7,086,481 B2 8/2006 Hosie et al.
7,152,680 B2 12/2006 Wilson et al.
7,159,669 B2 1/2007 Bourgoyne et al.
7,165,610 B2 1/2007 Hopper
7,174,956 B2 2/2007 Williams et al.
7,178,600 B2 2/2007 Luke et al.
7,191,840 B2 3/2007 Bailey
7,198,098 B2 4/2007 Williams
7,204,315 B2 4/2007 Pia
7,219,729 B2 5/2007 Bostick et al.
7,237,618 B2 7/2007 Williams
7,237,623 B2 7/2007 Hannegan
7,240,727 B2 7/2007 Williams
7,243,958 B2 7/2007 Williams
7,255,173 B2 8/2007 Hosie et al.
7,258,171 B2 8/2007 Bailey
7,278,494 B2 10/2007 Williams
7,278,496 B2 10/2007 Leuchtenberg
7,296,628 B2 11/2007 Robichaux
7,308,954 B2 12/2007 Martin-Marshall
7,325,610 B2 2/2008 Giroux et al.
7,334,633 B2 2/2008 Williams et al.
7,347,261 B2 3/2008 Markel et al.
7,350,590 B2 4/2008 Hosie et al.
7,363,860 B2 4/2008 Wilson et al.
7,367,411 B2 5/2008 Leuchtenberg
7,377,334 B2 5/2008 May
7,380,590 B2 6/2008 Hughes et al.
7,380,591 B2 6/2008 Williams
7,380,610 B2 6/2008 Williams
7,383,876 B2 6/2008 Gray et al.
7,389,183 B2 6/2008 Gray
7,392,860 B2 7/2008 Johnston
7,413,018 B2 8/2008 Hosie et al.
7,416,021 B2 8/2008 Williams

(56) References Cited

U.S. PATENT DOCUMENTS

| | | | |
|---|---|---|---|
| 7,416,226 | B2 | 8/2008 | Williams |
| 7,448,454 | B2 | 11/2008 | Bourgoyne et al. |
| 7,451,809 | B2 | 11/2008 | Noske et al. |
| 7,475,732 | B2 | 1/2009 | Hosie et al. |
| 7,487,837 | B2 | 2/2009 | Bailey et al. |
| 7,513,300 | B2 | 4/2009 | Pietras et al. |
| 7,559,359 | B2 | 7/2009 | Williams |
| 7,635,034 | B2 | 12/2009 | Williams |
| 7,650,950 | B2 | 1/2010 | Leuchtenberg |
| 7,654,325 | B2 | 2/2010 | Giroux et al. |
| 7,669,649 | B2 | 3/2010 | Williams |
| 7,699,109 | B2 | 4/2010 | May et al. |
| 7,708,089 | B2 | 5/2010 | Williams |
| 7,712,523 | B2 | 5/2010 | Snider et al. |
| 7,717,169 | B2 | 5/2010 | Williams |
| 7,717,170 | B2 | 5/2010 | Williams |
| 7,726,416 | B2 | 6/2010 | Williams |
| 7,743,823 | B2 | 6/2010 | Hughes et al. |
| 7,762,320 | B2 | 7/2010 | Williams |
| 7,766,100 | B2 | 8/2010 | Williams |
| 7,779,903 | B2 | 8/2010 | Bailey et al. |
| 7,789,132 | B2 | 9/2010 | Williams |
| 7,789,172 | B2 | 9/2010 | Williams |
| 7,793,719 | B2 | 9/2010 | Snider et al. |
| 7,798,250 | B2 | 9/2010 | Williams |
| 7,802,635 | B2 | 9/2010 | Leduc et al. |
| 7,823,665 | B2 | 11/2010 | Sullivan |
| 7,836,946 | B2 | 11/2010 | Bailey et al. |
| 7,836,973 | B2 | 11/2010 | Belcher et al. |
| 7,926,593 | B2 | 4/2011 | Bailey et al. |
| 8,096,711 | B2 | 1/2012 | Beauchamp et al. |
| 8,286,734 | B2 | 10/2012 | Hannegan et al. |
| 2003/0106712 | A1 | 6/2003 | Bourgoyne et al. |
| 2003/0164276 | A1 | 9/2003 | Snider et al. |
| 2004/0017190 | A1 | 1/2004 | McDearmon et al. |
| 2005/0151107 | A1 | 7/2005 | Shu |
| 2005/0161228 | A1 | 7/2005 | Cook et al. |
| 2006/0037782 | A1 | 2/2006 | Martin-Marshall |
| 2006/0108119 | A1 | 5/2006 | Bailey et al. |
| 2006/0144622 | A1 | 7/2006 | Bailey et al. |
| 2006/0157282 | A1 | 7/2006 | Tilton et al. |
| 2006/0191716 | A1 | 8/2006 | Humphreys |
| 2007/0051512 | A1 | 3/2007 | Markel et al. |
| 2007/0095540 | A1 | 5/2007 | Kozicz |
| 2007/0163784 | A1 | 7/2007 | Bailey |
| 2008/0169107 | A1 | 7/2008 | Redlinger et al. |
| 2008/0210471 | A1 | 9/2008 | Bailey et al. |
| 2008/0236819 | A1 | 10/2008 | Foster et al. |
| 2008/0245531 | A1 | 10/2008 | Noske et al. |
| 2008/0296016 | A1 | 12/2008 | Hughes |
| 2009/0025930 | A1 | 1/2009 | Iblings et al. |
| 2009/0050373 | A1* | 2/2009 | Loretz ..... 175/59 |
| 2009/0101351 | A1 | 4/2009 | Hannegan et al. |
| 2009/0101411 | A1 | 4/2009 | Hannegan et al. |
| 2009/0139724 | A1 | 6/2009 | Gray et al. |
| 2009/0152006 | A1 | 6/2009 | Leduc et al. |
| 2009/0161997 | A1 | 6/2009 | Beauchamp et al. |
| 2009/0166046 | A1 | 7/2009 | Edvardson et al. |
| 2009/0200747 | A1 | 8/2009 | Williams |
| 2009/0211239 | A1 | 8/2009 | Askeland |
| 2009/0236144 | A1 | 9/2009 | Todd et al. |
| 2009/0301723 | A1 | 12/2009 | Gray |
| 2010/0008190 | A1 | 1/2010 | Gray et al. |
| 2010/0025047 | A1 | 2/2010 | Sokol |
| 2010/0175882 | A1 | 7/2010 | Bailey et al. |
| 2011/0024195 | A1 | 2/2011 | Hoyer |
| 2011/0036629 | A1 | 2/2011 | Bailey et al. |
| 2011/0036638 | A1 | 2/2011 | Sokol |

FOREIGN PATENT DOCUMENTS

| | | | |
|---|---|---|---|
| AU | 200028183 | B2 | 9/2000 |
| CA | 2363132 | A1 | 9/2000 |
| CA | 2447196 | A1 | 4/2004 |
| EP | 0290250 | A2 | 11/1988 |
| EP | 0290250 | A3 | 11/1988 |
| EP | 267140 | | 3/1993 |
| EP | 1375817 | A1 | 1/2004 |
| EP | 1519003 | A1 | 3/2005 |
| EP | 1659260 | A2 | 5/2006 |
| EP | 2 053 197 | A2 | 4/2009 |
| GB | 1161299 | | 8/1969 |
| GB | 2019921 | A | 11/1979 |
| GB | 2067235 | A | 7/1981 |
| GB | 2 362 668 | A | 11/2001 |
| GB | 2362668 | A | 11/2001 |
| GB | 2394738 | A | 5/2004 |
| GB | 2394741 | A | 5/2004 |
| GB | 2449010 | A | 8/2007 |
| WO | WO 93/06335 | | 4/1993 |
| WO | WO 99/45228 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO 00/52299 | A1 | 9/2000 |
| WO | WO 00/52300 | A1 | 9/2000 |
| WO | WO 01/79654 | A1 | 10/2001 |
| WO | WO 02/36928 | A1 | 5/2002 |
| WO | WO 02/50398 | A1 | 6/2002 |
| WO | WO 03/071091 | A1 | 8/2003 |
| WO | WO 2006/088379 | A1 | 8/2006 |
| WO | WO 2007/092956 | A2 | 8/2007 |
| WO | WO 2008/133523 | A1 | 11/2008 |
| WO | WO 2008/156376 | A1 | 12/2008 |
| WO | WO 2009/017418 | A1 | 2/2009 |
| WO | WO 2009/123476 | A1 | 10/2009 |
| WO | WO-2012-041996 | A2 | 4/2012 |
| WO | WO 2012/041996 | A2 | 4/2012 |

OTHER PUBLICATIONS

The Modular T BOP Stack System, Cameron Iron Works © 1985 (5 pages).

Cameron HC Collet Connector, © 1996 Cooper Cameron Corporation, Cameron Division (12 pages).

Riserless drilling: circumventing the size/cost cycle in deepwater—Conoco, Hydril project seek enabling technologies to drill in deepest water depths economically, May 1986 Offshore Drilling Technology (pp. 49, 50, 52, 53, 54 and 55).

U.S. Appl. No. 60/079,641, Abandoned, but Priority Claimed in above US Patent Nos. 6,230,824B1 and 6,102,673 and PCT WO 99/50524, Mar. 27, 1998.

U.S. Appl. No. 60/122,530, Abandoned, but Priority Claimed in US Patent No. 6,470,975B1, Mar. 2, 1999.

U.S. Appl. No. 61/205,209, Abandoned, but priority claimed in US2010/0175882A1, Jan. 15, 2009.

Williams Tool Company—Home Page—Under Construction Williams Rotating Control Heads (2 pages); Seal-Ability for the pressures of drilling (2 pages); Williams Model 7000 Series Rotating Control Heads (1 page); Williams Model 7000 & 7100 Series Rotating Control Heads (2 pages); Williams Model IP1000 Rotating Control Head (2 pages); Williams Conventional Models 8000 & 9000 (2 pages); Applications Where Using a Williams rotating control head while drilling is a plus (1 page); Williams higher pressure rotating control head systems are Ideally Suited for New Technology Flow Drilling and Closed Loop Underbalanced Drilling (UBD) Vertical and Horizontal (2 pages); and How to Contact US (2 pages).

Offshore—World Trends and Technology for Offshore Oil and Gas Operations, Mar. 1998, Seismic: Article entitled, "Shallow Flow Diverter JIP Spurred by Deepwater Washouts" (3 pages including cover page, table of contents and p. 90).

Williams Tool Co., Inc. Rotating Control Heads and Strippers for Air, Gas, Mud, and Geothermal, Drilling Worldwide—Sales Rental Service, © 1988 (19 pages).

Williams Tool Co., Inc. 19 page brochure © 1991 Williams Tool Co., Inc. (19 pages).

FIG. 19 Floating Piston Drilling Choke Design: May of 1997.

Blowout Preventer Testing for Underbalanced Drilling by Charles R. "Rick" Stone and Larry A. Cress, Signa Engineering Corp., Houston, Texas (24 pages) Sep. 1997.

(56) References Cited

OTHER PUBLICATIONS

Williams Tool Co., Inc. Instructions, Assemble & Disassemble Model 9000 Bearing Assembly (cover page and 27 numbered pages).
Williams Tool Co., Inc. Rotating Control Heads Making Drilling Safer While Reducing Costs Since 1968, © 1989 (4 pages).
Williams Tool Company, Inc. International Model 7000 Rotating Control Head, 1991 (4 pages).
Williams Rotating Control Heads, Reduce Costs Increase Safety Reduce Environmental Impact, 4 pages, (© 1995).
Williams Rotating Control Heads, Reduce Costs Increase Safety Reduce Environmental Impact (4 pages).
Williams Tool Co., Inc. Sales-Rental-Service, Williams Rotating Control Heads and Strippers for Air, Gas, Mud, and Geothermal Drilling, © 1982 (7 pages).
Williams Tool Co., Inc., Rotating Control Heads and Strippers for Air, Gas, Mud, Geothermal and Pressure Drilling, © 1991 (19 pages).
An Article—The Brief Jan. '96, The Brief's Guest Columnists, Williams Tool Co., Inc., Communicating Dec. 13, 1995 (Fort Smith, Arkansas), The When? and Why? of Rotating Control Head Usage, Copyright © Murphy Publishing, Inc. 1996 (2 pages).
A reprint from the Oct. 9, 1995 edition of Oil & Gas Journal, "Rotating control head applications increasing," by Adam T. Bourgoyne, Jr., Copyright 1995 by PennWell Publishing Company (6 pages).
1966-1967 Composite Catalog-Grant Rotating Drilling Head for Air, Gas or Mud Drilling (1 page).
1976-1977 Composite Catalog Grant Oil Tool Company Rotating Drilling Head Models 7068, 7368, 8068 (Patented), Equally Effective with Air, Gas, or Mud Circulation Media (3 pages).
A Subsea Rotating Control Head for Riserless Drilling Applications; Daryl A. Bourgoyne, Adam T. Bourgoyne, and Don Hannegan—1998 (International Association of Drilling Contractors International Deep Water Well Control Conference held in Houston, Texas, Aug. 26-27, 1998) 14 pages).
Hannegan, "Applications Widening for Rotating Control Heads," Drilling Contractor, cover page, table of contents and pp. 17 and 19, Drilling Contractor Publications Inc., Houston, Texas, Jul. 1996.
Composite Catalog, Hughes Offshore 1986-87 Subsea Systems and Equipment, Hughes Drilling Equipment Composite Catalog (pp. 2986-3004).
Williams Tool Co., Inc. Technical Specifications Model for the Model 7100, (3 pages).
Williams Tool Co., Inc. Website, Underbalanced Drilling (UBD), The Attraction of UBD (2 pages).
Williams Tool Co., Inc. Website,. "Applications, Where Using a Williams Rotating Control Head While Drillings is a Plus" (2 pages).
Williams Tool Co., Inc. Website, "Model 7100," (3 pages).
Composite Catalog, Hughes Offshore 1982/1983, Regan Products, © Copyright 1982 (Two cover sheets and 4308-27 thru 4308-43, and end sheet). See p. 4308-36 Type KFD Diverter.
Coflexip Brochure; 1-Coflexip Sales Offices, 2-the Flexible Steel Pipe for Drilling and Service Applications, 3-New 5 I.D. General Drilling Flexible, 4-Applications, and 5-Illustration (5 unnumbered pages).
Baker, Ron, "A Primer of Oilwell Drilling," Fourth Edition, Published Petroleum Extension Service, The University of Texas at Austin, Austin, Texas, in cooperation with International Association of Drilling Contractors Houston, Texas © 1979 (3 cover pages and pp. 42-49 re Circulation System).
Brochure, Lock down Lubricator System, Dutch Enterprises, Inc., "Safety with Savings" (cover sheet and 16 unnumbered pages); see above US Patent No. 4,836,289 referred to therein.
Hydril GL series Annual Blowout Preventers (Patented—see Roche patents above), (cove sheet and 2 pages).
Other Hydril Product Information (The GH Gas Handler Series Product is Listed), © 1996, Hydril Company (Cover sheet and 19 pages).
Brochure, Shaffer Type 79 Rotating Blowout Preventer, NL Rig Equipment/NL Industries, Inc., (6 unnumbered pages).
Shaffer, A Varco Company, (Cover page and pp. 1562-1568).
Avoiding Explosive Unloading of Gas in a Deep Water Riser When SOBM in Use; Colin P. Leach & Joseph R. Roche—1998 (The Paper Describes an Application for the Hydril Gas Handler, The Hydril GH 211-2000 Gas Handler is Depicted in Figure 1 of the Paper) (9 unnumbered pages).
Feasibility Study of Dual Density Mud System for Deepwater Drilling Operations; Clovis A. Lopes & A.T. Bourgoyne, Jr.—1997 (Offshore Technology Conference Paper No. 8465); (pp. 257-266).
Apr. 1998 Offshore Drilling with Light Weight Fluids Joint Industry Project Presentation (9 unnumbered pages).
Nakagawa, Edson Y., Santos, Helio and Cunha, J.C., "Application of Aerated-Fluid Drilling in Deepwater," SPE/IACDC 52787 Presented by Don Hannegan, P.E., SPE © 1999 SPE/IADC Drilling Conference, Amsterdam, Holland, Mar. 9-11, 1999 (5 unnumbered pages).
Brochure: "Inter-Tech Drilling Solutions, Ltd.'s RBOP™ Means Safety and Experience for Underbalanced Drilling," Inter-Tech Drilling Solutions Ltd./Big D Rentals & Sales (1981) Ltd. and Color "Rotating BOP" (2 unnumbered pages).
"Pressure Control While Drilling," Shaffer® A Varco Company, Rev. A (2 unnumbered pages).
Field Exposure (as of Aug. 1998), Shaffer® A Varco Company (1 unnumbered page).
Graphic: "Rotating Spherical BOP" (1 unnumbered page).
"JIP's Worl Brightens Outlook for UBD in Deep Waters" by Edson Yoshihito Nakagawa, Helio Santos and Jose Carlos Cunha, American Oil & Gas Reporter, Apr. 1999, pp. 53, 56, 58-60 and 63.
"Seal-Tech 1500 PSI Rotating Blowout Preventer," Undated, 3 pages.
"RPM System 3000™ Rotating Blowout Preventer, Setting a new standard in Well Control," by Techcorp Industries, Undated, 4 pages.
"RiserCap™ Materials Presented at the 1999 LSU/MMS/IADC Well Control Workshop", by Williams Tool Company, Inc., Mar. 24-25, pp. 1-14.
"The 1999 LSU/MMS/IADC Well Control Workshop: An overview," by John Rogers Smith. World Oil, Jun. 1999. Cover page and pp. 4, 41-42, and 44-45.
Dag Oluf Nessa, "Offshore underbalanced drilling system could revive field developments," World Oil, vol. 218, No. 10, Oct. 1997, 1 unnumbered page and pp. 83-84, 86, and 88.
D.O. Nessa, "Offshore underbalanced drilling system could revive filed developments," World Oil Exploration Drilling Production, vol. 218, No. 7, Color pages of Cover Page and pp. 3, 61-64, and 66, Jul. 1997.
PCT Search Report, International Application No. PCT/US99/06695, 4 pages (date of Completion May 27, 1999).
PCT Search Report, International Application No. PCT/GB00/00731, 3 pages (Date of Completion Jun. 16, 2000).
National Academy of Sciences—National Research Council, "Design of a Deep Ocean Drilling Ship," Cover Page and pp. 114-121. Undated but cited in above US Patent No. 6,230,824B1.
History and Development of a Rotating Preventer, by A. Cress, Rick Stone, and Mike Tangedahl IADC/SPE 23931, 1992 IADC/SPE Drilling Conference, Feb. 1992, pp. 757-773.
Helio Santos, Email message to Don Hannegan, et al., 1 page (Aug. 20, 2001).
Rehm, Bill, "Practical Underbalanced Drilling and Workover," Petroleum Extension Service, The University of Texas at Austin Continuing & Extended Education, Cover page, title page, copyright page, and pp. 6-6, 11-2, 11-3, G-9, and G-10 (2002).
Williams Tool Company Inc., "Risercap™: Rotating Control Head System for Floating Drilling Rig Applications," 4 unnumbered pages, (© 1999 Williams Tool Company, Inc.).
Antonio C.V.M. Lage, Helio, Santos and Paulo R.C. Silva, Drilling With Aerated Drilling Fluid From a Floating Unit Part 2: Drilling the Well, SPE 71361, 11 pages (© 2001, Society of Petroleum Engineers, Inc.)
Helio Santos, Fabio Rosa, and Christian Leuchtenberg, Drilling and Aerated Fluid from a Floating Unit, Part 1: Planning, Equipment, Test, and Rig Modifications, SPE/IADC 67748, 8 pages (© SPE/IADC Drilling Conference).
E.Y. Nakagawa, H. Santos, J.C. Cunha and S. Shayegi, Planning of Deepwater Drilling Operations with Aerated Fluids, SPE 54283, 7 pages, (© 1999, Society of Petroleum Engineers).

(56) References Cited

OTHER PUBLICATIONS

E.Y. Nakagawa, H.M.R. Santos and J.C. Cunha, Implementing the Light-Weight Fluids Drilling Technology in Deepwater Scenarios, 1999 LSU/MMS Well Control Workshop Mar. 24-25, 1999, 12 pages (1999).
Press Release, "Stewart & Stevenson Introduces First Dual Gradient Riser," Stewart & Stevenson, http:/www.ssss/com/ssss/20000831.asp, 2 pages (Aug. 31, 2000).
Press Release: "Stewart & Stevenson introduces First Dual Gradient Riser," Stewart & Stevenson, http:www/ssss/com/ssss/20000831.asp, 2 pages (Aug. 31, 2000).
Williams Tool Company Inc., "Williams Tool Company Introduces the . . . Virtual Riser™," 4 unnumbered pages, (© 1998 Williams Tool Company, Inc.).
"PETEX Publications," Petroleum Extension Service, University of Texas at Austin, 12 pages, (last modified Dec. 6, 2002).
"BG in the Caspian region," SPE Review, Issue 164, 3 unnumbered pages (May 2003).
"Field Cases as of Mar. 3, 2003," Impact Fluid Solutions, 6 pages (Mar. 3, 2003).
"Determine in the Safe Application of Underbalanced Drilling Technologies in Marine Environments—Technical Proposal," Maurer Technology, Inc., Cover Page and pp. 2-13 (Jun. 17, 2002).
Colbert, John W., "John W. Colbert, P.E. Vice President Engineering Biographical Data," Signa Engineering Corp., 2 unnumbered pages (undated).
"Technical Training Courses," Parker Drilling Co., http:/www.parkerdrilling.com/news/tech.html, 5 pages (last visited, Sep. 5, 2003).
"Drilling equipment: Improvements from data recording to slim hole," Drilling Contractor, pp. 30-32, (Mar./Apr. 2000.
"Drilling conference promises to be informative," Drilling Contractor, p. 10 (Jan./Feb. 2002).
"Underbalanced and Air Drilling," OGCI, Inc., http:/www.ogci.com/course_info.asp?counselD=410, 2 pages, (2003).
"2003 SPE Calendar," Society of Petroleum Engineers, Google cache of http:/www.spe.org/spe/cda/views/events/eventMaster/0,1470,1648_2194_632303.00.html; for "mud cap drilling", 2 pages (2001).
"Oilfield Glossary: reverse-circulating valve," Schlumberger Limited, 1 page (2003).
Murphy, Ross D. and Thompson, Paul B., "A drilling contractor's view of underbalanced drilling," World Oil Magazine, vol. 223, No. 5, 9 pages (May 2002).
"Weatherford UnderBalanced Services: General Underbalance Presentation to the DTI," 71 unnumbered pages, © 2002.
Rach, Nina M., "Underbalanced near-balanced drilling are possible offshore," Oil & Gas Journal, Color Copies, pp. 39-44, (Dec. 1, 2003).
Forrest, Neil et al., Subsea Equipment for Deep Water Drilling Using Dual Gradient Mud System, SPE/IADC Drilling Conference held in Amsterdam, The Netherlands, Feb. 27, 2001 to Mar. 1, 2001, Paper SPE/IADC 67707, © 2001 SPE/IADC Drilling Conference (8 pages); particularly see p. 3, col. 1, ¶ 4 and col. 2, ¶ 5 and Figs. 4-6; cited in 7V below where indicated as "technical background".
Hannegan, D.M.; Bourgoyne, Jr., A.T.: "Deepwater Drilling with Lightweight Fluids—Essential Equipment Required," SPE/IADC 67708, pp. 1-6 (© 2001, SPE/IADC Drilling Conference).
Hannegan, Don M., "Underbalanced Operations Continue Offshore Movement," SPE 68491, pp. 1-3, (© 2001, Society of Petroleum Engineers, Inc.).
Hannegan, D. and Divine, R., "Underbalanced Drilling—Perceptions and Realities of Today's Technology in Offshore Applications," IADC/SPE 74448, p. 1-9, (© 2002, IADC/SPE Drilling Conference).
Hannegan, Don M. and Wanzer, Glen: "Well Control Considerations—Offshore Applications of Underbalanced Drilling Technology," SPE/IADC 79854, pp. 1-14, (© 2003, SPE/IADC Drilling Conference).
Bybee, Karen, "Offshore Applications of Underbalanced—Drilling Technology," Journal of Petroleum Technology, Cover Page and pp. 51-52, (Jan. 2004).
Bourgoyne, Darryl A.; Bourgoyne, Adam T.; Hannegan, Don; "A Subsea Rotating Control Head for Riserless Drilling Applications," IADC International Deep Water Well Control Conference, pp. 1-14, (Aug. 26-27, 1998) (see document T).
Lage, Antonio C.V.M.; Santos, Helio; Silva, Paulo R.C.; "Drilling With Aerated Drilling Fluid From a Floating Unit Part 2: Drilling the Well," Society of Petroleum Engineers, SPE 71361, pp. 1-11 (Sep. 30-Oct. 3, 2001)(see document BBB).
Furlow, William; "Shell's seafloor pump, solids removal key to ultra-deep, dual-gradient drilling (Skid ready for commercialization),"Offshore World Trends and Technology for Offshore Oil and Gas Operations, Cover page, table of contents, pp. 54, 2 unnumbered pages, and 106 (Jun. 2001).
Rowden, Michael V.: "Advances in riserless drilling pushing the deepwater surface string envelope (Alternative to seawater, CaCl2 sweeps);"Offshore World Trends and Technology for Offshore Oil and Gas Operations, Cover page, table of contents, pp. 56, 58, and 106 (Jun. 2001).
Boye, John: "Multi Purpose Intervention Vessel Presentation," M.O.S.T. Multi Operational Service Tankers, Weatherford International, Jan. 2004, 43 pages. (© 2003).
GB Search Report, International Application No. GB 0324939.8, 1 page (Jan. 21, 2004).
MicroPatent® list of patents citing US Patent No. 3,476,195, printed on Jan. 24, 2003.
PCT Search Report, International Application No. PCT/EP2004/052167, 4 pages (Date of Completion Nov. 25, 2004).
PCT Written Opinion of the International Searching Authority, International Application No. PCT/EP2004/052167, 6 pages.
Supplementary European Search Report No. EP 99908371, 3 pages (Date of Completion Oct. 22, 2004).
*General Catalog*, 1970-1971, Vetco Offshore, Inc., Subsea Systems; cover page, company page and numbered pp. 4800, 4816-4818; 6 pages total, in particular see numbered p. 4816 for "patented" Vetco H-4 connectors.
*General Catalog*, 1972-73, Vetco Offshore, Inc., Subsea Systems; cover page; company page and numbered pp. 4498, 4509-4510; 5 pages total.
*General Catalog*, 1974-75, Vetco Offshore, Inc.; cover page, company page and numbered pp. 5160, 5178-5179; 5 pages total.
*General Catalog*, 1976-1977, Vetco Offshore, Inc., Subsea Drilling and Completion Systems; cover page and numbered pp. 5862-5863; 4 pages total.
*General Catalog*, 1982-1983, Vetco; cover page and numbered pp. 8454-8455, 8479; 4 pages total.
Shaffer, *A Varco Company: Pressure Control While Drilling System*, http:/www.tulsaequipm.com; printed Jun. 21, 2004; 2 pages.
*Performance Drilling by Precision Drilling. A Smart Equation*, Precision Drilling, © 2002 Precision Drilling Corporation; 12 pages, in particular see 9th page for "Northland's patented RBOP . . . ".
*RPM System, 3000™ Rotating Blowout Preventer: Setting a New Standard in Well Control*, Weatherford, Underbalanced Systems: © 2002-2005 Weatherford; Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford, 28 pages.
Hold™ 2500 RCD Rotating Control Device web page and brochure, http://www.smith.com/hold2500; printed Oct. 27, 2004, 5 pages.
Rehm, Bill, "Practical Underbalanced Drilling and Workover," Petroleum Extension Service, The University of Texas at Austin Continuing & Extended Education, cover page, title page, copyright page and pp. 6-1 to 6-9, 7-1 to 7-9 (2002).
"Pressured Mud Cap Drilling from a Semi-Submersible Drilling Rig," J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).

(56) References Cited

OTHER PUBLICATIONS

Tangedahl, M.J., et al., "Rotating Preventers: Technology for Better Well Control," World Oil, Gulf Publishing Company, Houston, TX, US, vol. 213, No. 10, Oct. 1992, numbered pp. 63-64 and 66 (3 pages).
European Search Report for EP 05 27 0083, Application No. 05270083.8-2315, European Patent Office, Mar. 2, 2006, corresponding to U.S. Appl. No. 10/995,980, published as US2006/0108119 A1 (now US 7,487,837 B2) (5 pages).
Netherlands Search Report for NL No. 1026044, dated Dec. 14, 2005 (3 pages).
Int'l. Search Report for PCT/GB 00/00731 corresponding to US :Patent No. 6,470,975 (Jun. 16, 2000) (2 pages).
GB0324939.8 Examination Report corresponding to US Patent No. 6,470,975 (Mar. 21, 2006) (6 pages).
GB0324939.8 Examination Report corresponding to US Patent No. 6,470,975 Jan. 22, 2004) (3 pages).
2003/0106712 Family Lookup Report (Jan. 15, 2006) (5 pages).
6,470,975 Family Lookup Report (Jun. 15, 2006) (5 pages).
AU S/N 28183/00 Examination Report corresponding to US Patent No. 6,470,975 (1 page) (Sep. 9, 2002).
NO S/N 20013953 Examination Report corresponding to US Patent No. 6,470,975 w/one page of English translation (3 pages) (Apr. 29, 2003).
Nessa, D.O. & Tangedahl, M.L. & Saponia, J: Part 1: "Offshore underbalanced drilling system could revive field developments," World Oil, vol. 218, No. 7, Cover p. 3, 61-64 and 66 (Jul. 1997); and Part 2: "Making this valuable reservoir drilling/completion technique work on a conventional offshore drilling platform." World Oil, vol. 218 No. 10, Cover Page, 3, 83, 84, 86 and 88 (Oct. 1997) (see 5A, 5G above and 5I below).
Int'l. Search Report for PCT/GB 00/00731 corresponding to US Patent No. 6, 470,975 (4 pages) (Jun. 27, 2000).
Int'l. Preliminary Examination Report for PCT/GB 00/00731 corresponding to US Patent No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to US Patent No. 6,263,982 (1 page) (Sep. 6, 2002).
EU Examination Report for WO 00/906522.8-2315 corresponding to US Patent No. 6,263,982 (4 pages) (Nov. 29, 2004).
NO S/N 20013952 Examination Report w/two pages of English translation corresponding to US Patent No. 6,263,982 (4 pages) (Jul. 2, 2005).
PCT/GB00/00726 Int'l. Preliminary Examination Report corresponding to US Patent No. 6,263,982 (10 pages) (Jun. 26, 2001).
PCT/GB00/00726 Written Opinion corresponding to US Patent No. 6,263,982 (7 pages) (Dec. 18, 2000).
PCT/GB00/00726 International Search Report corresponding to US Patent No. 6,263,982 (3 pages (Mar. 2, 1999).
AU S/N 27822/99 Examination Report corresponding to US Patent No. 6,138,774 (1 page) (Oct. 15, 2001).
EU 99908371.0-1266-US99/03888 European Search Report corresponding to US Patent No. 6,138,774 (3 pages) (Nov. 2, 2004).
NO S/N 20003950 Examination Report w/one page of English translation corresponding to US Patent No. 6,138,774 (3 pages) (Nov. 1, 2004).
PCT/US990/03888 Notice of Transmittal of International Search Report corresponding to US Patent No. 6,138,774 (6 pages) (Aug. 4, 1999).
PCT/US99/03888 Notice of Transmittal of International Search Report corresponding to US Patent No. 6,138,774 (6 pages) (Aug. 4, 1999).
PCT/US99/03888 Notice of Transmittal of International Preliminary Examination Report corresponding to US Patent No. 6,138,774 (15 pages) (Jun. 12, 2000).
EU Examination Report for 05270083.8-2315 corresponding to U.S. Appl. No. 10/995,980, published as US 2006/0108119 A1 (now US 7,487,837 B2) (11 pages) (May 10, 2006).
Tangedahl, M.J., et al. "Rotating Preventers: Technology for Better Well Control," World Oil, Gulf Publishing Company, Houston, TX, US, vol. 213, No. 10, Oct. 1992, numbered pp. 63-64 and 66 (3 pages) XP 000288328 ISSN: 0043-8790 (see YYYY, 5X above).
UK Search Report for Application No. GB 0325423.2, searched Jan. 30, 2004 corresponding to above US Patent No. 7,040,394 (one page).
UK Examination Report for Application No. GB 0325423.2 (corresponding to above 5Z) (4 pages).
Dietle, Lannie L., et al., Kalsi Seals Handbook, Document. 2137 Revision 1, © 1992-2005 Kalsi Engineering, Inc. of Sugar Land, Texas USA; front and back covers and 164 total pages; in particular forward p. ii for "Patent Rights"; Appendix A-6 for Kalsi seal part No. 381-6- and A-10 for Kalsi seal part No. 432-32-. as discussed in U.S. Appl. No. 11/366,078 application (now U S 7,836,946 B2) at number paragraph 70 and 71.
Fig. 10 and discussion in U.S. Appl. No. 11/366,078 application, published as US2006/0144622 A1 (now U S 7,836,946 B2) of Background of Invention.
Partial European search report R.46 EPC dated Jun. 27, 2007 for European Patent Application EP07103416.9-2315 corresponding to U.S. Appl. No. 11/366,078, published as US 2006/0144622 A1, now US Patent 7,836,946 (5 pages).
Extended European search report R.44 EPC dated Oct. 9, 2007 for European Patent Application 07103416.9-2315 corresponding to U.S. Appl. No. 11/366,078, published as US-2006/0144622 A1, now US patent 7,836,946 (8 pages).
U.S. Appl. No. 60/079,641, Mudlift System for Deep Water Drilling, filed Mar. 27, 1998, abandoned, but priority claimed in above US 6,230,824 B1 and 6,102,673 and PCT WO-99/50524 (54 pages).
U.S. Appl. No. 60/122,530, Concepts for the Application of Rotating Control Head Technology to Deepwater Drilling Operations, filed Mar. 2, 1999, abandoned, but priority claimed in above US 6,470,975 B1 (54 pages).
PCT/GB2008/050239 (corresponding to US2008/0210471 A1; now issued as US 7,926,593) Annex to Form PCT/ISA/206 Communication Relating to the Results of the Partial International Search dated Aug. 26, 2008 (4 pages).
PCT/GB2008/050239 (corresponding to US2008/0210471 A1; now issued as US 7,926,593) International Search Report and Written Opinion of the International Searching Authority (19 pages).
Vetco Gray Product Information CDE-PI-0007 dated Mar. 1999 for 59.0 Standard Bore CSO Diverter (2 pages) © 1999 by Vetco Gray Inc.
Vetco Gray Capital Drilling Equipment KFDJ and KFDJ Model "J" Diverters (1 page) (no. date).
Hydril Blowout Preventers Catalog M-9402 D (44 pages) © 2004 Hydrill Company LP; see annular and ram BOP seals on p. 41.
Hydril Compact GK® 7 1/16-3000 & 5000 psi Annular Blowout Preventers, Catalog 9503B © 1999 Hydril Company (4 pages).
Weatherford Controlled Pressure Drilling *Williams*® Rotating Marine Diverter Insert (2 pages).
Weatherford Controlled Pressure Drilling Model 7800 Rotating Control Device © 2007 Weatherford(5 pages).
Weatherford Controlled Pressure Drilling® and Testing Services *Williams*® Model 8000/9000 Conventional Heads © 2002-2006 Weatherford(2 pages).
Weatherford "Real Results Rotating Control Device Resolves Mud Return Issues in Extended-Reach Well, Saves Equipment Costs and Rig Time" © 2007 Weatherford and "Rotating Control Device Ensures Safety of Crew Drilling Surface-Hole Section" © 2008 Weatherford (2 pages).
Washington Rotating Control Heads, Inc. Series 1400 Rotating Control Heads ("Shorty") printed Nov. 21, 2008 (2 pages).
Smith Services product details for Rotating Control Device—RDH 500® printed Nov. 24, 2008 (4 pages).
American Petroleum Institute Specification for Drill Through Equipment—Rotating Control Devices, API Specification 16RCD, First Edition, Feb. 2005 (84 pages).
Weatherford Drilling & Intervention Services Underbalanced Systems RPM System 3000™ Rotating Blowout Preventer, Setting a

(56) References Cited

OTHER PUBLICATIONS

New Standard in Well Control, An Advanced Well Control System for Underbalanced Drilling Operations, Brochure #333.00, © 2002 Weatherford (4 pages).
Medley, George; Moore, Dennis; Nauduri, Sagar; Signa Engineering Corp.; SPE/IADC Managed Pressure Drilling & Underbalanced Operations (PowerPoint presentation; 22 pages).
Secure Drilling Well Controlled, Secure Drilling™ System using Micro-Flux Control Technology, © 2007 Secure Drilling (12 pages).
The LSU Petroleum Engineering Research & Technology Transfer Laboratory, 10-rate Step Pump Shut-down and Start-up Example Procedure for Constant Bottom Hole Pressure Manage Pressure Drilling Applications (8 pages).
United States Department of the Interior Minerals Management Service Gulf of Mexico OCS Region NTL No. 2008-G07; Notice to Lessees and Operators of Federal Oil, Gas, and Sulphur Leases in the Outer Continental Shelf, Gulf of Mexico OCS Region, Managed Pressure Drilling Projects; Issue Date: May 15, 2008; Effective Date: Jun. 15, 2008; Expiration Date: Jun. 15, 2013 (9 pages).
Gray, Kenneth; Dynamic Density Control Quantifies Well Bore Conditions in Real Time During Drilling; American Oil & Gas Reporter, Jan. 2009 (4 pages).
Kotow, Kenneth J.; Pritchard, David M.; Riserless Drilling with Casing: A New Paradigm for Deepwater Well Design, OTC-19914-PP, © 2009 Offshore Technology Conference, Houston, TX May 4-7, 2009 (13 pages).
Hannegan, Don M.; Managed Pressure Drilling—A New Way of Looking at Drilling Hydraulics—Overcoming Conventional Drilling Challenges; SPE 2006-2007 Distinguished Lecturer Series presentation (29 pages); see all but particularly see Figs. 14-20; cited in 7V below where indicated as "document cited for other reasons".
Turck Works Industrial Automation; Factor 1 Sensing for Metal Detection, cover page, first page and numbered pp. 1.157 to 1.170 (16 pages) (printed in Jan. 2009).
Balluff Sensors Worldwide; Object Detection Catalog 08/09—Industrial Proximity Sensors for Non-Contact Detection of Metallic Targets at Ranges Generally under 50mm (2 inches); Linear Position and Measurement; Linear Position Transducers; Inductive Distance Sensors; Photoelectric Distance Sensors; Magneto-Inductive Linear Position Sensors; Magnetic Linear/Rotary Encoder System; printed Dec. 23, 2008 (8 pages).
Inductive Sensors AC 2-Wire Tubular Sensors, Balluff product catalog pp. 1.109-1.120 (12 pages) (no. date).
Inductive Sensors DC 2-Wire Tubular Sensors, Balluff product catalog pp. 1.125-1.136 (12 pages) (no date).
Inductive Sensors Analog Inductive Sensors, Balluff product catalog pp. 1.157-1.170 (14 pages) (no date).
Inductive Sensors DC 3-/4-Wire Inductive Sensors, Balluff product catalog pp. 1.72-1.92 (21 pages).
Selecting Position Transducers: How to Choose Among Displacement Sensor Technologies; How to Choose Among Draw Wire, LVDT, RVDT, Potentiometer, Optical Encoder, Ultrasonic, Magnetostrictive, and Other Technologies; © 1996-2010, Space Age Control, Inc., printed Jan. 11, 2009 (7 page) (www..spaceagecontrol.com/selpt.htm).
Liquid Flowmeters, Omega.com website; printed Jan. 26, 2009 (13 pages).
Super Autochoke—Automatic Pressure Regulation Under All Conditions © 2009 M-I, LLC; MI Swaco website; printed Apr. 2, 2009 (1 page).
Extended European Search Report R.61 EPC dated Sep. 16, 2010 for European Patent Application 08166660.4-1266/2050924 corresponding to U.S. Appl. No. 11/975,554, now US 2009/0101351 A1 (7 pages).
Office Action from the Canadian Intellectual Property Office dated Nov. 13, 2008 for Canadian Application No. 2,580,177 corresponding to U.S. Appl. No. 11/366,078, published as US-2006/0144622 A1, now US Patent No. 7,836,946 B2 (3 pages).
European Patent Application No. 08719084.9 (corresponding to the present published application US2008/0210471 A1, now issued as US 7,926,593) dated Nov. 16, 2010 (4 pages).
Office Action from the Canadian Intellectual Property Office dated Apr. 15, 2008 for Canadian Application No. 2,527,395 corresponding to U.S. Appl. No. 10/995,980, published as US-2006/0108119 A1, now US Patent No. 7,487,837 B2 (3 pages).
Office Action from the Canadian Intellectual Property Office dated Apr. 9, 2009 for Canadian Application No. 2,527,395 corresponding to U.S. Appl. No. 10/995,980, published as US-2006/0108119 A1, now US Patent No. 7,487,837 B2 (2 pages).
Office Action from the Canadian Intellectual Property Office dated Dec. 15, 2009 for Canadian Application No. 2,681,868 corresponding to U.S. Appl. No. 10/995,980, published as US-2006/0108119 A1, now US Patent No. 7,487,837 B2 (2 pages).
Examiner's First Report on Australian Patent Application No. 2005234651 from the Australian Patent Office dated Jul. 22, 2010 corresponding to U.S. Appl. No. 10/995,980, published as US-1, 2006/0108119 A1, now US Patent No. 7,487,837 B2 (2 pages).
Office Action from the Canadian Intellectual Property Office dated Sep. 9, 2010 for Canadian Application No. 2,707,738 corresponding to U.S. Appl. No. 10/995,980, published as US-2006/0108119 A1, now US Patent No. 7,487,837 B2 (2 pages).
Web page of Ace Wire Spring & Form Company, Inc. printed Dec. 8, 2009 for "Garter Springs—Helical Extension & Compression" www..acewirespring.com/garter-springs.html (1 page).
Extended European Search Report (R 61 EPC) dated Mar. 4, 2011 for European Application No. 0816665.8-1266/2053197 corresponding to U.S. Appl. No. 11/975,946, published as US 2009-0101411 A1 (13 pages).
Canadian Intellectual Property Office Office Action dated Dec. 7, 2010, Application No. 2,641,238 entitled "Fluid Drilling Equipment" for Canadian Application corresponding to U.S. Appl. No. 11/975,946, published as US 2009-0101411 A1 (4 pages).
Grosso, J.A., "An Analysis of Well Kicks on Offshore Floating Drilling Vessels," SPE 4134, Oct. 1972, pp. 1-20, © 1972 Society of Petroleum Engineers (20 pages).
Bourgoyne, Jr., Adam T., et al., "Applied Drilling Engineering," pp. 168-171, © 1991 Society of Petroleum Engineers (6 pages).
Wagner, R.R., et al., "Surge Field Tests Highlight Dynamic Fluid Response," SPE/IADC 25771, Feb. 1993, pp. 883-892, © 1993 SPE/IADC Drilling Conference (10 pages).
Solvang, S.A., et al., "Managed Pressure Drilling Resolves Pressure Depletion Related Problems in the Development of the HPHT Kristin Field," SPE/IADC 113672, Jan. 2008, pp. 1-9, © 2008 IADC/SPE Managed Pressure Drilling and Underbalanced Operations Conference and Exhibition 9 pages).
Rasmussen, Ovle Sunde, et al., "Evaluation of MPD Methods for Compensation of Surge-and-Swab Pressures in Floating Drilling Operations," IADC/SPE 108346, Mar. 2007, pp. 1-11, © 2007 IADC/SPE Managed Pressure Drilling and Underbalanced Operations Conference and Exhibition (11 pages).
Shaffer Drill String Compensator available from National Oilwell Varco of Houston, Texas, printed Mar. 23, 2010 from http://www.nov.com/ProductDisplay.aspx?ID=4954&taxID=121 &terms=drill+string+compensators (1 page).
Shaffer Crown Mounted Compensator available from National Oilwell Varco of Houston, Texas, printed Mar. 23, 2010 from http://www.nov.com/ProductDisplay.aspx?ID=4949&taxID=121 &terms=active+drill+string+compensator (3 pages).
Active heave compensator available from National Oilwell Varco of Houston, Texas, printed Mar. 23, 2010 from http://www.nov.com/ProductDisplay.aspx?ID=36778,taxID=740 &terms=active+heave+compensator for (3 pages).
Durst, Doug, et al., "Subsea Downhole Motion Compensator (SDMC): Field History, Enhancements, and the Next Generation," IADC/SPE 59152, Feb. 2000, pp. 1-12, © 2000 Society of Petroleum Engineers, Inc. (12 pages).
Sensoy, Taner, et al., Weatherford Secure Drilling Well Controlled Report "Surge and Swab effects d ue to the Heave motion of floating rigs", Nov. 10, 2009 (7 pages).

(56) References Cited

OTHER PUBLICATIONS

Hargreaves, David, et al., "Early Kick Detection for Deepwater Drilling: New Probabilistic Methods Applied in the Field", SPE 71369, © 2001, Society of Petroleum Engineers, Inc. (11 pages).
HH Heavy-Duty Hydraulic Cylinders catalog, The Sheffer Corporation, printed Mar. 5, 2010 from http://www.sheffercorp.com/layout_contact.shtm (27 pages).
Unocal Baroness Surface Stack Upgrade Modifications (5 pages).
Thomson, William T., Professor of Engineering, University of California, "Vibration Theory and Applications", © 1848, 1953, 1965 by Prentice-Hall, Inc. title page, copyright page, contents page and numbered pp. 3-9 (10 pages).
Active Heave Compensator, Ocean Drilling Program, www.oceandrilling.org (3 pages).
3.3 Floating Offshore Drilling Rigs (Floaters); 3.3.1. Technologies Required by Floaters; 3.3.2. Drillships; 3.3.3. Semisubmersible Drilling Rig; 4.3.4. Subsea Control System; 4.4. Prospect of Offshore Production System (5 pages).
Weatherford® Real Results First Rig Systems Solutions for Thailand Provides Safer, More Efficient Operations with Stabmaster® and Automated Side Doors, © 2009 Weatherford document No. 6909.00 discussing Weatherford's Integrated Safety Interlock System (ISIS) (1 page).
U.S. Appl. No. 61/205,209, filed Jan. 15, 2009; Abandoned, but priority claimed in US2010/0175882A1 (24 pages).
Smalley® Steel Ring Company, Spirolox®; pages from website http://www.spirolox.com/what_happened.php printed Apr. 27, 2010 (5 pages).
Patent Cooperation Treaty International Searching Authority Invitation to Pay Additional Fees and, where Applicable, Protest Fee with Communication relating to the Results of the Partial International Search mailed Apr. 3, 2013, International Application No. PCT/EP2011/067057, now published as WO2012/041996 A2 (7 pages).
Canadian Intellectual Property Office Action dated Oct. 1, 2012, Application No. 2,641,238, entitled "Fluid Drilling Equipment"for Canadian Application corresponding to U.S. Appl. No. 11/975,946, published as US 2009-0101411 A1, now US 8,286,734 B2 issued Oct. 16, 2012 (3 pages).
Patent Cooperation Treaty Notification of Transmittal of the International Search Report and Written Opinion of the International Searching Authority, or the Declaration, mailed May 27, 2013; International Application No. PCT-EP2011-067057, now published as WO-2012-041996 A2 (our matter 67PCT) (21 pages).

* cited by examiner 130
124
154
156
158
162
126
125
6A
128
136
14
132
138
160
142
140
163
HS
6
134
137
10C
120
131
122
146
144
148
150
152
D4
D3
H5

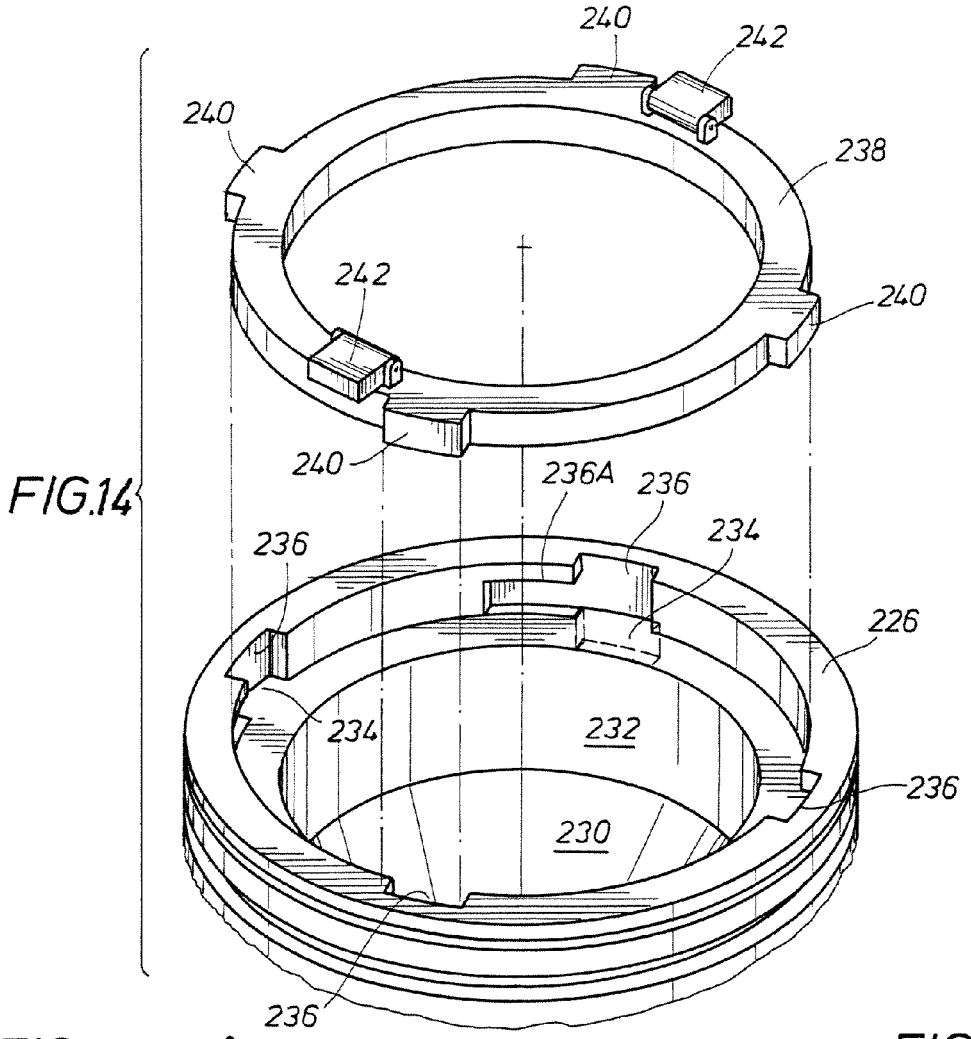
FIG.14
FIG.15
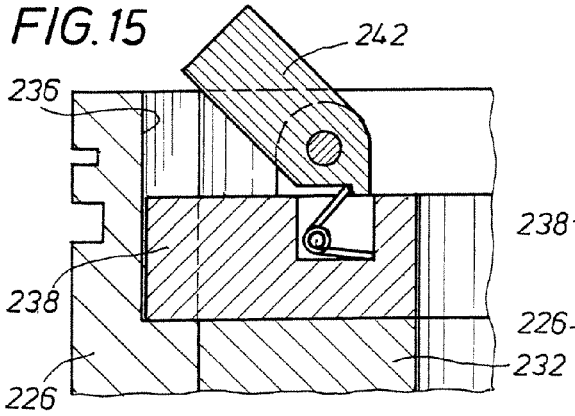
FIG.16
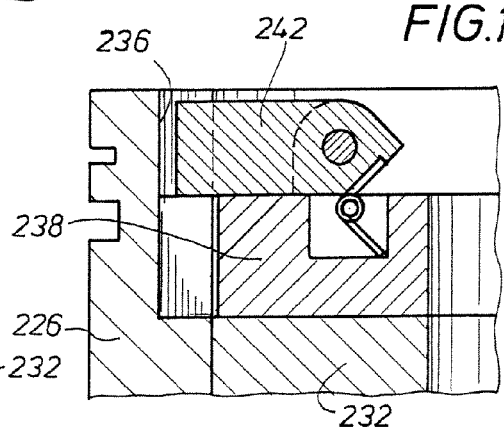

FIG. 18
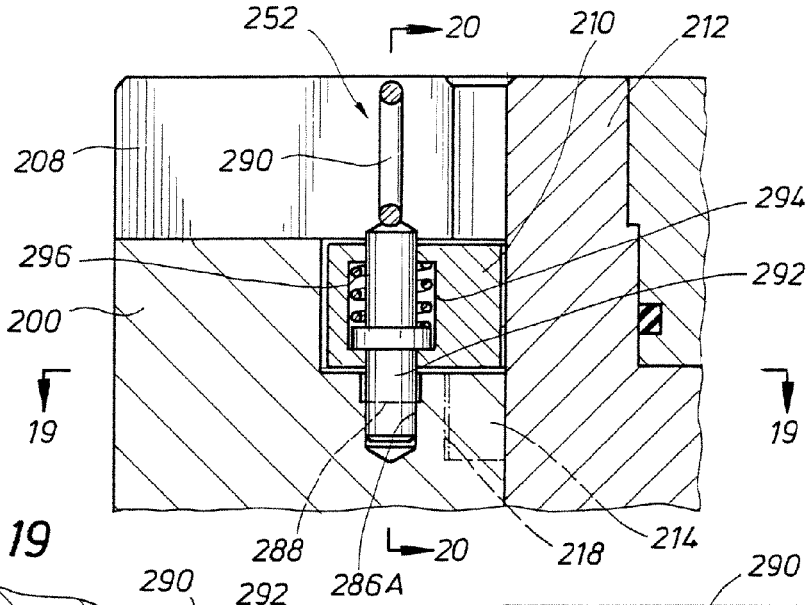
FIG. 19
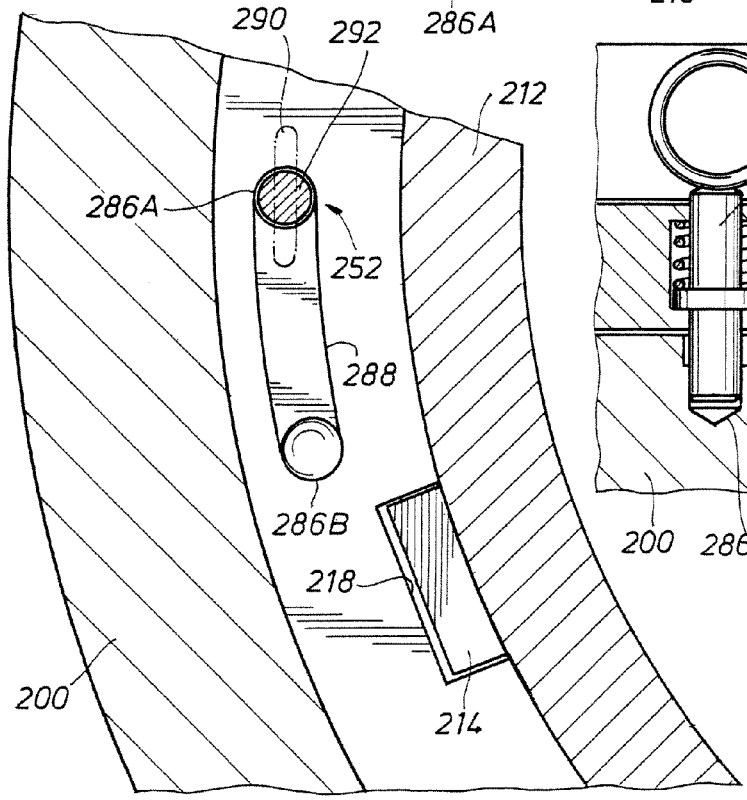
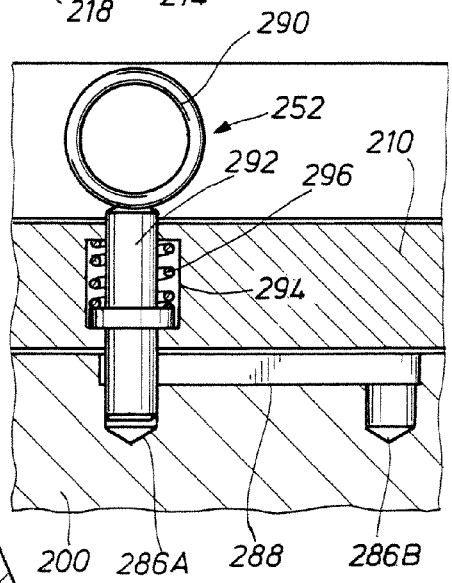
FIG. 20

INTERLOCKING LOW PROFILE ROTATING CONTROL DEVICE

CROSS-REFERENCE TO RELATED APPLICATIONS

This application is a continuation-in-part of co-pending U.S. application Ser. No. 11/975,946 filed on Oct. 23, 2007, which application is hereby incorporated by reference for all purposes in its entirety and is assigned to the assignee of the present invention.

STATEMENT REGARDING FEDERALLY SPONSORED RESEARCH OR DEVELOPMENT

N/A

REFERENCE TO MICROFICHE APPENDIX

N/A

BACKGROUND OF THE INVENTION

1. Field of the Invention

This invention relates to rotating control devices to be used in the field of fluid drilling equipment.

2. Description of the Related Art

Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

These improved techniques present a need for pressure management devices, such as rotating control heads or devices (referred to as RCDs). RCDs, such as proposed in U.S. Pat. No. 5,662,181, have provided a dependable seal in the annular space between a rotating tubular and the casing or a marine riser for purposes of controlling the pressure or fluid flow to the surface while drilling operations are conducted. Typically, a member of the RCD is designed to rotate with the tubular along with an internal sealing element(s) or seal(s) enabled by bearings. The seal of the RCD permits the tubular to move axially and slidably through the RCD. As best shown in FIG. 3 of the '181 patent, the RCD has its bearings positioned above a lower sealing element or stripper rubber seal, and an upper sealing element or stripper rubber seal is positioned directly and completely above the bearings. The '181 patent proposes positioning the RCD with a housing with a lateral outlet or port with a circular cross section for drilling fluid returns. As shown in FIG. 3 of the '181 patent, the diameter of a circular flange at the end of a circular conduit communicating with the port is substantially smaller than the combined height of the RCD and housing. The term "tubular" as used herein means all forms of drill pipe, tubing, casing, riser, drill collars, liners, and other tubulars for drilling operations as are understood in the art.

U.S. Pat. No. 6,138,774 proposes a pressure housing assembly with a RCD and an adjustable constant pressure regulator positioned at the sea floor over the well head for drilling at least the initial portion of the well with only sea water, and without a marine riser. As shown in FIG. 6 of the '774 patent, the diameters of the circular flanges are substantially smaller than the combined height of the RCD and pressure housing. Also shown in FIG. 6 of the '774 patent, a lubrication unit pressurized by a spring loaded piston is proposed that is separated from but in fluid communication with a housing disposed with a sealed bearing assembly. It is proposed that lubricant may be injected into fissures at the top and bottom of the bearing assembly to lubricate the internal components of the bearing assembly.

U.S. Pat. No. 6,913,092 B2 proposes a seal housing with a RCD positioned above sea level on the upper section of a marine riser to facilitate a mechanically controlled pressurized system that is useful in underbalanced subsea drilling. A remote controlled external disconnect/connect clamp is proposed for hydraulically clamping the bearing and seal assembly of the RCD to the seal housing. As best shown in FIG. 3 of the '092 patent, in one embodiment, the seal housing of the RCD is proposed to contain two lateral conduits extending radially outward to respective T-connectors for the return pressurized drilling fluid flow. As further shown in FIG. 3 of the '092 patent, each diameter of the two lateral conduits extending radially outward are substantially smaller than the combined height of the RCD and seal housing.

U.S. Pat. No. 4,949,796 proposes a bearing assembly with a rotatable sealing element disposed with an assembly carrier. The assembly carrier is proposed to be removably attached with a stationary housing with a clamping assembly.

U.S. Pat. No. 7,159,669 B2 proposes that the RCD positioned with an internal housing member be self-lubricating. The RCD proposed is similar to the Weatherford-Williams Model 7875 RCD available from Weatherford International of Houston, Tex. The '669 patent proposes two pressure compensation mechanisms that maintain a desired lubricant pressure in the bearing assembly. One pressure compensation mechanism is proposed to be disposed directly and completely above the bearings, and the other pressure compensation mechanism is proposed to be disposed directly and completely below the bearings. Both pressure compensation mechanisms are proposed to be disposed directly and completely between the upper and lower rotatable seals.

U.S. Pat. No. 7,487,837 proposes a remotely actuated hydraulic piston latching assembly for latching and sealing a RCD with the upper section of a marine riser or a bell nipple positioned on the riser.

Pub. No. US 2006/0144622 A1 proposes a system and method for cooling a RCD while regulating the pressure on its upper radial seal. Gas, such as air, and liquid, such as oil, are alternatively proposed for use in a heat exchanger in the RCD.

An annular blowout preventer (BOP) has been often used in conventional hydrostatic pressure drilling. As proposed in U.S. Pat. No. 4,626,135, when the BOP's annular seals are closed upon the drill string tubular, fluid is diverted via a lateral outlet or port away from the drill floor. However, drilling must cease because movement of the drill string tubular will damage or destroy the non-rotatable annular seals. During normal operations the BOP's annular seals are open, and drilling mud and cuttings return to the rig through the annular space. For example, the Hydril Company of Houston, Tex. has offered the Compact GK®7 1/16"-3000 and 5000 psi annular blowout preventers.

Small drilling rigs with short substructure heights have been used to drill shallow wells with conventional drilling techniques as described above. Some small land drilling rigs are even truck mounted. However, smaller drilling rigs and structures are generally not equipped for managed pressure and/or underbalanced drilling because they lack pressure containment or management capability. At the time many such rigs were developed and constructed, managed pressure and/or underbalanced drilling was not used. As a result of their limited substructure height, there is little space left for additional equipment, particularly if the rig already uses a BOP.

As a result of the shortage of drilling rigs created by the high demand for oil and gas, smaller drilling rigs and structures are being used to drill deeper wells. In some locations where such smaller rigs are used, such as in western Canada and parts of the northwestern and southeastern United States, there exist shallow pockets of $H_2S$ (sour gas), methane, and other dangerous gases that can escape to atmosphere immediately beneath the drill rig floor during drilling and/or workover operations. Several blowouts have occurred in drilling and/or workovers in such conditions. Even trace amounts of such escaping gases create health, safety, and environmental (HSE) hazards, as they are harmful to humans and detrimental to the environment. There are U.S. and Canadian regulatory restrictions on the maximum amount of exposure workers can have to such gases. For example, the Occupational Safety and Health Administration (OSHA) sets an eight hour daily limit for a worker's exposure to trace amounts of $H_2S$ gas when not wearing a gas mask.

Smaller drilling rigs and structures are also typically not able to drill with compressible fluids, such as air, mist, gas, or foam, because such fluids require pressure containment. There are numerous occasions in which it would be economically desirable for such smaller rigs to drill with compressible fluids. Also, HSE hazards could result without pressure containment, such as airborne debris, sharp sands, and toxins.

As discussed above, RCDs and their housings proposed in the prior art cannot fit on many smaller drilling rigs or structures due to the combined height of the RCDs and their housings, particularly if the rigs or structures already use a BOP. The RCD's height is a result in part of the RCD's bearings being positioned above the RCD's lower sealing element, the RCD's accommodation, when desired, for an upper sealing element, the means for changing the sealing element(s), the configurations of the housing, the area of the lateral outlet or port in the housing, the thickness of the bottom flange of the housing, and the allowances made for bolts or nuts on the mounting threaded rods positioned with the bottom flange of the housing.

RCDs have also been proposed in U.S. Pat. Nos. 3,128,614; 4,154,448; 4,208,056; 4,304,310; 4,361,185; 4,367,795; 4,441,551; 4,531,580; and 4,531,591. Each of the referenced patents proposes a conduit in communication with a housing port with the port diameter substantially smaller than the height of the respective combined RCD and its housing.

U.S. Pat. No. 4,531,580 proposes a RCD with a body including an upper outer member and a lower inner member. As shown in FIG. 2 of the '580 patent, a pair of bearing assemblies are located between the two members to allow rotation of the upper outer member about the lower inner member.

More recently, manufacturers such as Smith Services and Washington Rotating Control Heads, Inc. have offered their RDH 500® RCD and Series 1400 "SHORTY" rotating control head, respectively. Also, Weatherford International of Houston, Tex. has offered its Model 9000 that has a 500 psi working and static pressure with a 9 inch (22.9 cm) internal diameter of its bearing assembly. Furthermore, International Pub. No. WO 2006/088379 A1 proposes a centralization and running tool (CTR) having a rotary packing housing with a number of seals for radial movement to take up angular deviations of the drill stem. While each of the above referenced RCDs proposes a conduit communicating with a housing port with the port diameter substantially smaller than the height of the respective combined RCD and its housing, some of the references also propose a flange on one end of the conduit. The diameter of the proposed flange is also substantially smaller than the height of the respective combined RCD and its housing.

The above discussed U.S. Pat. Nos. 3,128,614; 4,154,448; 4,208,056; 4,304,310; 4,361,185; 4,367,795; 4,441,551; 4,531,580; 4,531,591; 4,626,135; 4,949,796; 5,662,181; 6,138,774; 6,913,092 B2; 7,159,669 B2; and 7,487,837; Pub. No. U.S. 2006/0144622 A1; and International Pub. No. WO 2006/088379 A1 are incorporated herein by reference for all purposes in their entirety. The '796, '181, '774, '092, '669 and '837 patents and the '622 patent publication have been assigned to the assignee of the present invention. The '614 patent is assigned on its face to Grant Oil Tool Company. The '310 patent is assigned on its face to Smith International, Inc. of Houston, Tex. The '580 patent is assigned on its face to Cameron Iron Works, Inc. of Houston, Tex. The '591 patent is assigned on its face to Washington Rotating Control Heads. The '135 patent is assigned on its face to the Hydril Company of Houston, Tex. The '379 publication is assigned on its face to AGR Subsea AS of Straume, Norway.

As discussed above, a long felt need exists for a low profile RCD (LP-RCD) system and method for managed pressure drilling and/or underbalanced drilling. It would be desirable to have a means for lubrication of the bearings of such a LP-RCD. It would be desirable to be able to efficiently replace the seal from the bearing assembly while leaving the bearing assembly in place. It would also be desirable to be able to efficiently remove the bearing assembly from its housing while leaving the housing in place.

BRIEF SUMMARY OF THE INVENTION

A low profile RCD (LP-RCD) system and method for managed pressure drilling, underbalanced drilling, and for drilling with compressible fluids is disclosed. In several embodiments, the LP-RCD is positioned with a LP-RCD housing, both of which are configured to fit within the limited space available on some rigs, typically on top of a BOP or surface casing wellhead in advance of deploying a BOP. The lateral outlet or port in the LP-RCD housing for drilling fluid returns may have a flange having a diameter that is substantially the same as the height of the combined LP-RCD and LP-RCD housing. Advantageously, in one embodiment, an annular BOP seal is integral with a RCD housing so as to eliminate an attachment member, thereby resulting in a lower overall height of the combined BOP/RCD and easy access to the annular BOP seal upon removal of the RCD.

The ability to fit a LP-RCD in a limited space enables $H_2S$ and other dangerous gases to be being diverted away from the area immediately beneath the rig floor during drilling operations. The sealing element of the LP-RCD can be advantageously replaced from above, such as through the rotary table of the drilling rig, eliminating the need for physically dangerous and time consuming work under the drill rig floor. The LP-RCD enables smaller rigs with short substructure heights to drill with compressible fluids, such as air, mist, gas, or foam. One embodiment of the LP-RCD allows rotation of the inserted tubular about its longitudinal axis in multiple planes, which is beneficial if there is misalignment with the wellbore or if there are bent pipe sections in the drill string.

Another embodiment of the LP-RCD allows the LP-RCD to be removably disposed with a LP-RCD housing by rotating a bearing assembly rotating plate. The bearing assembly rotating plate is positioned with the LP-RCD housing on roller bearings. The LP-RCD bearing assembly outer member may have tabs positioned with receiving slots in the LP-RCD housing. The bearing assembly rotating plate may be rotated to a blocking position covering the bearing assembly outer member tabs and blocking removal of the LP-RCD from the LP-RCD housing. The bearing assembly rotating plate may also be rotated to an access position uncovering the bearing assembly outer member tabs and allowing removal of the LP-RCD from the LP-RCD housing.

A spring loaded lock member or pin may be movably disposed with the bearing assembly rotating plate. The lock pin may provide an attachment point for rotation of the plate. The lock pin may be moved to a locked position resisting relative rotation between the bearing assembly rotating plate and the LP-RCD housing. The lock pin may also be moved to an unlocked position allowing relative rotation between the bearing assembly rotating plate and the LP-RCD housing. The bearing assembly rotating plate may be locked in the access position and in a blocking position. In addition, a rod may be positioned through an access opening in the LP-RCD housing into a port in the bearing assembly rotating plate to rotate the bearing assembly rotating plate between blocking and access positions. A bearing assembly retainer plate may be disposed over the bearing assembly rotating plate and attached with the LP-RCD housing to block removal of the bearing assembly rotating plate.

The sealing element may be removably disposed with the LP-RCD bearing assembly by rotating a seal retainer ring. Tabs on a seal support member or ring that supports the seal may be disposed in slots in the LP-RCD bearing assembly inner member. The seal retainer ring may be disposed over the seal support ring. Tabs on the seal retainer ring may be positioned over the seal support ring tabs in the bearing assembly inner member slots. The seal retainer ring and its tabs may be rotated through a horizontal groove to a blocking position blocking removal of the sealing element from the bearing assembly. The seal retainer ring may also be rotated to an access position allowing removal of the sealing element from the bearing assembly. Spring loaded flipper dogs on the seal retainer ring may be moved to locked positions when the seal retainer ring is in the blocking position preventing relative rotation between the seal retainer ring and the LP-RCD bearing assembly inner member. The flipper dogs may also be moved to unlocked positions allowing relative rotation between the seal retainer ring and the LP-RCD bearing assembly inner member.

Alternatively, the sealing element may be removably disposed with the LP-RCD bearing assembly with a seal support member threadedly attached with the LP-RCD bearing assembly. The seal support member may be locked into position with a seal locking ring threadedly attached with the LP-RCD bearing assembly over the seal support member.

The LP-RCD bearing assembly may be self-lubricating with a plurality of spaced apart accumulators disposed radially outward of the bearings in the bearing assembly outer member. Each accumulator may have a spring loaded piston.

BRIEF DESCRIPTION OF THE DRAWINGS

A better understanding of the present invention can be obtained with the following detailed descriptions of the various disclosed embodiments in the drawings:

FIG. 3A is a section view taken along line 3A-3A of FIGS. 2-3, to better illustrate the lateral conduit and its flange.

FIG. 14 is an exploded isometric view of the seal retainer ring with four seal retainer ring tabs and two spring loaded flippers over a top partial isometric view of the seal support ring disposed with the bearing assembly inner member with the seal support ring tabs aligned with corresponding bearing assembly inner member receiving slots.

FIG. 15 is a partial cross-sectional detail view of an exemplary seal retainer ring tab in a bearing assembly inner member receiving slot with a seal retainer ring spring loaded flipper dog in the unlocked position.

FIG. 16 is a similar view as FIG. 15 except with the spring loaded flipper dog in the locked position.

FIG. 18 is partial cross-sectional view of the bearing assembly retainer plate over the LP-RCD housing, the bearing assembly rotating plate over a bearing assembly outer member tab disposed in a corresponding LP-RCD housing bearing assembly receiving slot, with a bearing assembly rotating plate spring loaded lock member or pin disposed with the rotating plate and in a locked position with a LP-RCD housing lock pin receiving port.

FIG. 19 is a section view along line 19-19 of FIG. 18 illustrating the LP-RCD housing lock pin receiving groove and two lock pin receiving ports, and a bearing assembly outer member tab in a corresponding LP-RCD housing bearing assembly receiving slot.

FIG. 20 is a section view along line 20-20 of FIG. 18 illustrating the bearing assembly rotating plate spring loaded lock pin in the locked position with the LP-RCD housing lock pin receiving groove and one of the two lock pin receiving ports.

DETAILED DESCRIPTION OF THE INVENTION

Figure 1A:
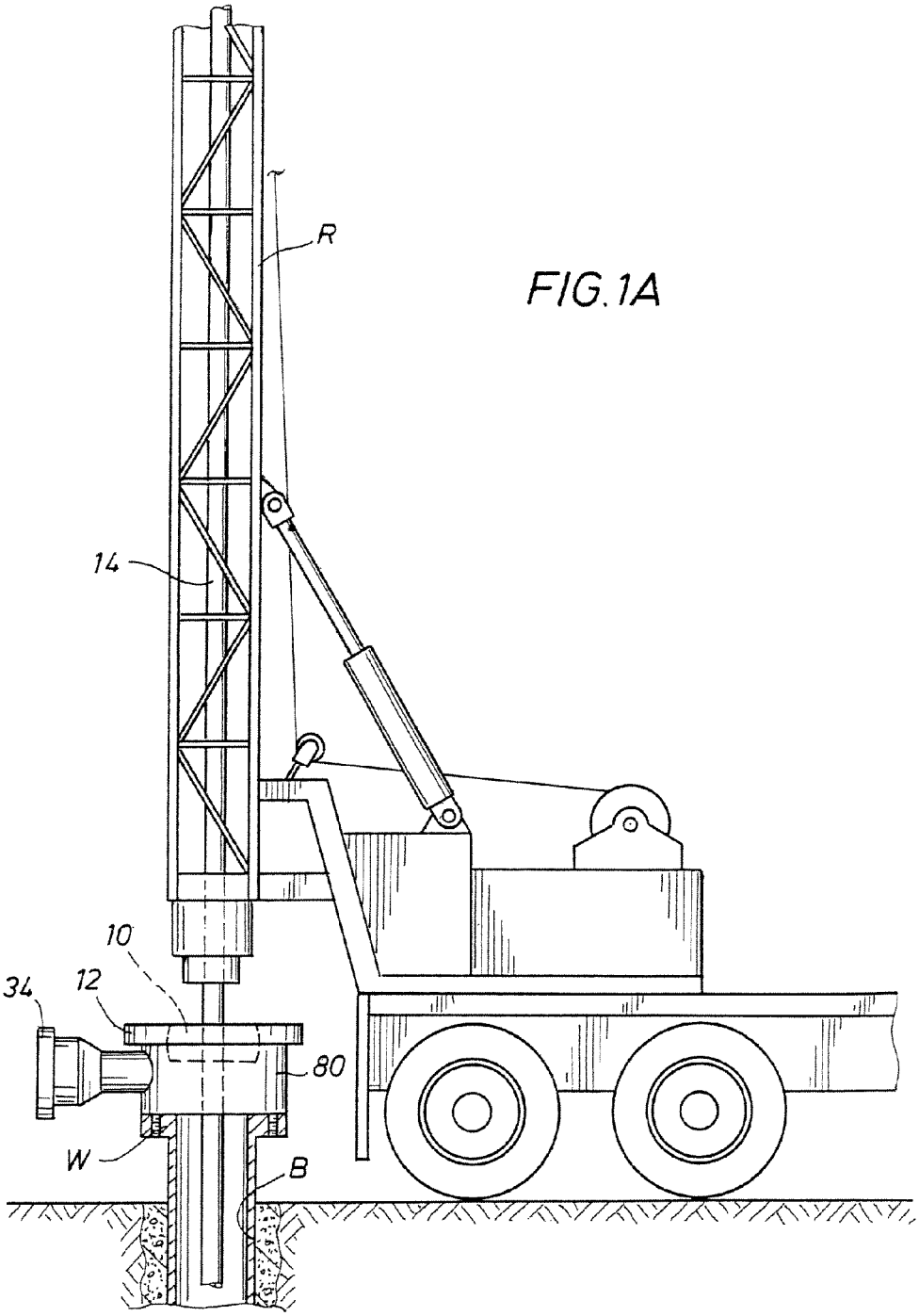
FIG. 1A is a side elevational view of a low profile rotating control device (LP-RCD), illustrated in phantom view, disposed in a LP-RCD housing positioned on a well head, along with an exemplary truck mounted drilling rig.
Figure 1B:
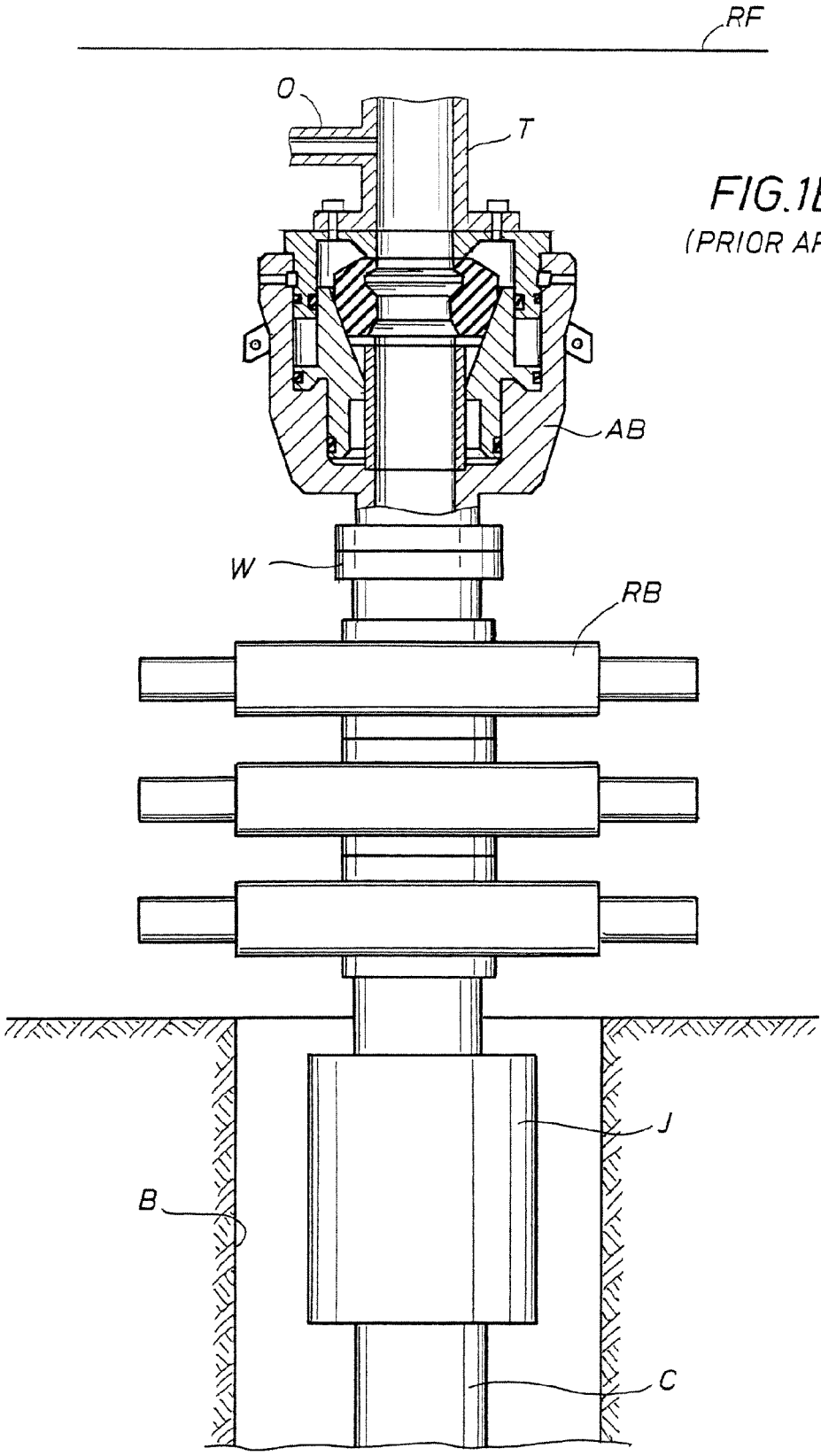
FIG.1B (PRIOR ART)
FIG. 1B is a prior art elevational view in partial cut away section of a nipple with a lateral conduit positioned on an annular BOP that is, in turn, mounted on a ram-type BOP stack.
Figure 1C:
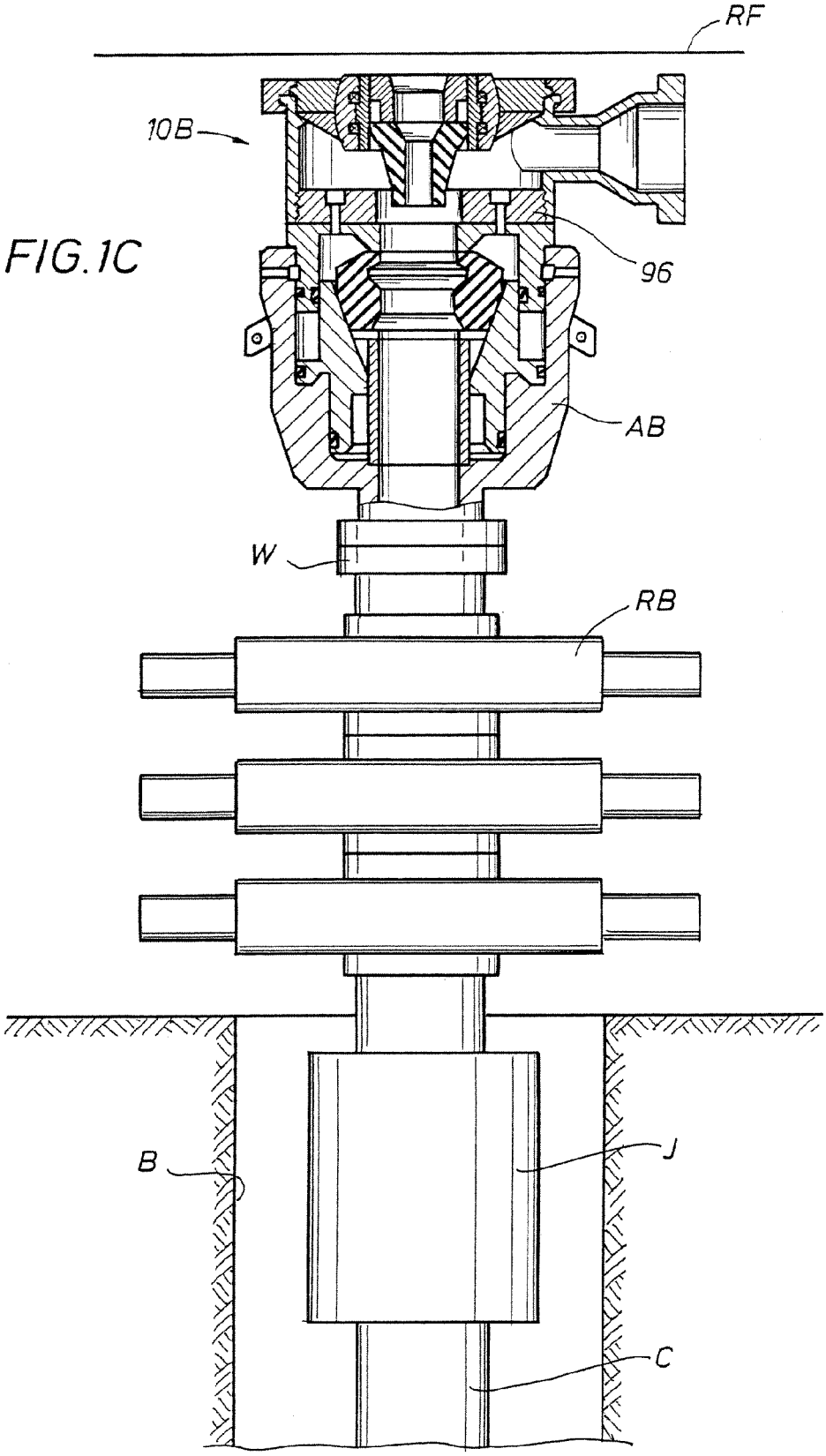
FIG. 1C is similar to FIG. 1B, except that nipple has been replaced with a LP-RCD disposed in a LP-RCD housing, which housing is positioned with an attachment retainer ring mounted on the annular BOP, all of which are shown in elevational view in a cut away section.

Generally, a system and method is disclosed for converting a smaller drilling rig with a limited substructure height between a conventional open and non-pressurized mud-return system for hydrostatic pressure drilling, and a closed and pressurized mud-return system for managed pressure drilling or underbalanced drilling, using a low profile rotating control device (LP-RCD), generally designated as 10 in FIG. 1. The LP-RCD is positioned with a desired RCD housing (18, 40, 50, 80, 132, 172, 200). The LP-RCD is further designated as 10A, 10B, 10C, or 10D in FIGS. 2-8 and 11-13 depending upon the type of rotation allowed for the inserted tubular (14, 110) about its longitudinal axis, and the location of its bearings. The LP-RCD is designated as 10A or 10D if it only allows rotation of the inserted tubular 14 about its longitudinal axis in a substantially horizontal plane, and has its bearings (24, 228) located inside of the LP-RCD housing (18, 40, 50, 172, 200) (FIGS. 2-4, 7-8, and 11-13), 10B if it allows rotation of the inserted tubular 110 about its longitudinal axis in multiple planes (FIGS. 1C and 5), and 10C if it only allows rotation of the inserted tubular about its longitudinal axis in a substantially horizontal plane, and has its bearings (126, 128) located outside of the LP-RCD housing 132 (FIG. 6). It is contemplated that the different types of LP-RCDs (as shown with 10A, 10B, 10C, and 10D) can be used interchangeably to suit the particular application. It is contemplated that the height (H1, H2, H3, H4, H5, H7) of the combined LP-RCD 10 positioned with the LP-RCD housing (18, 40, 50, 80, 132, 200) shown in FIGS. 2-6 and 11-13 may be relatively short, preferably ranging from approximately 15.0 inches (38.1 cm) to approximately 20.77 inches (52.8 cm), depending on the type of LP-RCD 10 and LP-RCD housing (18, 40, 50, 80, 132, 200) as described below, although other heights are contemplated as well.

Turning to FIG. 1A, an exemplary embodiment of a truck mounted drilling rig R is shown converted from conventional hydrostatic pressure drilling to managed pressure drilling and/or underbalanced drilling. LP-RCD 10, in phantom, is shown clamped with radial clamp 12 with an LP-RCD housing 80, which housing 80 is positioned directly on a well head W. The well head W is positioned over borehole B as is known in the art. Although a truck mounted drilling rig R is shown in FIG. 1, other drilling rig configurations and embodiments are contemplated for use with LP-RCD 10 for offshore and land drilling, including semi-submersibles, submersibles, drill ships, barge rigs, platform rigs, and land rigs. Although LP-RCD 10 is shown mounted on well head W, it is contemplated that LP-RCD 10 may be mounted on an annular BOP (See e.g. FIG. 1C), casing, or other housing that are known in the art. For example, LP-RCD 10 could be mounted on a Compact GK® annular BOP offered by the Hydril Company or annular BOPs offered by Cameron, both of Houston, Tex. Although the preferred use of any of the disclosed LP-RCDs 10 is for drilling for oil and gas, any of the disclosed LP-RCDs 10 may be used for drilling for other fluids and/or substances, such as water.

FIG. 1B shows a prior art assembly of a tubular T with lateral conduit O mounted on an annular BOP AB below a rig floor RF. Annular BOP AB is directly positioned on well head W. A ram-type BOP stack RB is shown below the well head W, and, if desired, over another annular BOP J positioned with casing C in a borehole B.

Figure 5:
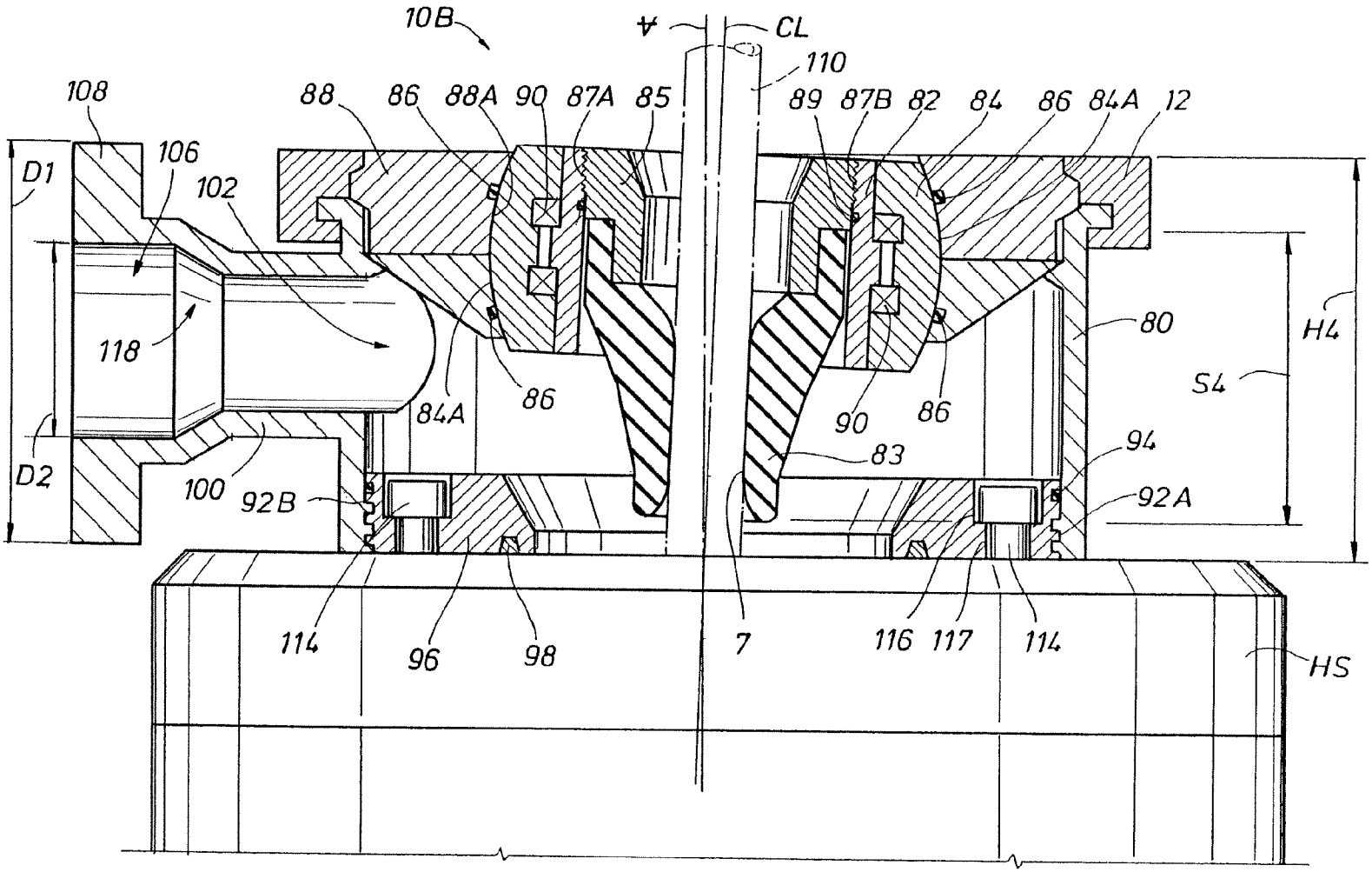
FIG. 5 is an elevational section view of a LP-RCD and LP-RCD housing, which LP-RCD allows rotation of the inserted tubular about its longitudinal axis in multiple planes, and which LP-RCD housing is threadably connected to an attachment retainer ring that is bolted to a lower housing.
Figures 6, 6A:
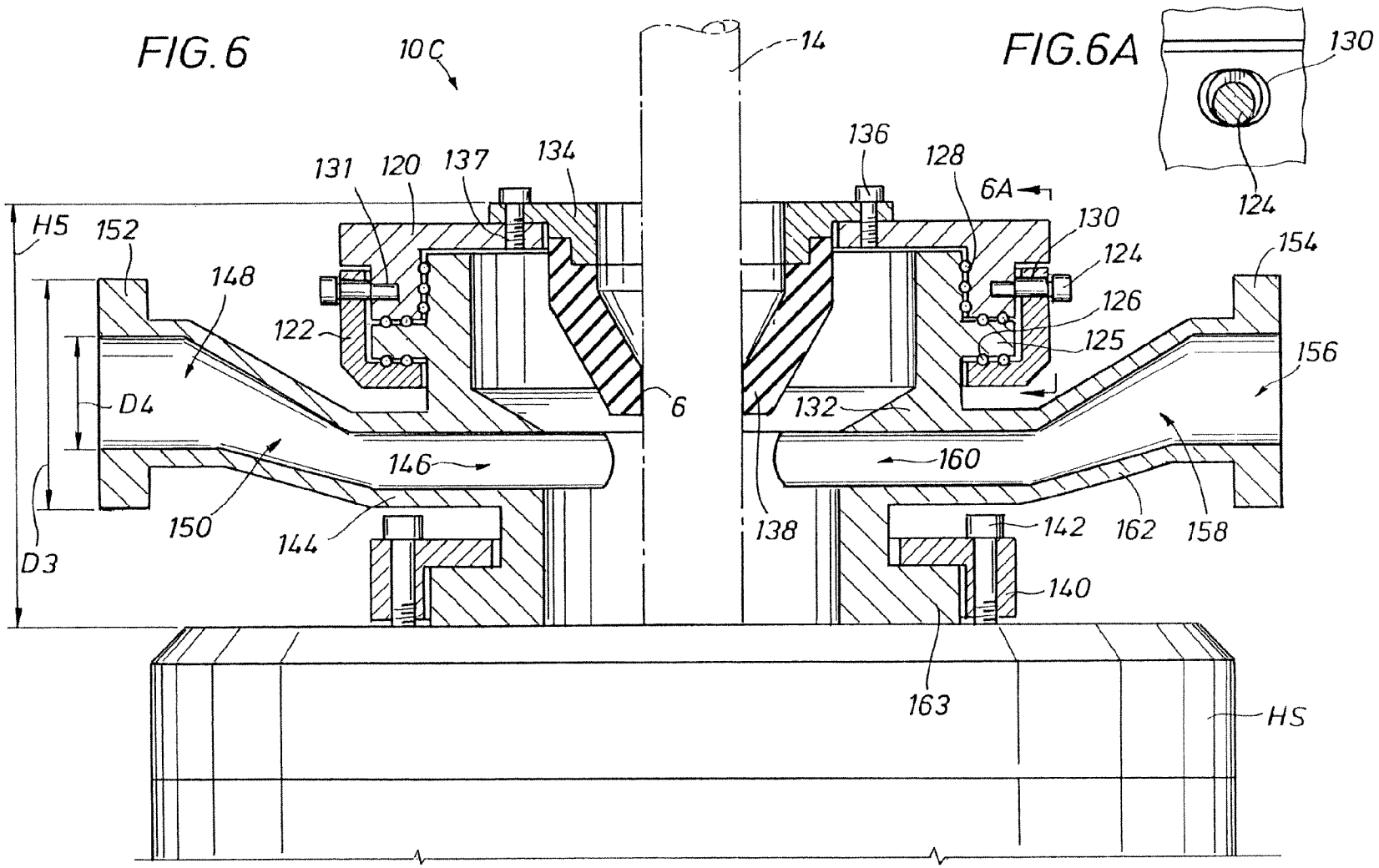
FIG. 6 is an elevational section view of a LP-RCD and LP-RCD housing, which LP-RCD allows rotation of the inserted tubular about its longitudinal axis in a horizontal plane, and which LP-RCD bearings are positioned external to the stationary LP-RCD housing so that the outer member is rotatable.
FIG. 6A is a section view taken along line 6A-6A of FIG. 6, showing the cross section of an eccentric bolt.

Turning to FIG. 1C, LP-RCD 10B, which will be discussed below in detail in conjunction with the embodiment of FIG. 5, is mounted below rig floor RF on an annular BOP AB using an attachment member or retainer ring 96, which will also be discussed below in detail in conjunction with FIG. 5. As discussed herein, any of the LP-RCDs 10 can be mounted on the top of an annular BOP AB using alternative attachment means, such as for example by bolting or nuts used with a threaded rod. Although LP-LCD 10B is shown in FIG. 1C, any LP-RCD 10, as will be discussed below in detail, may be similarly positioned with the annular BOP AB of FIG. 1C or a gas handler BOP as proposed in U.S. Pat. No. 4,626,135.

Figure 2:
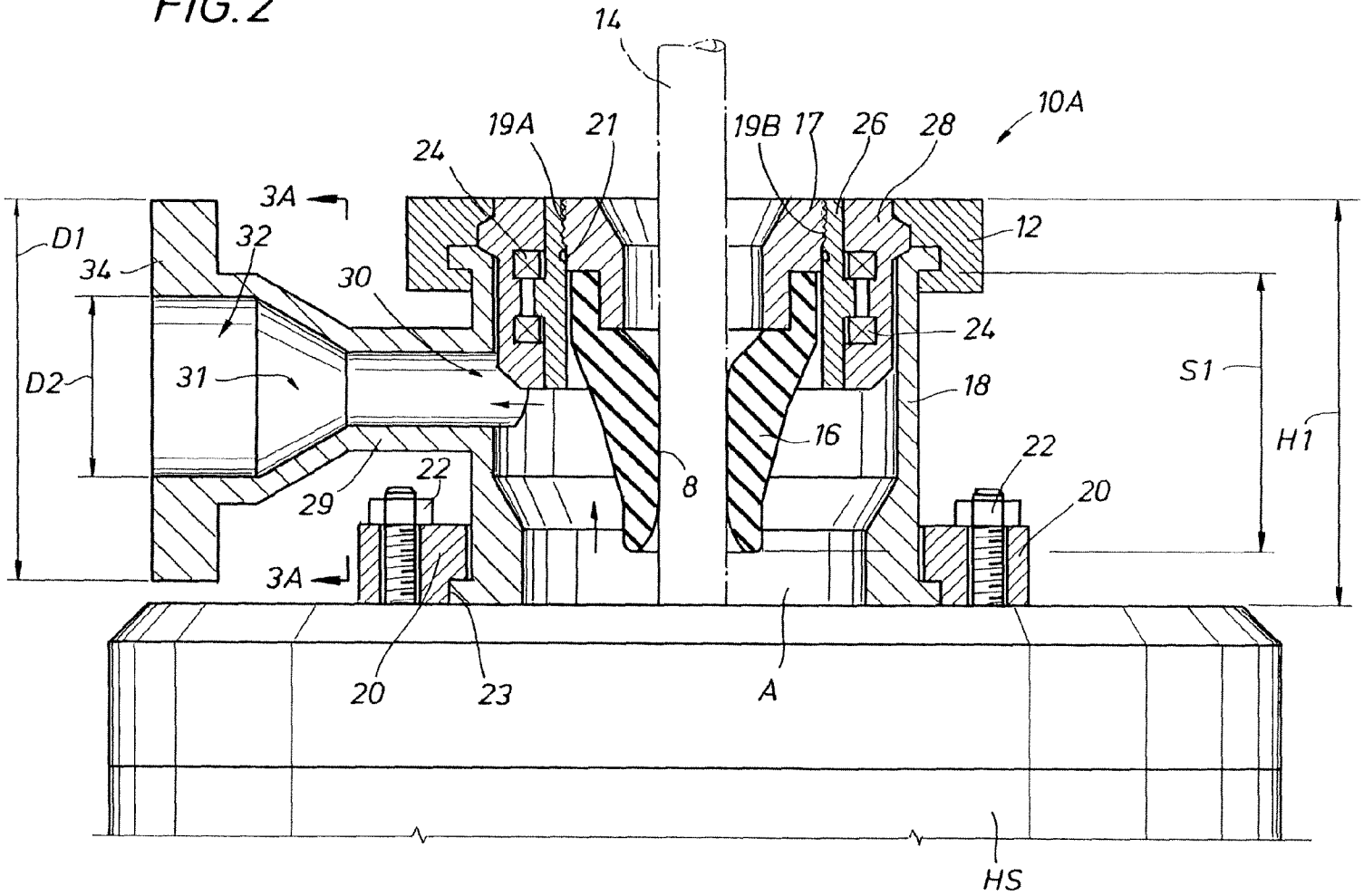
FIG. 2 is an elevational section view of a LP-RCD and LP-RCD housing, which LP-RCD allows rotation of the inserted tubular about its longitudinal axis in a horizontal plane, and which LP-RCD housing is attached to a lower housing with swivel hinges.

FIG. 2 shows tubular 14, in phantom view, inserted through LP-RCD 10A so that tubular 14 can extend through the lower member or housing HS below. Tubular 14 can move slidingly through the LP-RCD 10A, and is rotatable about its longitudinal axis in a horizontal plane. The lower housing HS in FIGS. 2-6 is preferably a compact BOP, although other lower housings are contemplated as described above. LP-RCD 10A includes a bearing assembly and a sealing element, which includes a radial stripper rubber seal 16 supported by a metal seal support member or ring 17 having a thread 19A on the ring 17 radially exterior surface. The bearing assembly includes an inner member 26, an outer member 28, and a plurality of bearings 24 therebetween. Inner member 26 has a passage with thread 19B on the top of its interior surface for a threaded connection with corresponding thread 19A of metal seal ring 17.

LP-RCD 10A is positioned with an LP-RCD housing 18 with radial clamp 12. Clamp 12 may be manual, mechanical, hydraulic, pneumatic, or some other form of remotely operated means. Bottom or lower flange 23 of LP-RCD housing 18 is positioned and fixed on top of the lower housing HS with a plurality of equally spaced attachment members or swivel hinges 20 that are attached to the lower housing HS with threaded rod/nut 22 assemblies. Swivel hinges 20 can be rotated about a vertical axis prior to tightening of the threaded rod/nut 22 assemblies. Before the threaded rod/nut 22 assemblies are tightened, swivel hinges 20 allow for rotation of the LP-RCD housing 18 so that conduit 29, further described below, can be aligned with the drilling rig's existing line or conduit to, for example, its mud pits, shale shakers or choke manifold as discussed herein. Other types of connection means are contemplated as well, some of which are shown in FIGS. 3-6 and/or described below.

Stripper rubber seal 16 seals radially around tubular 14, which extends through passage 8. Metal seal support member or ring 17 is sealed with radial seal 21 in inner member 26 of LP-RCD 10A. Inner member 26 and seal 16 are rotatable in a horizontal plane with tubular 14. A plurality of bearings 24 positioned between inner member 26 and outer member 28 enable inner member 26 and seal 16 to rotate relative to stationary outer member 28. As can now be understood, bearings 24 for the LP-RCD 10A are positioned radially inside LP-RCD housing 18. As can also now be understood, the threaded connection between metal seal support ring 17 and inner member 26 allows seal 16 to be inspected for wear and/or replaced from above. It is contemplated that stripper rubber seal 16 may be inspected and/or replaced from above, such as through the rotary table or floor RF of the drilling rig, in all embodiments of the LP-RCD 10, eliminating the need for physically dangerous and time consuming work under drill rig floor RF.

Figure 3:
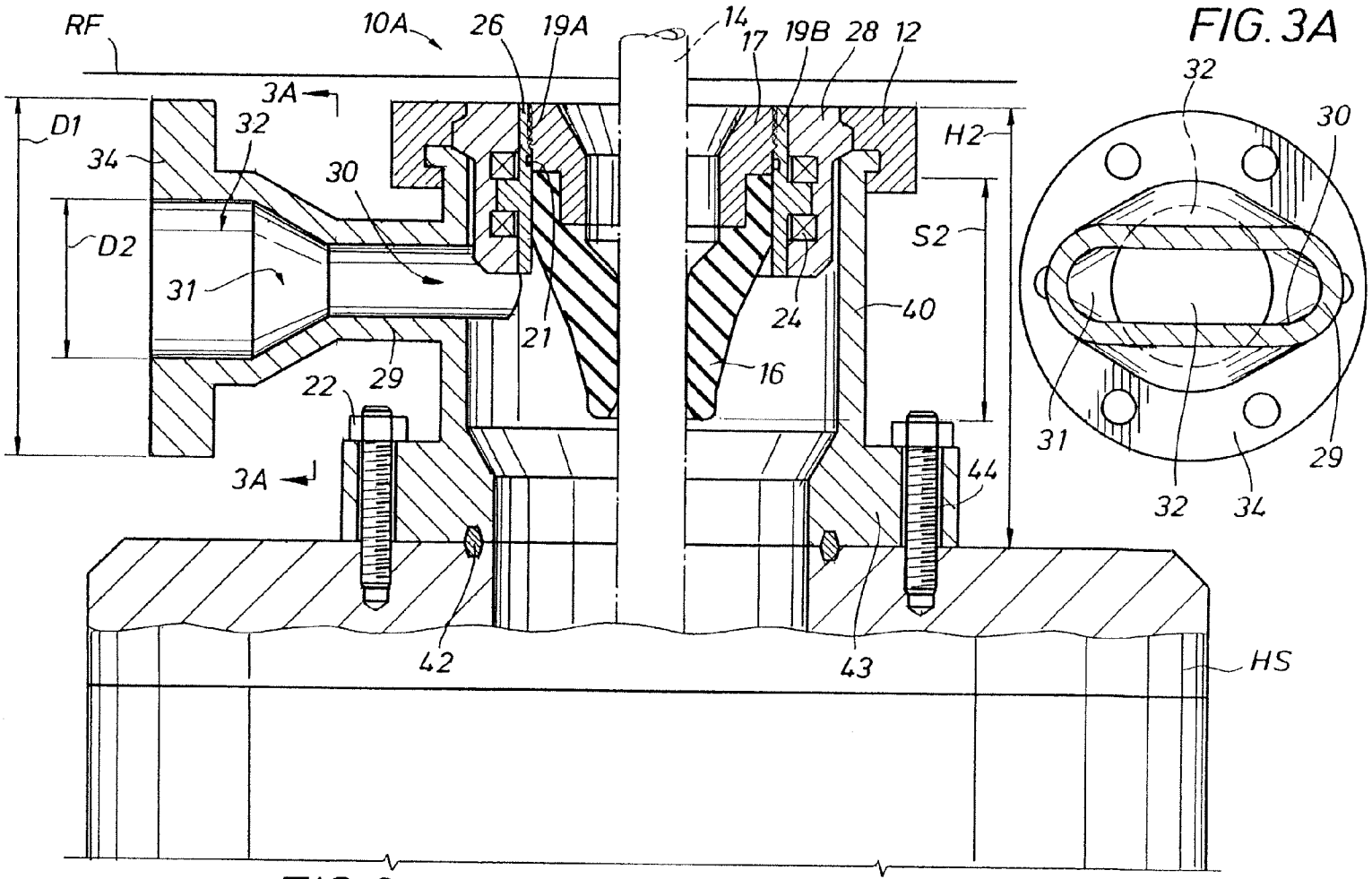
FIG. 3 is similar to FIG. 2, except that the LP-RCD housing is directly attached to a lower housing.

Reviewing both FIGS. 2 and 3, LP-RCD housing conduit 29 initially extends laterally from the housing port, generally shown as 30, with the conduit width greater than its height, and transitions, generally shown as 31, to a flange port, generally shown as 32, that is substantially circular, as is best shown in FIG. 3A. The shape of conduit 29 allows access to threaded rod/nut assemblies 22. It is also contemplated that conduit 29 may be manufactured as a separate part from LP-RCD housing 18, and may be welded to or otherwise sealed with LP-RCD housing 18. The cross sectional or flow areas of the two ports (30, 32), as well as the cross sectional or flow areas of the transition 31, are substantially identical, and as such are maximized, as is shown in FIGS. 2, 3 and 3A. However, different cross sectional shapes and areas are contemplated as well. It is further contemplated that conduit 29 and port 30 may be in alignment with a portion of seal 16. A line or conduit (not shown), including a flexible conduit, may be connected to the flange 34. It is also contemplated that a flexible conduit could be attached directly to the port 30 as compared to a rigid conduit 29. It is contemplated that return drilling fluid would flow from the annulus A through ports (30, 32), which are in communication, as shown with arrows in FIG. 2.

Turning now to FIG. 2, it is contemplated that height H1 of the combined LP-RCD 10A positioned with LP-RCD housing 18 would be approximately 16 inches (40.6 cm), although other heights are contemplated. It is further contemplated that outer diameter D1 of flange 34 would be approximately 15 inches (38.1 cm), although other diameters, shapes and sizes are contemplated as well. As can now be understood, it is contemplated that the outer flange diameter D1 may be substantially the same as housing height H1. For the embodiment shown in FIG. 2, it is contemplated that the ratio of diameter D1 to height H1 may be 0.94, although other optimized ratios are contemplated as well. In the preferred embodiment, it is contemplated that outer diameter D1 of flange 34 may be substantially parallel with height H1. It is also contemplated that diameter D2 of port 32 may be greater than fifty percent of the height H1. It is also contemplated that the seal height S1 may be greater than fifty percent of height H1.

Turning now to FIG. 3, the LP-RCD housing 40 is sealed with radial seal 42 and attached with threaded rod/nut assemblies 22 to lower member or housing HS using attachment member 43. Attachment member 43 may have a plurality of radially equally spaced openings 44 for threaded rod/nut assemblies 22. It is contemplated that height H2 of the combined LP-RCD 10A positioned with LP-RCD housing 40 would be 18.69 inches (47.5 cm), although other heights are contemplated. It is contemplated that the outer diameter D1 of flange 34 may be 15.0 inches (38.1 cm), although other diameters, shapes and sizes are contemplated as well. For the embodiment shown in FIG. 3, it is contemplated that the ratio of diameter D1 to height H2 may be 0.80, although other ratios are contemplated as well. It is also contemplated that seal height S2 may be greater than fifty percent of height H2.

Figure 4:
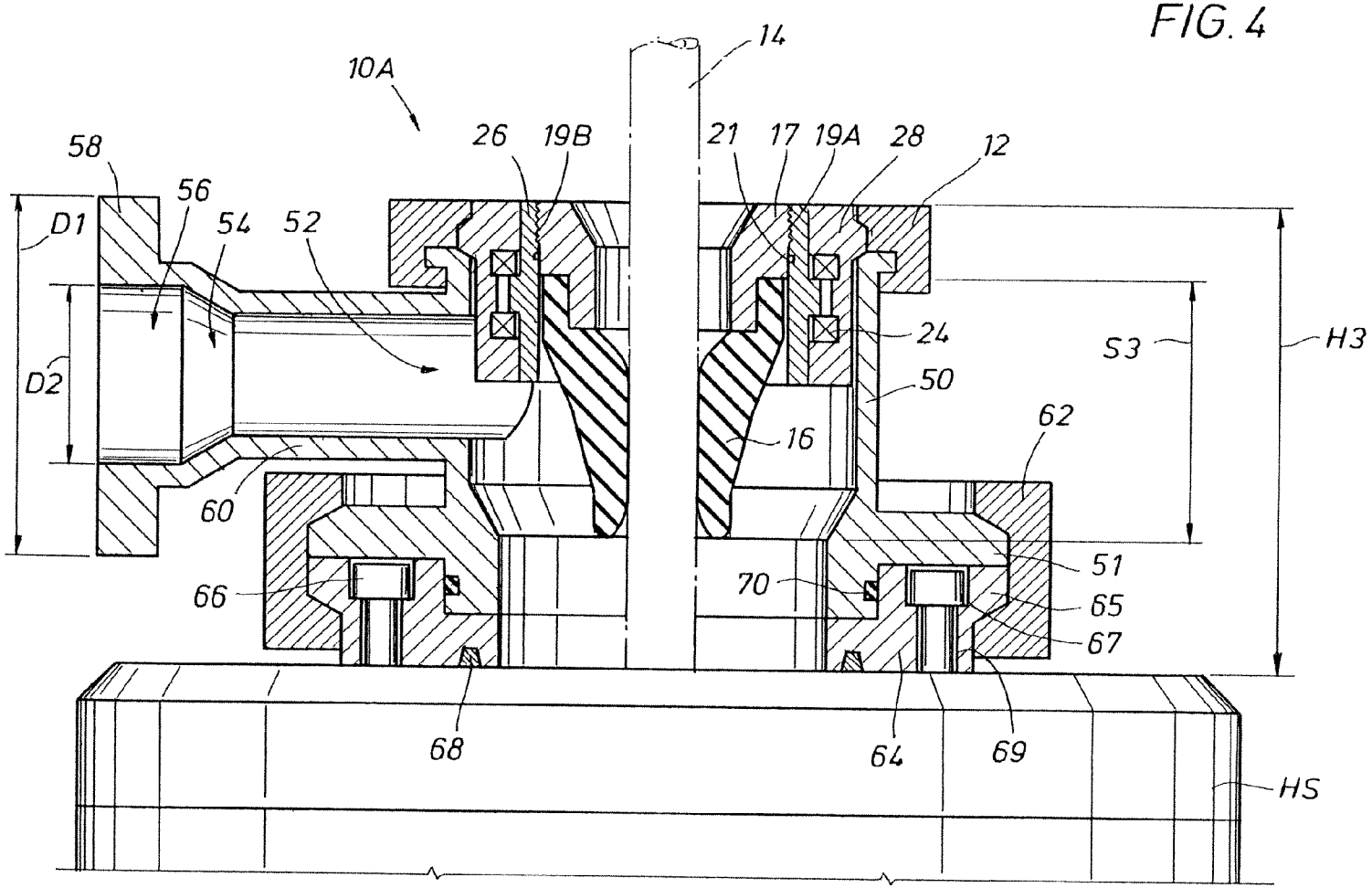
FIG. 4 is similar to FIG. 2, except that the LP-RCD housing is clamped to an attachment retainer ring that is bolted to a lower housing.

Turning next to FIG. 4, LP-RCD housing 50 is sealed with radial seal 70 and clamped with radial clamp 62 to an attachment member or retainer ring 64. Clamp 62 may be manual, mechanical, hydraulic, pneumatic, or some other form of remotely operated means. Clamp 62 is received about base shoulder 51 of LP-RCD housing 50 and radial shoulder 65 of retainer ring 64. Before clamp 62 is secured, LP-RCD housing 50 may be rotated so that conduit 60, described below, is aligned with the drilling rig's existing line or conduit to, for example, its mud pits, shale shakers or choke manifold as discussed herein. Retainer ring 64 is sealed with radial seal 68 and bolted with bolts 66 to lower housing HS. The retainer ring has a plurality of equally spaced openings 69 with recesses 67 for receiving bolts 66.

LP-RCD housing conduit 60 extends from the housing port, shown generally as 52. Conduit 60 has a width greater than its height, and then transitions, generally shown as 54, to a flange port, shown generally as 56, that is substantially circular. The cross sectional or flow areas of the two ports (52, 56), which are in communication, as well as the cross sectional or flow areas of the transition 54 therebetween, are substantially identical. However, different cross sectional areas and shapes are contemplated as well. It is contemplated that conduit 60 and port 52 may be in alignment with a portion of seal 16. A line or conduit (not shown), including a flexible conduit, may be connected to the flange 58. It is also contemplated that a flexible conduit may be attached directly to port 52 as compared to rigid conduit 60. It is contemplated that height H3 of the combined LP-RCD 10A and LP-RCD housing 50 in FIG. 4 would be 19.27 inches (49 cm), although other heights are contemplated. It is further contemplated that outer diameter D1 of flange 58 may be 15.0 inches (38.1 cm), although other diameters and sizes are contemplated as well. For the embodiment shown in FIG. 4, it is contemplated that the ratio of diameter D1 to height H3 may be 0.78, although other ratios are contemplated as well. It is also contemplated that the seal height S3 may be greater than fifty percent of height H3.

FIG. 5 shows a tubular 110, in phantom view, inserted through LP-RCD 10B to lower member or housing HS. Tubular 110 is rotatable in its inserted position about its longitudinal axis CL in multiple planes. This is desirable when the longitudinal axis CL of tubular 110 is not completely vertical, which can occur, for example, if there is misalignment with the wellbore or if there are bent pipe sections in the drill string. The longitudinal axis CL of the tubular 110 is shown in FIG. 5 deviated from the vertical axis V of the wellbore, resulting in the tubular 110 rotating about its longitudinal axis CL in a plane that is not horizontal. While it is contemplated that longitudinal axis CL would be able to deviate from vertical axis V, it is also contemplated that longitudinal axis CL of tubular 110 may be coaxial with vertical axis V, and tubular 110 may rotate about its longitudinal axis CL in a horizontal plane.

LP-RCD 10B includes a bearing assembly and a sealing element, which includes a stripper rubber seal 83 supported by a metal seal support member or ring 85 having a thread 87A on ring 85 radially exterior surface. The bearing assembly includes an inner member 82, an outer ball member 84, and a plurality of bearings 90 therebetween. The inner member 82 has thread 87B on the top of its interior surface for a threaded connection with metal seal support ring 85. Exterior surface 84A of outer ball member 84 is preferably convex. Outer member 84 is sealed with seals 86 to socket member 88 that is concave on its interior surface 88A corresponding with the convex surface 84A of the outer member 84. LP-RCD 10B and socket member 88 thereby form a ball and socket type joint or connection. LP-RCD 10B is held by socket member 88, which is in turn attached to LP-RCD housing 80 with a radial clamp 12. As previously discussed, clamp 12 may be manual, mechanical, hydraulic, pneumatic, or some other form of remotely operated means. It is also contemplated that socket member 88 may be manufactured as a part of LP-RCD housing 80, and not clamped thereto.

LP-RCD housing 80 is sealed with radial seal 94 and threadably connected with radial thread 92A to attachment member or retainer ring 96. Although radial thread 92A is shown on the inside of the LP-RCD housing 80 and thread 92B on the radially outwardly facing surface of retainer ring 96, it is also contemplated that a radial thread could alternatively be located on the radially outwardly facing surface of a LP-RCD housing 80, and a corresponding thread on the inside of a retainer ring. In such an alternative embodiment, the retainer ring would be located outside of the LP-RCD housing. As best shown in FIG. 5, the threaded connection allows for some rotation of LP-RCD housing 80 so that the conduit 100, described below, can be aligned with the drilling rig's existing line or conduit, for example, to its mud pits, shale shakers or choke manifold as discussed herein. Retainer ring 96 is sealed with radial seal 98 and bolted with bolts 114 to the lower member or housing HS. Retainer ring 96 has a plurality of equally spaced openings 117 spaced radially inward of thread 92B with recesses 116 sized for the head of bolts 114.

Stripper rubber seal 83 seals radially around tubular 110, which extends through passage 7. Metal seal support member or ring 85 is sealed by radial seal 89 with inner member 82 of LP-RCD 10B. Inner member 82 and seal 83 are rotatable with tubular 110 in a plane that is 90° from the longitudinal axis or center line CL of tubular 110. A plurality of bearings 90 positioned between inner member 82 and outer member 84 allow inner member 82 to rotate relative to outer member 84. As best shown in FIG. 5, the ball and socket type joint additionally allows outer member 84, bearings 90, and inner member 82 to rotate together relative to socket member 88. As can now be understood, LP-RCD 10B allows the inserted tubular 110 to rotate about its longitudinal axis in multiple planes, including the horizontal plane. Also, as can now be understood, LP-RCD 10B accommodates misaligned and/or bent tubulars 110, and reduces side loading. It is contemplated that stripper rubber seal 83 may be inspected and, if needed, replaced through the rotary table of the drilling rig in all embodiments of the disclosed LP-RCDs, eliminating the need for physically dangerous and time consuming work under the drill rig floor.

LP-RCD housing 80 includes conduit 100 that initially extends from the housing port, generally shown as 102, with conduit 100 having a width greater than its height, and transitions, generally shown as 118, to a flange port, generally shown as 106, that is substantially circular. The cross sectional or flow areas of the two ports (102, 106), which are in communication, as well as the different cross sectional areas of the transition 118 therebetween, are substantially identical, similar to that shown in FIG. 3A. However, different cross sectional areas and shapes are contemplated as well. It is contemplated that conduit 100 and port 102 may be in alignment with a portion of seal 83. A line or conduit (not shown), including a flexible conduit, may be connected to the flange 108. It is also contemplated that outlet conduit 100 may be manufactured as a separate part from LP-RCD housing 80, and may be welded to LP-RCD housing 80. It is also contemplated that a flexible conduit may be attached directly to port 102 as compared to a rigid conduit 100.

It is contemplated that height H4 of the combined LP-RCD 108 and the LP-RCD housing 80 in FIG. 5 may be 14.50 inches (38.1 cm), although other heights are contemplated. It is further contemplated that the outer diameter D1 of flange 108 may be approximately 15.0 inches (38.1 cm), although other diameters and sizes are contemplated as well. For the embodiment shown in FIG. 5, it is contemplated that the ratio of diameter D1 to height H4 may be 1.03, although other ratios are contemplated as well. It is also contemplated that seal height S4 may be greater than fifty percent of height H4.

Turning to FIG. 6, a tubular 14, in phantom view, is shown inserted through LP-RCD 10C to the lower housing HS. Tubular 14 can move slidingly through LP-RCD 10C, and is rotatable about its longitudinal axis in a horizontal plane. LP-RCD 10C includes a bearing assembly and a sealing element, which includes a radial stripper rubber seal 138 supported by metal seal support member or ring 134 attached thereto. The bearing assembly includes top ring 120, side ring 122, eccentric bolts 124, a plurality of radial bearings 128, and a plurality of thrust bearings 126. Metal seal support ring 134 has a plurality of openings, and top ring 120 has a plurality of equally spaced threaded bores 137, that may be aligned for connection using bolts 136. Bolts 136 enable inspection and replacement of stripper rubber seal 138 from above. Other connection means, as are known in the art, are contemplated as well.

LP-RCD 10C is positioned with an LP-RCD housing 132 with the bearing assembly. As best shown in FIG. 6A, eccentric bolts 124 may be positioned through oval shaped bolt channels 130 through side ring 122. Bolts 124 are threadably connected into threaded bores 131 in top ring 120. When bolts 124 are tightened, side ring 122 moves upward and inward, creating pressure on thrust bearings 126, which creates pressure against radial flange 125 of LP-RCD housing 132, positioning LP-RCD 10C with LP-RCD housing 132. The variable pressure on thrust bearings 126, which may be induced before a tubular 14 is inserted into or rotating about its longitudinal axis in the LP-RCD 10C, allows improved thrust bearing 126 performance. Bolts 124 may be tightened manually, mechanically, hydraulically, pneumatically, or some other form of remotely operated means. As an alternative embodiment, it is contemplated that washers, shims, or spacers, as are known in the art, may be positioned on non-eccentric bolts inserted into top ring 120 and side ring 122. It is also contemplated that spacers may be positioned above thrust bearings 126. Other connection means as are known in the art are contemplated as well.

The bottom or lower flange 163 of LP-RCD housing 132 is positioned on top of lower member or housing HS with a plurality of attachment members or swivel hinges 140 that may be bolted to lower housing HS with bolts 142. Swivel hinges 140, similar to swivel hinges 20 shown in FIG. 2, may be rotated about a vertical axis prior to tightening of the bolts 142. Other types of connections as are known in the art are contemplated as well, some of which are shown in FIGS. 2-5 and/or described above. The stripper rubber seal 138 seals radially around the tubular 14, which extends through passage 6. As discussed above, seal 138 may be attached to the metal seal support member or ring 134, which support ring 134 may be, in turn, bolted to top ring 120 with bolts 136. As can now be understood, it is contemplated that stripper rubber seal 138 may be inspected and, if needed, replaced through the rotary table of the drilling rig in all embodiments of the LP-RCD 10, eliminating the need for physically dangerous and time consuming work under the drill rig floor.

Top ring 120, side ring 122, and stripper rubber seal 138 are rotatable in a horizontal plane with the tubular 14. A plurality of radial 128 and thrust 126 bearings positioned between the LP-RCD housing 132 on the one hand, and the top ring 120 and side ring 122 on the other hand, allow seal 138, top ring 120, and side ring 122 to rotate relative to the LP-RCD stationary housing 132. The inner race for the radial bearings, shown generally as 128, may be machined in the outside surfaces of the LP-RCD housing 132. As can now be understood, the bearings (126, 128) of LP-RCD 10C are positioned outside of LP-RCD housing 132.

LP-RCD housing 132 includes dual and opposed conduits (144, 162) that initially extend from dual and opposed housing ports, generally shown as (146, 160), with a width (preferably 14 inches or 35.6 cm) greater than their height (preferably 2 inches or 5.1 cm), and transition, generally shown as (150, 158), to flange ports, generally shown as (148, 156), that are substantially circular. The shape of conduits (144, 162) allow access to bolts 142. Housing ports (146, 160) are in communication with their respective flange ports (148, 156). The two ports, each of equal area, provide twice as much flow area than a single port. Other dimensions are also contemplated. It is also contemplated that conduits (144, 162) may be manufactured as a separate part from the LP-RCD housing 132, and be welded to the LP-RCD housing 132. The cross sectional or flow areas of the ports (146, 148, 156, 160), as well as the cross sectional or flow areas of the transition between them (150, 158) are preferably substantially identical. However, different cross sectional areas and shapes are contemplated as well. Lines or conduits (not shown), including flexible conduits, may be connected to flanges (152, 154).

It is contemplated that height H5 of the combined LP-RCD 10C positioned with LP-RCD housing 132 in FIG. 6 may be 15.0 inches (38.1 cm), although other heights are contemplated. It is further contemplated that the outer diameter D3 of flanges (152, 154) may be 6.0 inches (15.2 cm), although other diameters and sizes are contemplated as well. For the embodiment shown in FIG. 6, it is contemplated that the ratio of diameter D3 to height H5 may be 0.4, although other ratios are contemplated as well. In the preferred embodiment, it is contemplated that diameter D3 of flanges (152, 154) may be substantially parallel with height H5.

Although two conduits (144, 162) are shown in FIG. 6, it is also contemplated that only one larger area conduit may be used instead, such as shown in FIGS. 1A, 1C, 2-5 and 7. Also, although two conduits (144, 162) are shown only in FIG. 6, it is also contemplated that two conduits could be used with any LP-RCD and LP-RCD housing (18, 40, 50, 80, 132, 172) of the present invention shown in FIGS. 1A, 1C, 2-7 to provide more flow area or less flow area per conduit. It is contemplated that two conduits may be useful to reduce a restriction of the flow of mud returns if the stripper rubber seal (16, 83, 138) is stretched over the outside diameter of an oversized tool joint or if a foreign obstruction, partly restricts the returns into the conduits. The two conduits would also reduce pressure spikes within the wellbore whenever a tool joint is tripped into or out of the LP-RCD with the rig pumps operating. Alternatively, when tripping a tool joint out through the LP-RCD, one of the two conduits may be used as an inlet channel for the pumping of mud from the surface to replace the volume of drill string and bottom hole assembly that is being removed from the wellbore. Otherwise, a vacuum may be created on the wellbore when tripping out, in a piston effect known as swabbing, thereby inviting kicks. It is also contemplated that two conduits may facilitate using lifting slings or fork trucks to more easily maneuver the LP-RCD on location. It is further contemplated, though not shown, that seal 138 may have a height greater than fifty percent of height H5.

Figure 7:
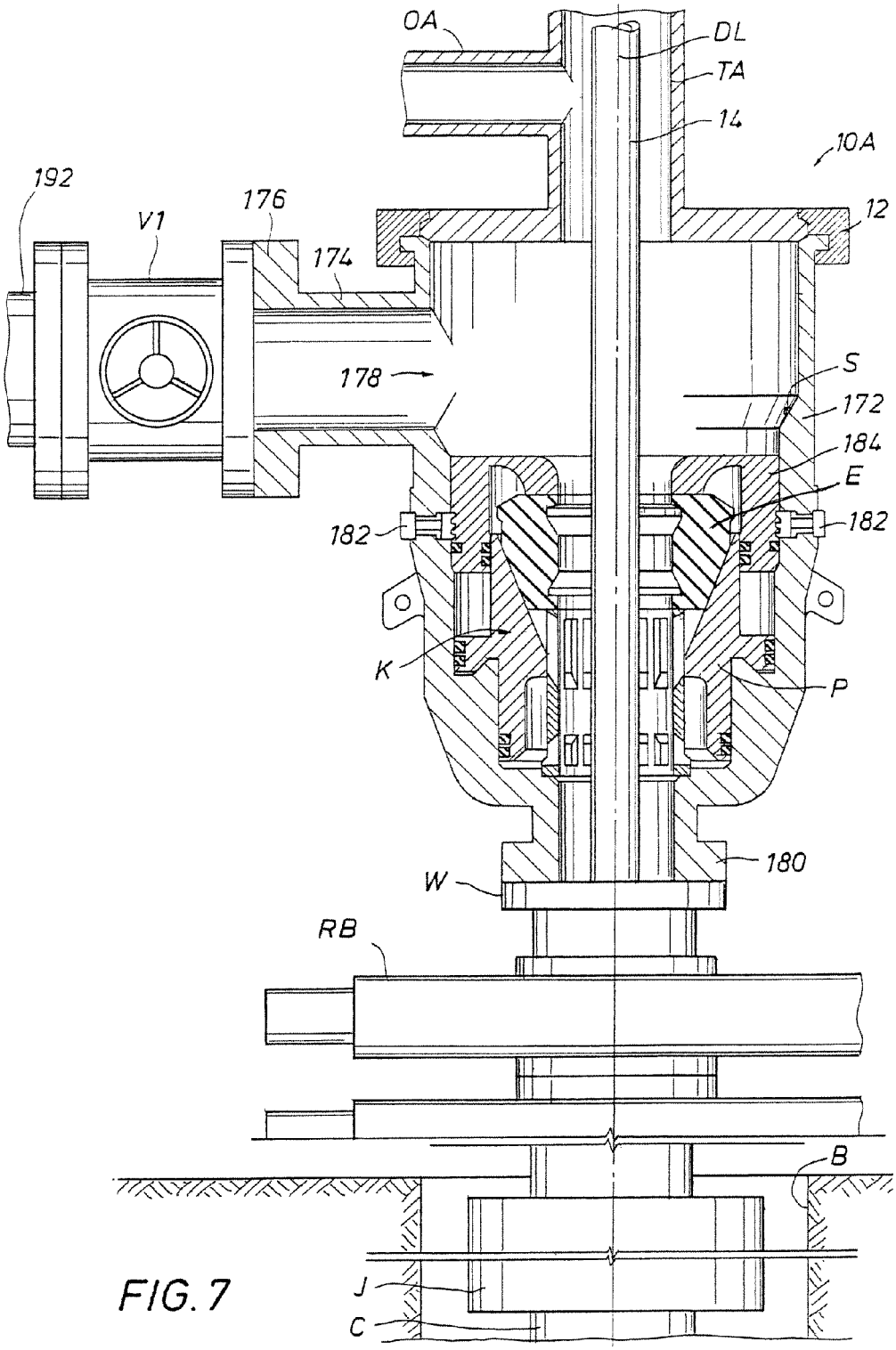
FIG. 7 is an elevational section view of a nipple with a lateral conduit positioned on an integral combination housing for use with an annular BOP seal and a RCD, and a valve attached with the housing, which housing is mounted on a ram-type BOP stack.

Turning to FIG. 7, a nipple or tubular TA with lateral conduit OA is attached with integral housing 172 using radial clamp 12. Integral housing 172 is mounted above a ram-type BOP stack RB shown below the well head W, and, if desired, over another annular BOP J positioned with casing C in a borehole B. Integral housing 172 contains known components K, such as piston P, containment member 184, and a plurality of connectors 182, for an annular BOP, such as proposed in U.S. Pat. No. 4,626,135. Annular seal E along axis DL may be closed upon the inserted tubular 14 with components K, such as proposed in the '135 patent. It is contemplated that components K may preferably be compact, such as those in the Compact GK® annular BOP offered by the Hydril Company of Houston, Tex.

Housing 172 has a lateral conduit 174 with housing port 178 that is substantially circular, and perpendicular to axis DL. Port 178 is above seal E while being in communication with seal E. It is also contemplated that conduit 174 may be manufactured as a separate part from LP-RCD housing 172, and may be welded to LP-RCD housing 172. If desired, valve V1 may be attached to flange 176, and a second lateral conduit 192 may be attached with valve V1. Valve V1 may be manual, mechanical, electrical, hydraulic, pneumatic, or some other remotely operated means. Sensors S will be discussed below in detail in conjunction with FIG. 8.

FIG. 7 shows how integral housing 172 may be configured for conventional drilling. It is contemplated that when valve V1 is closed, drilling returns may flow through open conduit OA to mud pits, shale shakers and/or other non-pressurized mud treatment equipment. It should be noted that the presence of nipple or tubular TA with lateral conduit OA is optional, depending upon the desired configuration. Should nipple or tubular TA with lateral conduit OA not be present, returns during conventional drilling may be taken through port 178 (optional), valve V1 and conduit 192. As will be discussed below in conjunction with FIG. 9, other valves (V2, V3) and conduits (194, 196) are also contemplated, in both configurations valve V1 is opened.

Figure 8:
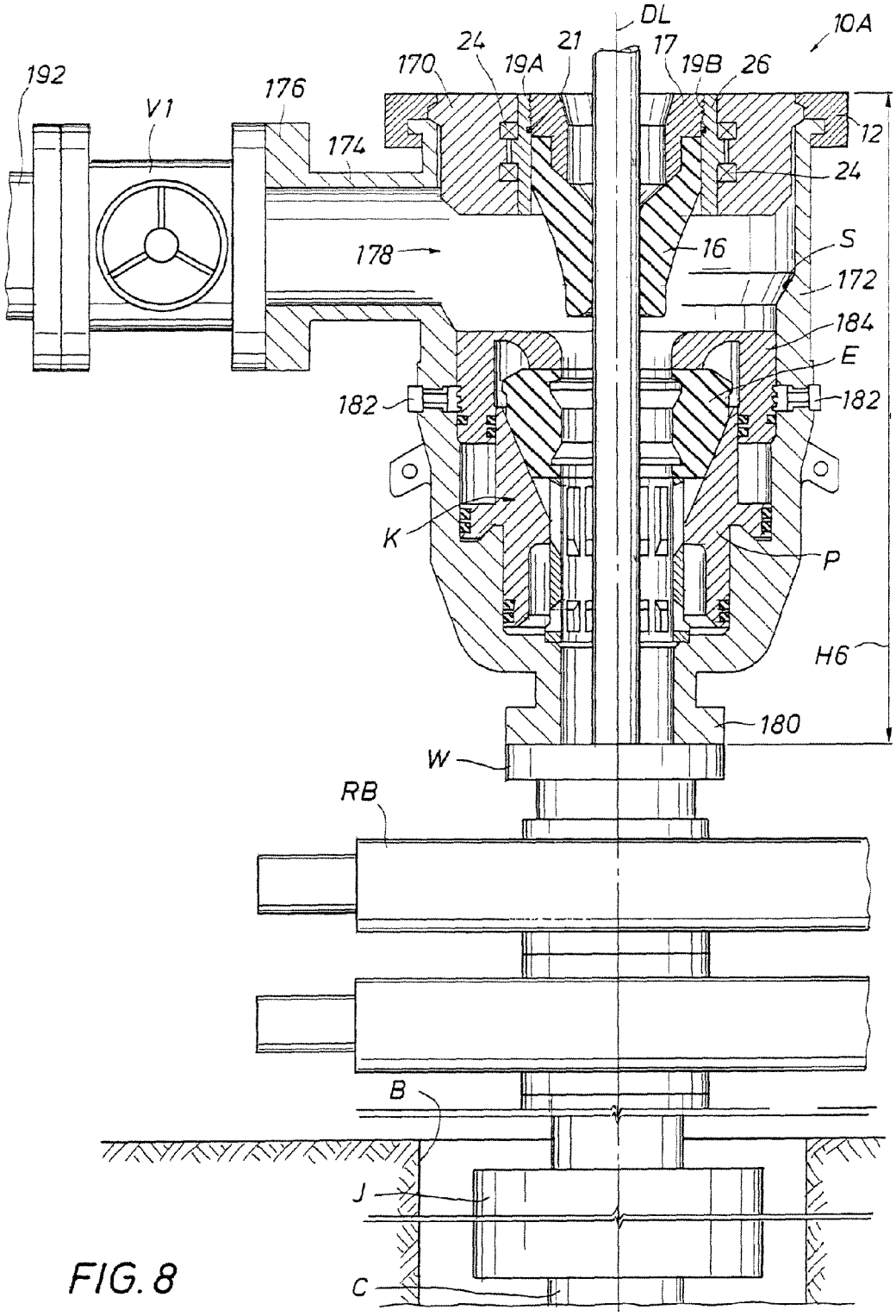
FIG. 8 is an elevational section view of the integral housing as shown in FIG. 7 but with the nipple removed and a LP-RCD installed.

Turning to FIG. 8, LP-RCD 10A is now attached with integral housing 172 using radial clamp 12. LP-RCD 10A includes a bearing assembly and a sealing element, which includes radial stripper rubber seal 16 supported with metal seal support member or ring 17 having thread 19A on ring 17 exterior radial surface. While FIG. 8 is shown with LP-RCD 10A, other LP-RCDs as disclosed herein, such as LP-RCD 10B, 10C, could be used. The bearing assembly includes inner member 26, outer member 170, and a plurality of bearings 24 therebetween, which bearings 24 enable inner member 26 to rotate relative to the stationary outer member 170. Inner member 26 and outer member 170 are coaxial with longitudinal axis DL. Inner member 26 and seal 16 are rotatable with inserted tubular 14 in a horizontal plane about axis DL. Inner member 26 has thread 19B on the top of its interior surface for a threaded connection with corresponding thread 19A of the metal seal support member or ring 17. Valve V1 is attached to flange 176, and a second lateral conduit 192 is attached with valve V1. It is contemplated that conduit 174 and port 178 may be in alignment with a portion of seal 16. Annular seal E is coaxial with and below seal 16 along axis DL.

FIG. 8 shows how integral housing 172 and LP-RCD 10A may be configured for managed pressure drilling. It is contemplated that valve V1 is open, and drilling returns may flow through housing port 178 and lateral conduit 192 to a pressure control device, such as a choke manifold (not shown). As will be discussed below in conjunction with FIG. 10, other valves (V2, V3) and conduits (194, 196) are also contemplated.

As can now be understood, an annular BOP seal E and its operating components K are integral with housing 172 and the LP-RCD 10A to provide an overall reduction in height H6 while providing functions of both an RCD and an annular BOP. Moreover, the need for an attachment member between a LP-RCD 10 and the BOP seal E, such as attachment members (20, 43, 64, 96, 140) along with a bottom or lower flange (23, 163) in FIGS. 2-6, have been eliminated. Therefore, both the time needed and the complexity required for rigging up and rigging down may be reduced, as there is no need to align and attach (or detach) a LP-RCD housing (18, 40, 50, 80, 132), such as shown in FIGS. 2-6, with a lower housing HS using one of the methods previously described in conjunction with FIGS. 2-6. Furthermore, height H6 in FIG. 8 of the integral RCD and annular BOP may be less than a combination of any one of the heights (H1, H2, H3, H4, H5) shown in FIGS. 2-6 and the height of lower housing HS (which preferably is an annular BOP). This is made possible in part due to the elimination of the thicknesses of the attachment member (20, 43, 64, 96, 140), a bottom or lower flange (23, 163) and the top of lower housing HS.

It is contemplated that the operation of the integral housing 172 with annular BOP and LP-RCD 10A, as shown in FIG. 8, may be controlled remotely from a single integrated panel or console. Sensors S in housing 172 may detect pressure, temperature, flow, and/or other information as is known in the art, and relay such information to the panel or console. Such sensors S may be mechanical, electrical, hydraulic, pneumatic, or some other means as is known in the art. Control of LP-RCD 10A from such remote means includes bearing lubrication flow and cooling.

Threaded connection (19A, 19B) between ring 17 and inner member 26 allows seal 16 to be inspected or replaced from above when the seal 16 is worn. Full bore access may be obtained by removing clamp 12 and LP-RCD 10A including bearing assembly (24, 26, 170). Seal E may then be inspected or replaced from above by disconnecting connectors 182 from containment member 184, removing containment member 184 from housing 172 via the full bore access, thereby exposing seal E from above. It is also contemplated that removal of ring 17 while leaving the bearing assembly (24, 26, 170) in place may allow limited access to seal E for inspection from above.

It should be understood that although housing lower flange 180 is shown over ram-type BOP stack RB in FIGS. 7-8, it may be positioned upon a lower housing, tubular, casing, riser, or other member using any connection means either described above or otherwise known in the art. It should also be understood that although LP-RCD 10A is shown in FIG. 8, it is contemplated that LP-RCD (10B, 10C) may be used as desired with housing 172.

Figure 9:
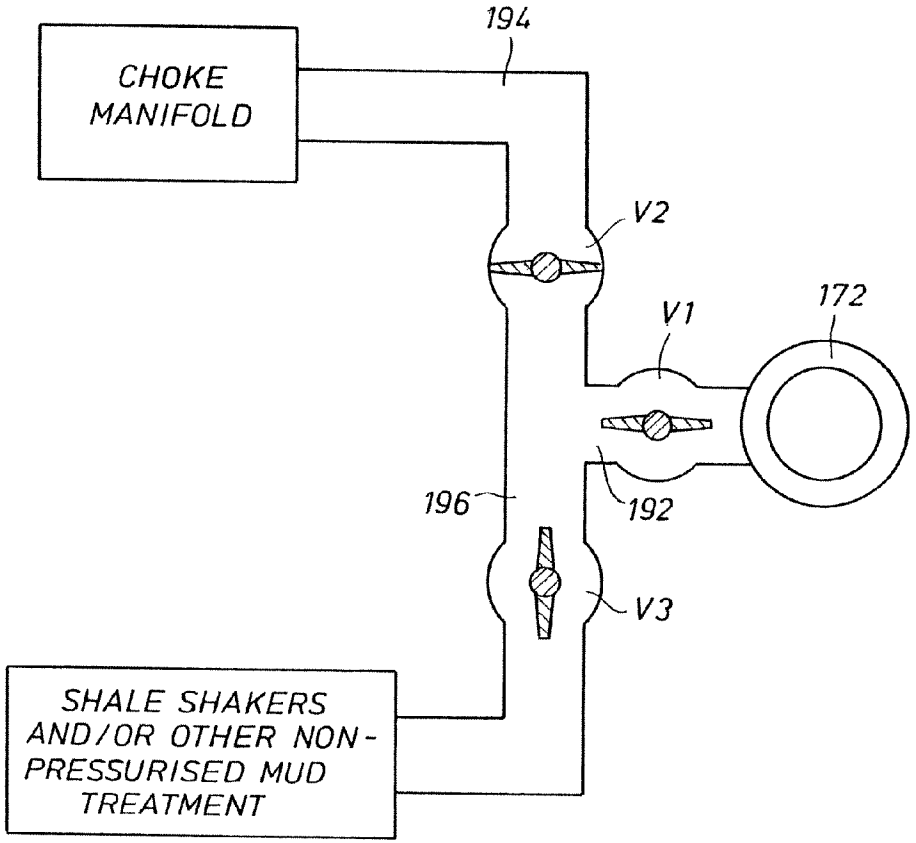
FIG. 9 is a schematic plan view of an integral housing with LP-RCD removed as shown in FIG. 7 with the valves positioned for communication between the housing and a shale shakers and/or other non-pressurized mud treatment.

Turning to FIG. 9, integral housing 172 is shown, as in FIG. 7, with no LP-RCD 10A installed. This reflects a configuration in which nipple or tubular TA with lateral conduit OA is not present during conventional drilling. Valve V1 is attached to housing 172 (e.g. such as shown in FIG. 7), and lateral conduit 192 is attached to valve V1. Other conduits (194, 196) and valves (V2, V3) are shown in communication with conduit 192, for example by a T-connection. Valves (V2, V3) may be manual, mechanical, electrical, hydraulic, pneumatic, or some other form of remotely operated means. One conduit 194 leads to a pressure control device, such as a choke manifold, and the other conduit 196 leads to the shale shakers and/or other non-pressurized mud treatment equipment. FIG. 9 shows a configuration for conventional drilling, as it is contemplated that valves (V1, V3) may be open, valve V2 may be closed, and drilling returns may flow through housing port 178 (shown in FIG. 7) and conduits (192, 196) to mud pits, shale shakers and/or other non-pressurized mud treatment equipment.

Figure 10:
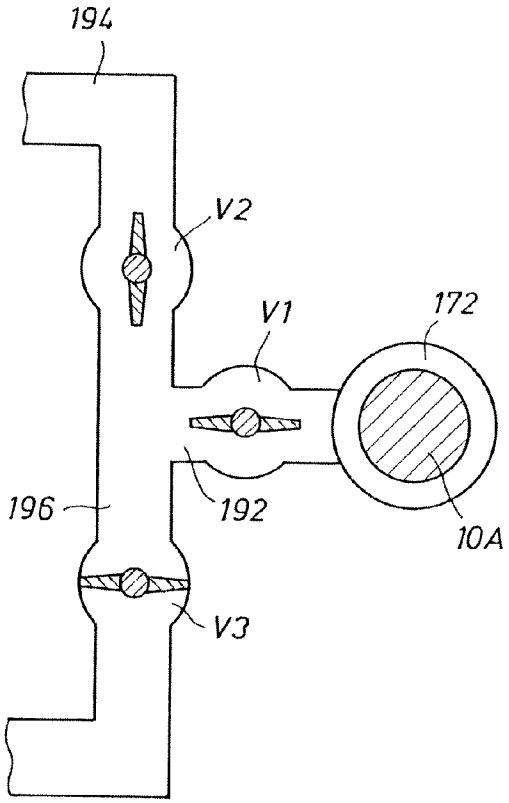
FIG. 10 is a schematic plan view of an integral housing with LP-RCD installed as shown in FIG. 8 with the valves positioned for communication between the housing and a choke manifold.

Turning to FIG. 10, integral housing 172 is shown, as in FIG. 8, with LP-RCD 10A installed and attached. FIG. 10 shows a configuration for managed pressure drilling, as it is contemplated that valves (V1, V2) are open, valve V3 is closed, and drilling returns may flow through housing port 178 and conduits (192, 194) to a pressure control device, such as a choke manifold.

It is contemplated that the desired LP-RCD 10 may have any type or combination of seals to seal with inserted tubulars (14, 110), including active and/or passive stripper rubber seals. It is contemplated that the connection means between the different LP-RCD housings (18, 40, 50, 80, 132, 172) and the lower member or housing HS shown in FIGS. 2-6 and/or described above, such as with threaded rod/nut assemblies 22, bolts (22, 66, 114, 142), swivel hinges (20, 140), retainer rings (64, 96), clamps 62, threads 92, and seals (42, 68, 94, 98), may be used interchangeably. Other attachment methods as are known in the art are contemplated as well.

Method of Use

LP-RCD 10 may be used for converting a smaller drilling rig or structure between conventional hydrostatic pressure drilling and managed pressure drilling or underbalanced drilling. A LP-RCD (10A, 10B, 10C) and corresponding LP-RCD housing (18, 40, 50, 80, 132, 172) may be mounted on top of a lower member or housing HS (which may be a BOP) using one of the attachment members and connection means shown in FIGS. 2-6 and/or described above, such as for example swivel hinges 140 and bolts 142 with LP-RCD 10C. Integral housing 172 may be used to house an annular BOP seal E, and a desired LP-RCD (10A, 10B, 10C) may then be positioned with housing 172 using one of the means shown in FIGS. 2-8 and/or described above, such as for example using radial clamp 12 with LP-RCD 10A.

Conduit(s) may be attached to the flange(s) (34, 58, 108, 152, 154, 176), including the conduit configurations and valves shown in FIGS. 9 and 10. The thrust bearings 126 for LP-RCD 10C, if used, may be preloaded with eccentric bolts 124 as described above. Drill string tubulars (14, 110), as shown in FIGS. 2-8, may then be inserted through a desired LP-RCD 10 for drilling or other operations. LP-RCD stripper rubber seal (16, 83, 138) rotates with tubulars (14, 110), allows them to slide through, and seals the annular space A so that drilling fluid returns (shown with arrows in FIG. 2) will be directed through the conduit(s) (29, 60, 100, 144, 162, 174). When desired the stripper rubber seal (16, 83, 138) may be inspected and, if needed, replaced from above, by removing ring (17, 85, 134). Moreover, for housing 172, shown in FIGS. 7-10, annular BOP seal E may be inspected and/or removed as described above.

For conventional drilling using housing 172 in the configuration shown in FIG. 7 with no LP-RCD 10 installed, valve V1 may be closed, so that drilling returns flow through lateral conduit OA to the mud pits, shale shakers or other non-pressurized mud treatment equipment. For conventional drilling with the conduit/valve configuration in FIG. 9 (and when nipple or tubular TA with lateral conduit OA is not present), valves (V1, V3) are open, valve V2 is closed so that drilling returns may flow through housing port 178 and conduits (192, 196) to mud pits, shale shakers and/or other non-pressurized mud treatment equipment. For managed pressure drilling using housing 172 in the configuration shown in FIG. 8 with LP-RCD 10A installed and attached, valve V1 is opened, so that drilling returns flow through housing port 178 and conduit 192 to a pressure control device, such as a choke manifold. For managed pressure drilling with the configuration in FIG. 10, valves (V1, V2) are open, valve V3 is closed so that drilling returns may flow through housing port 178 and conduits (192, 194) to a pressure control device, such as a choke manifold.

As is known by those knowledgeable in the art, during conventional drilling a well may receive an entry of water, gas, oil, or other formation fluid into the wellbore. This entry occurs because the pressure exerted by the column of drilling fluid or mud is not great enough to overcome the pressure exerted by the fluids in the formation being drilled. Rather than using the conventional practice of increasing the drilling fluid density to contain the entry, integral housing 172 allows for conversion in such circumstances, as well as others, to managed pressure drilling.

To convert from the configurations shown in FIGS. 7 and 9 for conventional drilling to the configurations shown in FIGS. 8 and 10 for managed pressure drilling, conventional drilling operations may be temporarily suspended, and seal E may be closed upon the static inserted tubular 14. It is contemplated that, if desired, the operator may kill the well temporarily by circulating a weighted fluid prior to effecting the conversion from conventional to managed pressure drilling. The operator may then insure that no pressure exists above seal E by checking the information received from sensor S. If required, any pressure above seal E may be bled via a suitable bleed port (not shown). Valve V1 may then be closed. If present, the nipple or tubular TA may then be removed, and the LP-RCD 10 positioned with housing 172 as shown in FIG. 8 using, for example, clamp 12. Valves (V1, V2) are then opened for the configuration shown in FIG. 10, and valve V3 is closed to insure that drilling returns flowing through housing port 178 are directed or diverted to the choke manifold. Seal E may then be opened, drilling operations resumed, and the well controlled using a choke and/or pumping rate for managed pressure drilling. If the operator had previously killed the well by circulating a weighted fluid, this fluid may then be replaced during managed pressure drilling by circulating a lighter weight drilling fluid, such as that in use prior to the kick. The operation of the integral annular BOP and LP-RCD 10A may be controlled remotely from a single integrated panel or console in communication with sensor S. Should it be desired to convert back from a managed pressure drilling mode to a conventional drilling mode, the above conversion operations may be reversed. It should be noted, however, that removal of LP-RCD 10A may not be necessary (but can be performed if desired). For example, conversion back to conventional drilling may be simply achieved by first ensuring that no pressure exists at surface under static conditions, then configuring valves V1, V2 and V3 to divert returns directly to the shale shakers and/or other non-pressurized mud treatment system, as shown in FIG. 9.

Interlocking LP-RCD System

Figure 11:
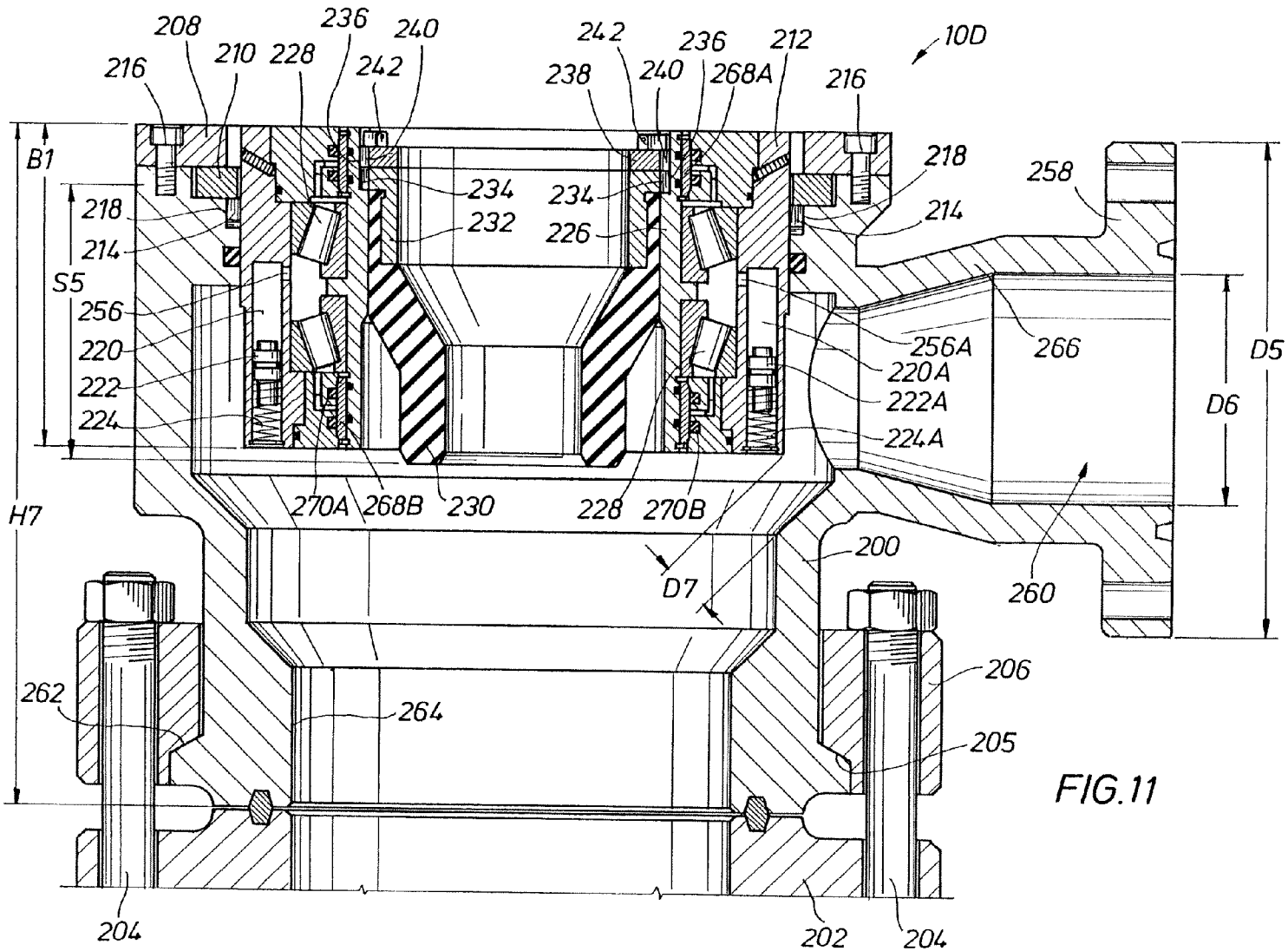
FIG. 11 is an elevational section view of a LP-RCD bearing assembly inner member and outer member disposed with a LP-RCD housing, with a bearing assembly retainer plate secured over a bearing assembly rotating plate, and bearing assembly outer member tabs in corresponding LP-RCD housing bearing assembly receiving slots, and a seal retainer ring with seal retainer ring tabs and spring loaded flipper dogs secured in bearing assembly inner member receiving slots over a seal support ring with seal support ring tabs positioned in the corresponding bearing assembly inner member receiving slots, and accumulators with accumulator pistons and springs disposed in the outer member.

Turning to FIG. 11, LP-RCD housing 200 is disposed over lower member or housing 202 with LP-RCD housing retainer ring or attachment member 206. Lower housing 202 may be a compact BOP, although other lower housings are contemplated. LP-RCD housing attachment member 206 has a plurality of openings for receiving bolts 204. Attachment member blocking shoulder 205 may be disposed with LP-RCD housing blocking shoulder 262. It is contemplated that LP-RCD housing attachment member 206 may be a 13⅝ inch-5000 psi flange designed as an Other End Connector (OEC) in accordance with both the American Petroleum Institute (API) Specification 6A and the American Society of Mechanical Engineers (ASME) Section VIII Division 2 Pressure Vessel Code. However, other sizes, shapes, strengths, designs, specifications and codes are contemplated. Before bolts 204 are tightened, LP-RCD housing attachment member 206 allows for the rotation of LP-RCD housing 200 about a vertical axis so that LP-RCD housing outlet conduit 266 and flange 258 may be aligned with the drilling rig's existing line or conduit to, for example, its mud pits, shale shakers or choke manifold. Other attachment means for LP-RCD housing 200 to lower member 202 are contemplated, including any means shown in any of the other Figures for any of the other embodiments, such as swivel hinges (FIGS. 2 and 6), direct attachment (FIG. 3) and clamping (FIG. 4).

Figure 12:
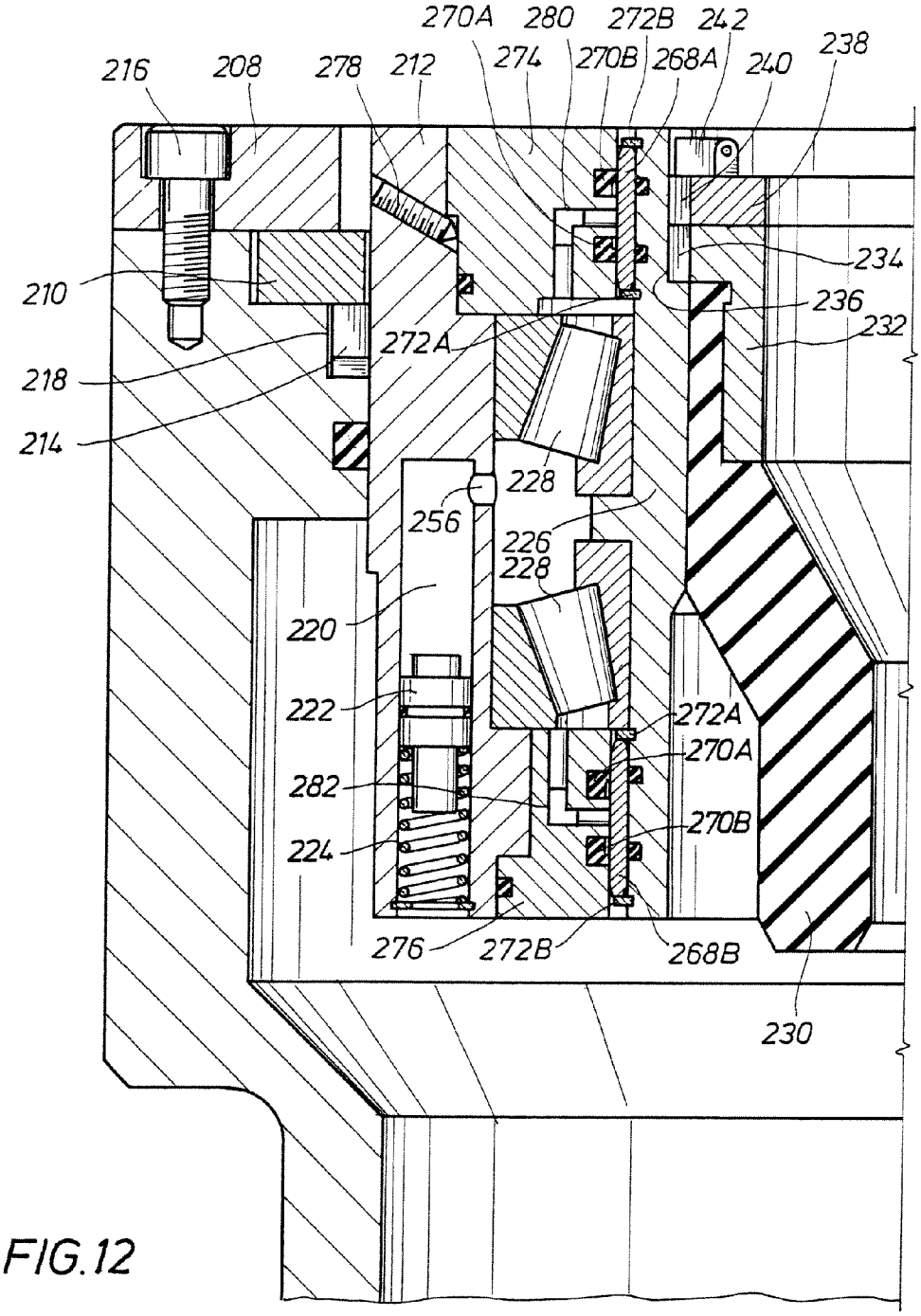
FIG. 12 is a detail view of the upper left portion of FIG. 11 to better illustrate the bearing assembly retainer plate secured over the bearing assembly rotating plate, and one bearing assembly outer member tab in a corresponding LP-RCD housing bearing assembly receiving slot, and the seal retainer ring with a seal retainer ring tab and a spring loaded flipper dog secured in a corresponding bearing assembly inner member receiving slot over a seal support ring with a seal support ring tab positioned in a corresponding bearing assembly inner member receiving slot, and an accumulator with accumulator piston and spring.

As shown in FIGS. 11 and 12, LP-RCD 10D comprises a bearing assembly and a sealing element. The bearing assembly includes an inner member 226, an outer member 212, and a plurality of bearings 228 therebetween. It is contemplated that bearings 228 may be tapered to take both thrust and radial loads. However, other bearing shapes are contemplated, including cylindrical with no taper. The sealing element includes a radial stripper rubber seal 230 supported by a seal support member or ring 232. Seal support ring 232 may be metal, although other materials are contemplated. The stripper rubber seal 230 is advantageously disposed radially inward from bearings 228 within the inside bore of the bearing assembly inner member 226.

The seal element is removably positioned with bearing assembly inner member 226 with seal support ring tabs 234 in bearing assembly inner member receiving slots 236. Seal support ring tabs 234 in bearing assembly inner member receiving slots 236 resist relative rotation between seal support ring 232 and bearing assembly inner member 226. Seal retainer ring 238 is disposed over seal support ring 232 with seal retainer ring tabs 240 also in bearing assembly inner member receiving slots 236. As can be better understood from FIG. 14, when seal retainer ring 238 is initially positioned with bearing assembly inner member 226, seal retainer ring tabs 240 may be aligned with bearing assembly inner member receiving slots 236 in the access position that allows seal support ring 232 to be positioned with or removed from bearing assembly inner member 226. Seal support ring tabs 234 are disposed in bearing assembly inner member receiving slots 236 providing support for seal support ring 232 and preventing relative rotation between seal support ring 232 and bearing assembly inner member 226.

After lowering seal retainer ring tabs 240 into bearing assembly inner member receiving slots 236 over seal support ring tabs 234, seal retainer ring 238 may then be rotated counterclockwise about a vertical axis moving seal retainer ring tabs 240 through the horizontal grooves 236A of receiving slots 236 from the access position to the blocking position. In the blocking position, at least some portion of seal retainer ring tabs 240 are in horizontal grooves 236A of receiving slots 236, thereby blocking removal of seal support ring 232 from bearing assembly inner member 226. When seal retainer ring 238 may not be rotated counterclockwise any further with seal retainer ring tabs 240 in the horizontal grooves 236A of receiving slots 236, seal retainer ring 238 is in its locked position. As can be understood, the locked position for seal retainer ring 238 is also a blocking position.

Spring loaded flipper dogs 242 are in their unlocked positions as shown in FIG. 15 when seal retainer ring 238 is not in its locked position. When seal retainer ring 238 is in its locked position after being rotated completely counterclockwise with seal retainer ring tabs 240 in the horizontal grooves 236A of receiving slots 236, flipper dogs 242 may be moved into their locked positions as shown in FIGS. 11-14 and 16. Flipper dogs 242 are disposed in bearing assembly inner member receiving slots 236 when in their locked positions. As can now be understood, the seal element 230 may be blocked and resisted from removal from the bearing assembly by moving seal retainer ring 238 counterclockwise to its blocking position. Seal retainer ring 238 may be locked with and prevented from rotating relative to the bearing assembly by moving the flipper dogs 242 to their locked positions. Other means for removably attaching the seal element with the bearing assembly are contemplated, including any means shown in any of the other Figures for any of the other embodiments, such as threads (FIGS. 2-5) and bolts (FIG. 6). To remove the seal 230 from the bearing assembly, flipper dogs 242 may be unlocked and seal retainer ring 238 may be rotated clockwise about a vertical axis moving seal retainer ring tabs 240 through the horizontal grooves 236A of receiving slots 236 from the blocking position to the access position. The access position allows for removal of seal 230 from the bearing assembly. Seal retainer ring 238 and seal support ring 232 with seal 230 may then be removed.

Returning to FIGS. 11-12, LP-RCD 10D is removably positioned with LP-RCD housing 200 with bearing assembly outer member tabs 214 in LP-RCD housing receiving slots 218. Bearing assembly rotating plate 210 is disposed with LP-RCD housing 200 over bearing assembly outer member tabs 214. Bearing assembly retainer plate 208 is positioned over bearing assembly rotating plate 210 and attached with LP-RCD housing 200 with exemplary screws 216. Other attachment means are contemplated.

Figure 17:
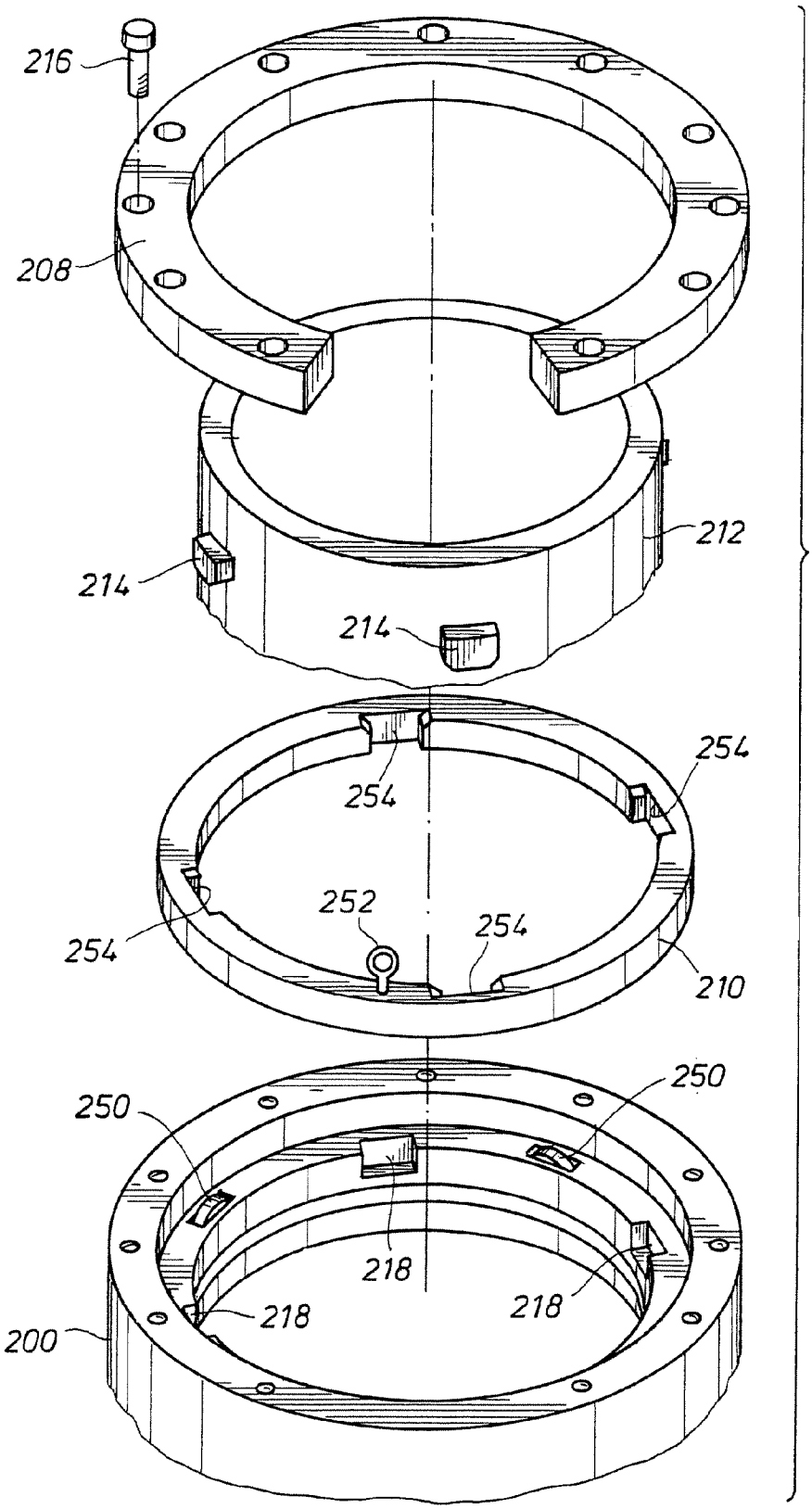
FIG. 17 is an exploded isometric view of the bearing assembly retainer plate with an exemplary socket head cap screw, a partial isometric view of the top of the bearing assembly outer member with bearing assembly outer member tabs, the bearing assembly rotating plate with rotating plate receiving slots and lock pin, and the top of the LP-RCD housing with LP-RCD housing rotating plate roller bearings and receiving slots for bearing assembly outer member tabs.

As can be better understood from FIG. 17, bearing assembly rotating plate 210 may be positioned with LP-RCD housing 200 on LP-RCD housing rotating plate roller bearings 250. Rotating plate receiving slots 254 may be aligned with LP-RCD housing receiving slots 218 when bearing assembly rotating plate 210 is first disposed or assembled with LP-RCD housing 200. When rotating plate receiving slots 254 are aligned with LP-RCD housing receiving slots 218, then bearing assembly rotating plate 210 is in the access position. To position the bearing assembly with LP-RCD housing 200, bearing assembly outer member tabs 214 may be moved through rotating plate receiving slots 254 for placement in LP-RCD housing receiving slots 218. As can now be understood, the bearing assembly rotating plate access position allows access to the bearing assembly for its placement with or removal from the LP-RCD housing 200.

With bearing assembly outer member tabs 214 supported in LP-RCD housing receiving slots 218, bearing assembly rotating plate 210 may be rotated clockwise about a vertical axis, such as with lock member or pin 252 as an attachment point or other means, which are described in detail below with FIGS. 18-23, so that rotating plate receiving slots 254 are not in alignment with LP-RCD housing receiving slots 218. When rotating plate receiving slots 254 are not aligned with LP-RCD housing receiving slots 218, then bearing assembly rotating plate 210 is in the blocking position. As can now be understood, the bearing assembly rotating plate 210 in the blocking position blocks and resists removal of the LP-RCD 10D from the LP-RCD housing 200. Bearing assembly rotating plate 210 in the access position allows and does not resist removal of the LP-RCD 10D from the LP-RCD housing 200.

As will be discussed in detail below with FIGS. 18-23, when bearing assembly rotating plate 210 is rotated fully clockwise about a vertical axis, it may be locked in the blocking position. In the locked position, bearing assembly outer member tabs 214 are covered by bearing assembly rotating plate 210, and the bearing assembly is blocked from being removed from LP-RCD housing 200. When bearing assembly rotating plate 210 is fully rotated counterclockwise about a vertical axis, it may also be locked in the access position with lock pin 252. When lock pin 252 is in its locked position, it resists relative rotation between bearing assembly rotating plate 210 and LP-RCD housing 200. Other means for removably attaching the bearing assembly with the LP-RCD housing 200 are contemplated, including any means shown in any of the other Figures for any of the other embodiments, such as a clamping (FIGS. 2-5).

Returning to FIGS. 11 and 12, upper 268A and lower 268B radial seal sleeves are disposed between bearing assembly inner member 226 and outer member 212. As best shown in FIG. 12, each seal sleeve (268A, 268B) may be held between an inner seal sleeve retaining ring 272A and an outer seal sleeve retainer ring 272B. Seal sleeve retaining rings (272A, 272B) may be Spirolox retaining rings available from Smalley® Steel Ring Company of Lake Zurich, Ill., although other types of retaining rings are contemplated. To remove lower seal sleeve 268B from the bearing assembly inner member 226, its inner seal sleeve retaining ring 272A may be removed to allow access for a pulling tool to grab the back side of the lower seal sleeve 268B.

An inner radial seal 270A and an outer radial seal 270B may be disposed with each seal sleeve (268A, 268B). Inner seals 270A and outer seals 270B may be hydrodynamic rotary Kalsi Seals® available from Kalsi Engineering, Inc. of Sugar Land, Tex., although other types of seals are contemplated. Bearing assembly outer member 212 may have a top packing box 274 and a bottom packing box 276. The bearings 228 may be preloaded with top packing box 274, and the top packing box 274 and the preload held in place with angled bearing assembly set screws 278. There may be a top packing box port 280 and a bottom packing box port 282 for filling with lubricant. It is contemplated that if an outer seal 270B fails, the leak rate of the lubricant may be lowered or slowed with the use of the adjacent port (280, 282).

Cylindrical shaped accumulators (220, 220A) may be disposed in bearing assembly outer member 212. An accumulator piston (222, 222A) and spring (224, 224A) are disposed in each accumulator (220, 220A). Although two accumulators (220, 220A) are shown, it is also contemplated that there may be only one accumulator, or preferably a plurality of spaced apart accumulators that are disposed radially outward from the bearings 228 in bearing assembly outer member 212. The plurality of accumulators may be spaced a substantially equal distance apart from each other. It is contemplated that there may be thirty (30) spaced apart accumulators (220, 220A) of 1 inch (2.54 cm) diameter, although other amounts and sizes are contemplated. It is also contemplated that there may be only one accumulator extending continuously radially around the entire circumference of bearing assembly outer member 212. Such an accumulator may have a single ring shaped piston and a spring.

As best shown in FIG. 12, each accumulator (220, 220A) may contain a lubricant that may be supplied through its accumulator lubricant port (256, 256A) to bearings 228. Springs (224, 224A) may supply the force to keep the bearing pressure above the wellbore pressure. It is contemplated that there may be a minimum lubricant pressure of 15 psi higher than the environment pressure, although other amounts are contemplated. Pistons (222, 222A) may move vertically to adjust as temperature changes affect the lubricant volume. The maximum piston stroke may be 3.46 inches (8.79 cm), although other piston strokes are contemplated. As can now be understood, the bearing assembly may be self lubricating. An external source of lubrication during operation may not be required. It is contemplated that accumulators (220, 220A) may collectively have a 200 hour or greater supply of lubricant. As can also now be understood, accumulators (220, 220A) advantageously are positioned radially outside of the bearings 228, allowing for a shorter LP-RCD housing height H7 than would be possible if the accumulators (220, 220A) were located directly above and below the bearings 228.

Accumulators (220, 220A) may be in radial alignment with the bearings 228. Seal retainer ring 238 and seal 230 may be directly radially inward of and in alignment with the bearing assembly. Accumulators (220, 220A) may be directly radially outward of and in alignment with the bearings 228. Bearing assembly rotating plate 210 may be directly radially outward of and in alignment with the bearing assembly. LP-RCD housing 200 may be directly radially outward of and in alignment with the bearing assembly. LP-RCD housing 200 may also be directly radially outward of and in alignment with the bearing assembly rotating plate 210. Bearing assembly retainer plate 208 may be directly radially outward of and in alignment with the bearing assembly. Bearing assembly retainer plate 208 may also be at least partially radially outward of the bearing assembly rotating plate 210.

Returning to FIG. 11, LP-RCD housing height H7 may be approximately 20.77 inches (52.8 cm), although other LP-RCD housing heights H7 are contemplated. As shown in FIG. 11, the combined LP-RCD 10D positioned with LP-RCD housing 200 may be height H7. Outer diameter D5 of LP-RCD housing outlet flange 258 may be approximately 15 inches (38.1 cm), although other diameters are contemplated. The ratio of outlet flange diameter D5 to LP-RCD housing height H7 may be 0.7 (or 70%) or higher, although other optimized ratios are contemplated. Outer diameter D5 of outlet flange 258 may be substantially parallel with LP-RCD housing height H7. Diameter D6 of LP-RCD housing outlet port 260 may be approximately 7.06 inches (17.9 cm), although other diameters are contemplated. The ratio of LP-RCD housing outlet port diameter D6 to LP-RCD housing height H7 may be 0.3 (or 30%) or higher, although other optimized ratios are contemplated. Bearing assembly height B1 may be 9.62 inches (24.4 cm), although other bearing assembly heights are contemplated. The ratio of bearing assembly height B1 to LP-RCD housing height H7 may be 0.45 (or 45%) or higher, although other optimized ratios are contemplated. Seal height S5 may be approximately 8.5 inches (21.6 cm) or higher, although other seal heights are contemplated. The ratio of seal height S5 to LP-RCD housing height H7 may be 0.4 (or 40%) or higher, although other optimized ratios are contemplated.

The diameter of LP-RCD housing well bore 264 may be approximately 13.63 inches (34.6 cm), although other diameters are contemplated. Although outlet conduit 266 is shown unitary or monolithic with LP-RCD housing 200, it is also contemplated that outlet conduit 266 may not be unitary with LP-RCD housing 200 and may be welded to the side of LP-RCD housing 200. Distance D7 between the bearing assembly and the inside surface of LP-RCD housing 200 may be 1.69 inches (4.3 cm), although other distances are contemplated.

Figure 13:
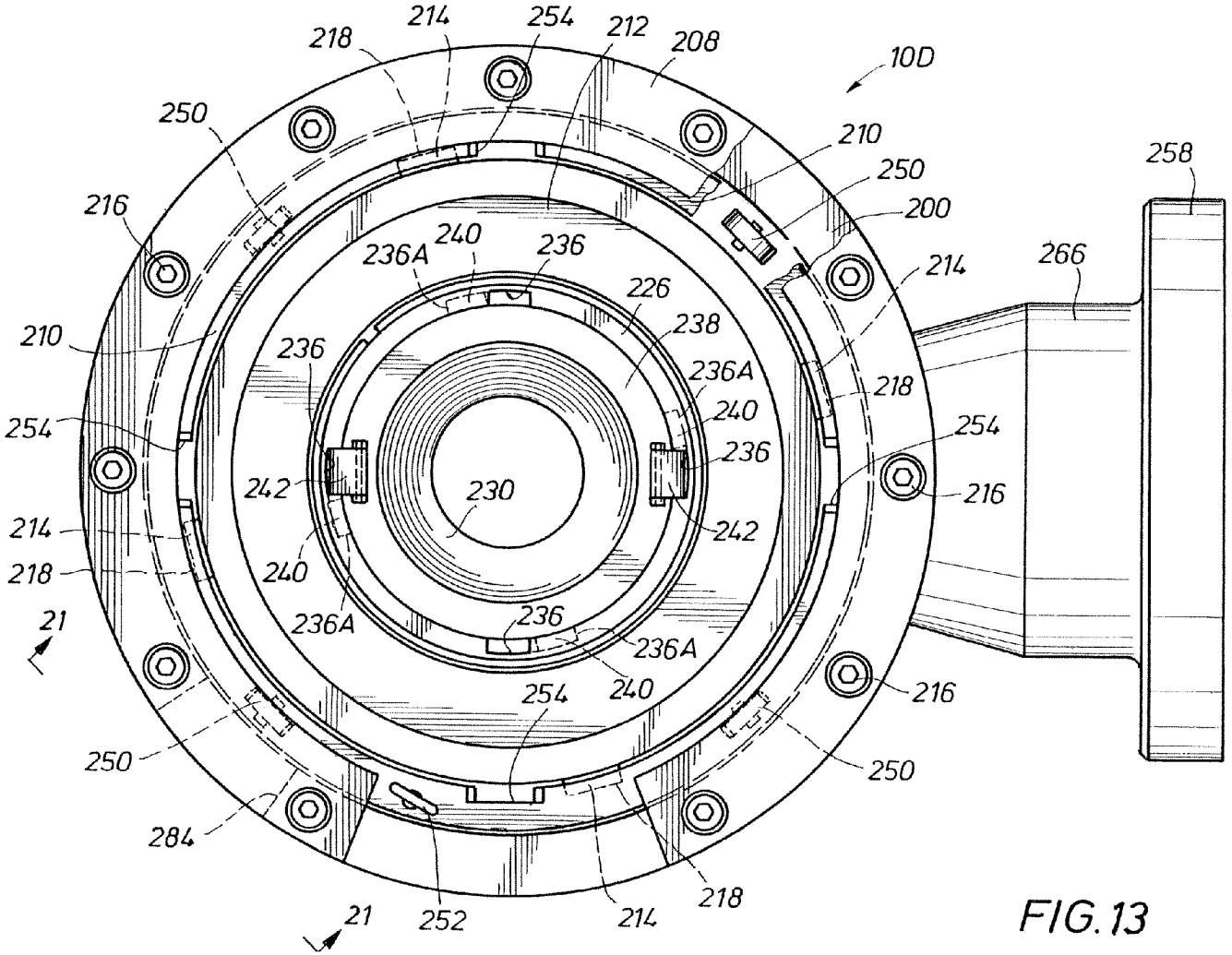
FIG. 13 is a plan view of the LP-RCD of FIG. 11 with the bearing assembly retainer plate over the bearing assembly rotating plate both partially cut away to show a LP-RCD housing rotating plate roller bearing, and in phantom three other LP-RCD housing rotating plate roller bearings, four bearing assembly outer member tabs disposed in corresponding LP-RCD housing bearing assembly receiving slots, and a bearing assembly rotating plate rotation access opening in the LP-RCD housing, a bearing assembly rotating plate lock member or pin, the seal retainer ring with seal retainer ring spring loaded flipper dogs in the locked position, and in phantom the four seal retainer ring tabs positioned in the corresponding bearing assembly inner member receiving slots.

In FIG. 13, bearing assembly retainer plate 208 is disposed with LP-RCD housing 200 with a plurality of screws 216. Bearing assembly rotating plate 210 may be rotated about a vertical axis on LP-RCD housing rotating plate rollers or roller bearings 250 with lock member or pin 252 as an attachment point, which will be described below in detail with FIGS. 18-20, or with a rod through bearing assembly rotating plate rotation access opening 284 in LP-RCD housing 200, which will be described below in detail with FIGS. 21-23. As shown in FIG. 13, bearing assembly outer member tabs 214 are disposed in and supported by LP-RCD housing receiving slots 218. Bearing assembly rotating plate 210 has been rotated clockwise to a blocking position as the rotating plate receiving slots 254 are not in alignment with the LP-RCD housing receiving slots 218. Bearing assembly rotating plate 210 has been fully rotated in the clockwise direction so that it may be locked with lock member 252. Advantageously, bearing assembly rotating plate 210 blocks the removal of LP-RCD bearing assembly from LP-RCD housing 200 since bearing assembly rotating plate 210 covers the bearing assembly outer member tabs 214. With lock member 252 is in its locked position, as will be described below with FIGS. 18-20, lock member 252 advantageously resists bearing assembly rotating plate 210 from rotating to the access position.

Seal retainer ring 238 is also in a blocking position and is locked with bearing assembly inner member 226. Seal support ring 232 (not shown) with seal 230 are held by bearing assembly inner member 226. Seal retainer ring tabs 240 are disposed in and supported by bearing assembly inner member receiving slots 236. Seal retainer ring tabs 240 have been lowered into bearing assembly inner member receiving slots 236 over seal support ring tabs 234 (not shown) in the access position. Seal retainer ring 238 has then been rotated counterclockwise about a vertical axis to a blocking position with seal retainer ring tabs 240 in horizontal grooves 236A of receiving slots 236. Seal retainer ring 238 has been fully rotated in a counterclockwise direction with seal retainer ring tabs 240 in horizontal grooves 236A of receiving slots 236. Seal retainer ring flipper dogs 242 are in their locked positions in bearing assembly inner member receiving slots 236 as shown in detail view in FIG. 16. In FIG. 15, seal retainer ring flipper dogs 242 are in their unlocked position. Advantageously, the flipper dogs 242 in their locked positions resist rotation of seal retainer ring 238 relative to bearing assembly inner member 226, thereby keeping seal retainer ring 238 from moving to its access position. Flipper dogs 242 in their unlocked positions do not resist rotation of seal retainer ring 238 relative to bearing assembly inner member 226.

Figure 22:
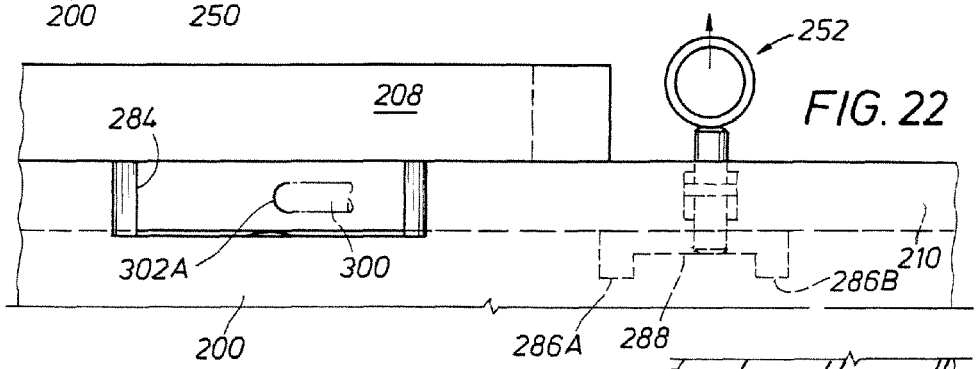
FIG. 22 is the same view as FIG. 21 except with the spring loaded lock pin is shown in the unlocked position and moved to the right along the LP-RCD housing lock pin receiving groove when the bearing assembly rotating plate is rotated to the right with the inserted rod.

Turning to FIG. 18, lock member or pin 252 is disposed in bearing assembly rotating plate spring cavity 294. Lock member 252 has an eye hook ring 290 attached with lock pin shaft 292. Lock member 252 is spring loaded with spring 296 in cavity 294. Lock member 252 is in its first locked position with lock pin shaft 292 extending in LP-RCD housing lock pin receiving port 286A. Advantageously, lock pin 252 in its first locked position resists rotation of bearing assembly rotating plate 210 relative to LP-RCD housing 200. Lock pin 252 in its unlocked position, such as shown in FIG. 22, does not resist the rotation of bearing assembly rotating plate 210 relative to LP-RCD housing 200. Spring 296 exerts a downward force on pin shaft 292 to resist retraction of shaft 292 from port 286A.

As best shown in FIG. 19, LP-RCD housing lock pin receiving groove 288 is disposed in LP-RCD housing 200 between the two LP-RCD housing lock pin receiving ports (286A, 286B). Lock pin 252 is in its locked position when lock pin shaft 292 is extending into either of the two LP-RCD housing lock pin receiving ports (286A, 286B). Bearing assembly outer member tab 214 is positioned in LP-RCD housing receiving slot 218. Although it is not shown in FIG. 19, bearing assembly rotating plate receiving slots 254 are not aligned with LP-RCD housing receiving slots 218 since rotating plate 210 is in the locked position and a blocking position covering tabs 214.

As best shown in FIGS. 20 and 22, to move lock pin 252 between ports (286A, 286B), a force with an upward component may be applied to ring 290, such as may be applied with a hook extending downward from the rig floor hooking ring 290, to lift the end of lock pin shaft 292 out of port 286A. The upward force must be sufficient to overcome the downward force of spring 296 on lock pin 252. The bearing assembly rotating plate 210 may then be rotated counterclockwise about a vertical axis, or to the right in FIGS. 20 and 22, with a force with a horizontal component applied to lock pin ring 290 so that the lifted lock pin shaft 292 moves along groove 288 from port 286A to port 286B. The upward force may then be released from lock pin ring 290 to allow the downward force of the spring 296 to move pin shaft 292 into port 286B, placing lock pin 252 in its second locked position. As can now be understood, bearing assembly rotating plate 210 may be locked in a blocking position when lock pin 252 is in its first locking position. Bearing assembly rotating plate 210 may also be locked in the access position when lock pin 252 is in its second locking position. Lock pin 252 is in its unlocked position when shaft 292 is not resting in either port (286A, 286B), such as for example in FIG. 22.

Figure 21:
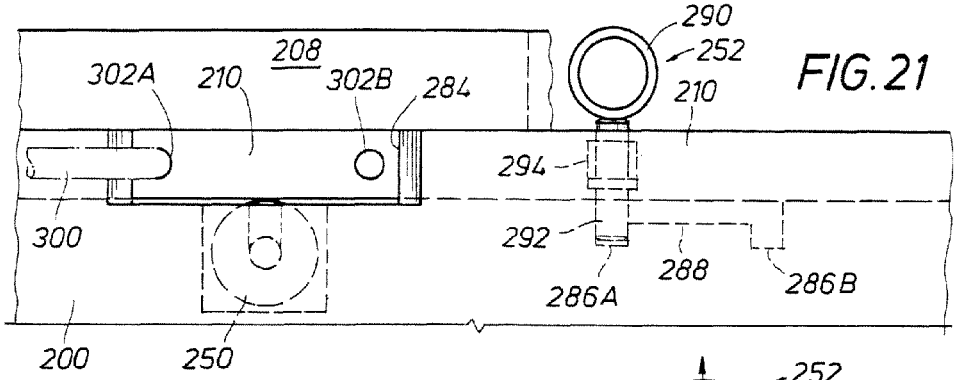
FIG. 21 is an partial elevational view along line 21-21 of FIG. 13 of the bearing assembly retainer plate over the LP-RCD housing, a bearing assembly rotating plate rotation opening in the LP-RCD housing exposing the bearing assembly rotating plate, a rod shown in phantom inserted in a rod insertion port in the bearing assembly rotating plate, also in phantom both an LP-RCD housing rotating plate roller bearing and the bearing assembly rotating plate spring loaded lock pin in the locked position with one of the two lock pin receiving ports.

In FIG. 21, an alternative embodiment for rotating or moving bearing assembly rotating plate 210 is shown. Bearing assembly rotating plate 210 is disposed on LP-RCD housing rotating plate rollers or roller bearings 250. Bearing assembly retainer plate 208 is disposed with LP-RCD housing 200. Bearing assembly rotating plate rotation access opening 284 in LP-RCD housing 200 allows access to the side of bearing assembly rotating plate 210 through LP-RCD housing 200. Two rod insertion ports (302A, 302B) are disposed in the side of bearing assembly rotating plate 210. However, other numbers of rod insertion ports are contemplated, including only one port. If bearing assembly rotating plate 210 needs to be rotated, it is contemplated that it may be rotated exclusively using lock pin 252 as an attachment point. However, if bearing assembly rotating plate 210 cannot be moved by a force applied to lock pin 252 alone, such as if rotation is resisted by damaged roller bearings 250 or other causes, then as shown in FIG. 21 a rod 300 may be inserted into rod insertion port 302A and bearing assembly rotating plate 210 moved or rotated about a vertical axis with a force applied to rod 300.

Figure 23:
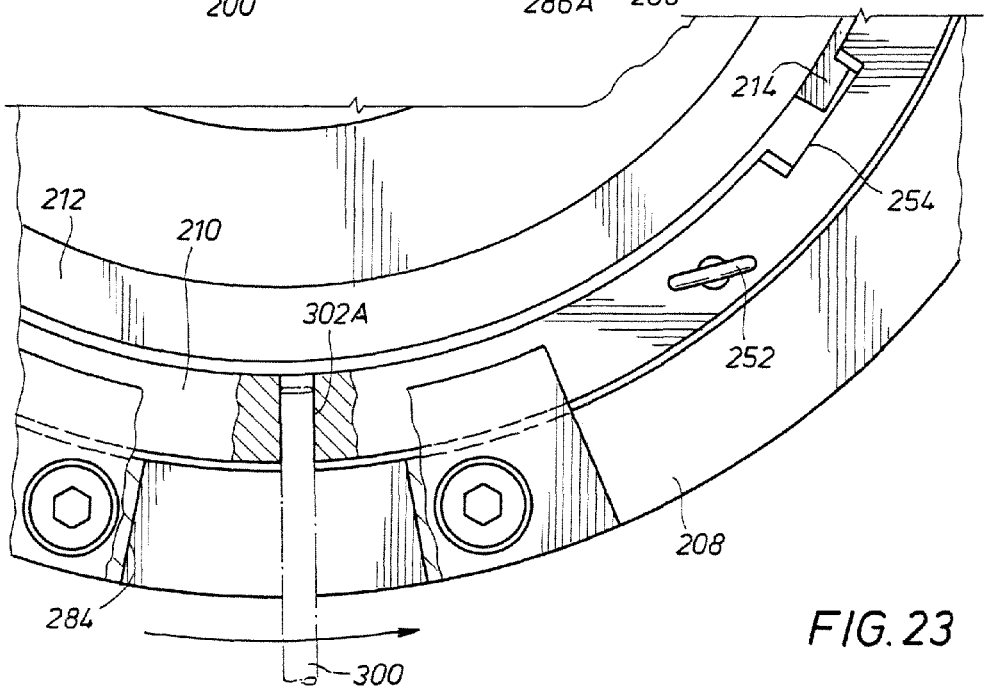
FIG. 23 is a plan view of FIG. 22 with the bearing assembly retainer plate partially cut away to expose the bearing assembly rotating plate rotation opening in the LP-RCD housing and the bearing assembly rotating plate partially cut away to show the rod insertion port.

In FIG. 22, lock pin 252 has been lifted to allow rotation of bearing assembly rotating plate 210 with rod 300 in port 302A. In FIGS. 22 and 23, rod 300 has moved rotating plate 210 to the right or counterclockwise from its position in FIG. 21. It is also contemplated that there may be no lock pin 252, and that a rod 300 in a port (302A, 302B) may be the exclusive means of rotating bearing assembly rotating plate 210. Turning to FIG. 23, moving bearing assembly rotating plate 210 counterclockwise about a vertical axis or to the right as shown moves bearing assembly rotating plate 210 toward its access position since rotating plate receiving slots 254 are moved toward alignment with bearing assembly outer member tabs 214.

Figure 24:
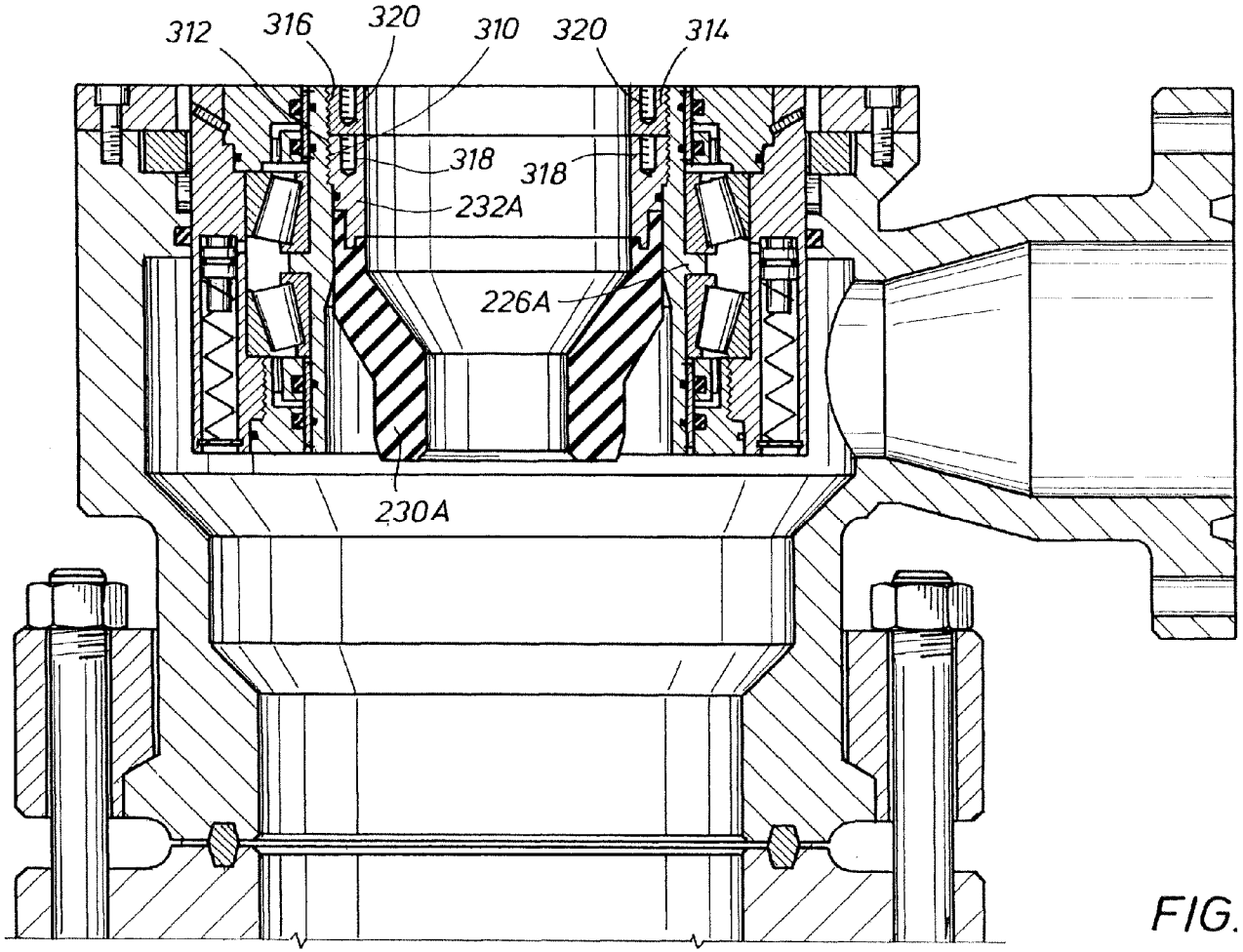
FIG. 24 is an elevational section view similar to FIG. 11 with an alternative embodiment seal support ring threadedly attached with a LP-RCD bearing assembly inner member, and a seal locking ring threadedly attached with the LP-RCD bearing assembly inner member in a locked position over the seal support ring.
Figure 25:
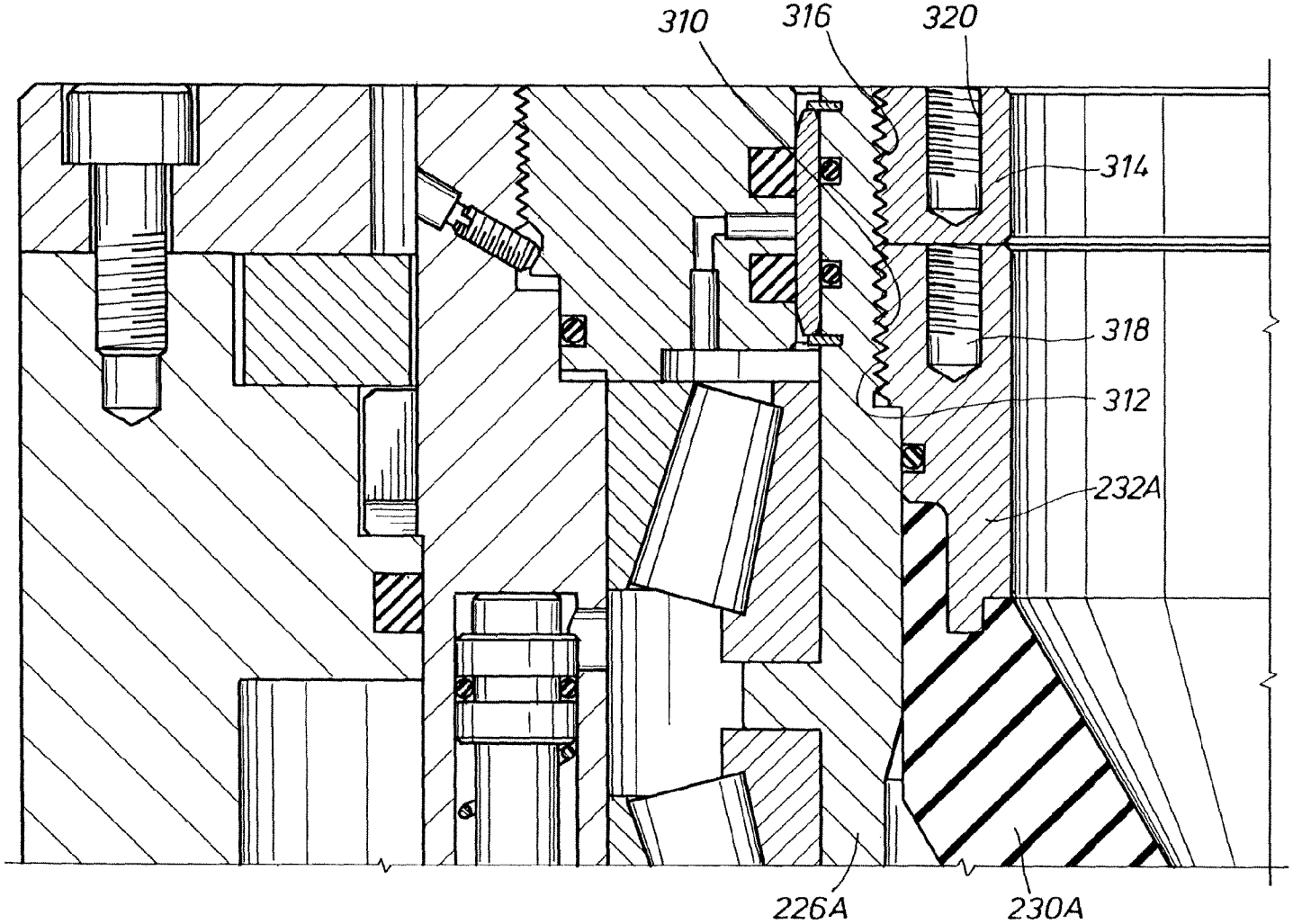
FIG. 25 is a detail view of FIG. 24 showing the seal support ring and seal locking ring.

In FIGS. 24 and 25, alternative embodiment seal support ring or member 232A supports seal 230A. Thread 310 of seal support ring 232A is engaged with thread 312 of LP-RCD bearing assembly inner member 226A. Seal support ring receiving ports 318 may be used for rotating seal support ring 232A to threadingly attach with LP-RCD bearing assembly inner member 226A. Ports 318 may be threaded. Seal locking ring 314 is in a locked position over seal support ring 232A. Seal locking ring 314 may be removed to allow access to seal support ring 232A. Thread 316 of seal locking ring 314 is engaged with thread 312 of LP-RCD bearing assembly inner member 226A. FIG. 24 is otherwise the same as FIG. 11. As can now be understood, seal 230A of FIGS. 24 and 25 may be removably attached with the LP-RCD bearing assembly. Seal locking ring 314 may be used to prevent seal support ring 232A from becoming loosened or unattached from LP-RCD bearing assembly inner member 226A.

Interlocking LP-RCD Method of Use

To assemble the LP-RCD 10D, seal 230 may be disposed with the bearing assembly by aligning and resting seal support ring tabs 234 in bearing assembly inner member receiving slots 236. Seal retainer ring 238 may be disposed over seal support ring 232 by aligning and lowering seal retainer ring tabs 240 over seal support ring tabs 234 in bearing assembly inner member receiving slots 236. Seal retainer ring 238 may be rotated in a counterclockwise direction about a vertical axis with seal retainer ring tabs 240 in horizontal grooves 236A of bearing assembly inner member receiving slots 236. After further counterclockwise rotation is resisted, seal retainer ring flipper dogs 242 may be moved to their locked positions in bearing assembly inner member receiving slots 236. As can now be understood, seal 230 is locked with the bearing assembly and blocked from removal.

The bearing assembly may be disposed with LP-RCD housing 200 by rotating bearing assembly rotating plate 210 to its access position in which bearing assembly rotating plate receiving slots 254 are aligned with LP-RCD housing receiving slots 218. Bearing assembly rotating plate 210 may be locked in its access position with lock pin 252 in its second locking position. The bearing assembly may be positioned with the LP-RCD housing 200 by aligning and lowering bearing assembly outer member tabs 214 through the bearing assembly receiving slots 254. The bearing assembly outer member tabs 214 may be supported in LP-RCD housing receiving slots 218. Lock member or pin 252 may then be refracted from its second locking position to the unlocked position. Bearing assembly rotating plate 210 may be rotated clockwise about a vertical axis to the blocking position. Lock pin 252 may then be moved to its first locking position to prevent relative rotation of bearing assembly rotating plate 210 with LP-RCD housing 200. As can now be understood, the bearing assembly is locked with the LP-RCD housing 200 and is blocked from removal.

LP-RCD 10D may be used for converting a smaller drilling rig or structure between conventional hydrostatic pressure drilling and managed pressure drilling or underbalanced drilling. LP-RCD 10D and corresponding LP-RCD housing 200 as shown in FIG. 11 may be mounted on top of a lower member or housing (202, HS) (which may be a BOP) using one of the attachment members and connection means shown in FIGS. 2-6 and 11 and/or described above, such as for example LP-RCD housing attachment member 206 in FIG. 11 and swivel hinges 140 in FIG. 6.

Outlet flange 258 may be aligned as necessary before LP-RCD housing 200 is fully tightened against the lower member (202, HS). Conduit(s) may be attached to the outlet flange 258, including the conduit configurations and valves shown in FIGS. 9 and 10. The bearings 228 for LP-RCD 10D may be preloaded with top packing box 274, and the top packing box 274 and the preload held in place with angled bearing assembly set screws 278. Drill string tubulars may be inserted through the LP-RCD 10D for drilling or other operations. LP-RCD stripper rubber seal 230 rotates with tubulars, allows them to slide through, and seals the annular space so that drilling fluid returns will be directed through the outlet conduit 266. During operations, the bearings 228 may be self lubricated with accumulators (220, 220A).

When desired, the stripper rubber seal 230 may be inspected and, if needed, replaced from above, by removing seal retainer ring 238 and lifting out seal support ring 232 and seal 230. Seal retainer ring 238 may be removed by moving flipper dogs 242 from their locked positions as shown in FIG. 16 to their unlocked positions as shown in FIG. 15, and then rotating seal retainer ring 238 clockwise about a vertical axis from a blocking position to its access position. When seal retainer ring tabs 240 are aligned over seal support ring tabs 234 in the access position, then seal retainer ring 238 and seal support ring 232 may be lifted out of the bearing assembly. The process may be reversed to assemble seal 230 back into the bearing assembly.

When desired, the bearing assembly may be inspected and, if needed, replaced from above, by rotating bearing assembly rotating plate 210 counterclockwise about a vertical axis from a blocking position to its access position either with lock pin 252 as an attachment point, or with a rod 300 in rod receiving port 302A in bearing assembly rotating plate 210, or with both. As shown in FIG. 22, lock pin 252 may be lifted from its first locked position then moved to the right or counterclockwise about a vertical axis to move rotating plate 210 on rotating plate roller bearings 250. Lock pin 252 may be moved from a first locked position in port 286A to a second locked position in port 286B. Bearing assembly rotating plate receiving slots 254 may be aligned with LP-RCD housing receiving slots 218 in the access position, uncovering bearing assembly outer member tabs 214. The bearing assembly may then be lifted from the LP-RCD housing 200. The process may be reversed to assemble the bearing assembly back into the bearing assembly. To remove lower seal sleeve 268B from the bearing assembly inner member 226, its inner seal sleeve retaining ring 272A may be removed to allow access for a pulling tool to grab the back side of the lower seal sleeve 268B.

If alternative embodiment seal support ring or member 232A and seal 230A shown in FIGS. 24 and 25 are used, seal 230A may be removably attached with LP-RCD bearing assembly inner member 226A by threadedly attaching or unattaching seal support ring 232A with LP-RCD bearing assembly inner member 226A. Seal locking ring 314 may be threaded into the locked position over seal support ring 232A as shown in FIGS. 24 and 25 to prevent seal support ring 232A from loosening during operations. When seal 230A needs to be removed, seal locking ring 314 may be unthreaded, and then seal support ring 232A with seal 230A may be unthreaded and removed.

The foregoing disclosure and description of the invention are illustrative and explanatory thereof, and various changes in the details of the illustrated apparatus and system, and the construction and the method of operation may be made without departing from the spirit of the invention.

We claim:

1. A system for forming a borehole using a rotatable tubular, the system comprising:

a housing disposed above the borehole, wherein said housing having a height and a port;

a bearing assembly having an inner member and an outer member and being removably positioned with said housing, wherein said inner member configured to be rotatable with the tubular relative to the outer member, said inner member having a passage through which the tubular may extend;

a bearing assembly rotating plate rotatably disposed with said housing and configured to rotate between a blocking position blocking removal of said bearing assembly from said housing, and an access position configured for removal of said bearing assembly from said housing while said bearing assembly rotating plate remains disposed with said housing;

a seal configured to sealably engage the rotatable tubular with said bearing assembly; and a plurality of bearings disposed between said inner member and said outer member.

2. The system of claim 1, further comprising an attachment member for attaching said housing with a lower member, wherein said housing having a blocking shoulder, said attachment member having a blocking shoulder, and said attachment member blocking shoulder positioned with said housing blocking shoulder to attach said housing with said lower member.

3. The system of claim 1, wherein said housing further comprising a flange having an outer diameter and a flange port, said housing port communicating with said flange port, and said housing flange outer diameter being at least seventy percent of said housing height.

4. The system of claim 1, further comprising:

a support member for supporting said seal with said bearing assembly, wherein said seal being removable from said bearing assembly; and a seal retainer ring rotatably disposed with said bearing assembly and configured to rotate between a blocking position blocking removal of said seal from said bearing assembly, and an access position configured for removal of said seal retainer ring from said bearing assembly to allow removal of said seal from said bearing assembly after removal of said seal retainer ring.

5. The system of claim 1, further comprising:

a support member supporting said seal with said bearing assembly, wherein said support member threadedly attached with said bearing assembly; and a seal locking ring threadedly disposed with said bearing assembly and configured to rotate between a locked position blocking removal of said seal from said bearing assembly, and an access position configured for allowing removal of said seal locking ring from said bearing assembly to allow removal of said seal from said bearing assembly after removal of said seal locking ring.

6. The system of claim 1, further comprising:

a plurality of accumulators completely disposed radially inwardly in said housing and configured to lubricate at least one of said plurality of bearings, and each of said accumulators spaced apart from each other accumulator and disposed radially outward from said plurality of bearings.

7. The system of claim 1, further comprising:

a plurality of rollers disposed between said housing and said bearing assembly rotating plate; and a bearing assembly retainer plate disposed with said housing and configured to block removal of said bearing assembly rotating plate from said housing.

8. The system of claim 1, wherein said bearing assembly rotating plate rotatably disposed with said housing, the system further comprising:

a lock member movable between a locked position to block relative rotation between said bearing assembly rotating plate and said housing, and an unlocked position to allow relative rotation between said bearing assembly rotating plate and said housing.

9. The system of claim 1, wherein said housing having an opening for radial access to said bearing assembly rotating plate, said housing access opening sized to receive a rod to be connected with said bearing assembly rotating plate.

10. The system of claim 1, wherein said bearing assembly outer member further comprising a plurality of tabs corresponding with a plurality of slots in said housing.

11. A rotating control apparatus, comprising:

a bearing assembly having an outer member and an inner member disposed with said outer member, said inner member having a passage;

a seal supported from said inner member and with the passage;

a plurality of bearings disposed between said outer member and said inner member so that one member is rotatable relative to the other member;

said seal extending radially inward from said plurality of bearings;

a support member for supporting said seal with said bearing assembly, wherein said seal being removable from said bearing assembly;

a seal retainer ring rotatably disposed with said bearing assembly and configured to rotate between a blocking position blocking removal of said seal from said bearing assembly, and an access position configured for removal of said seal retainer ring from said bearing assembly to allow removal of said seal from said bearing assembly after removal of said seal retainer ring;

a housing to receive at least a portion of said bearing assembly, wherein said housing having a height and a housing port; and a housing flange having an outer diameter and a flange port, wherein said housing port communicating with said housing flange port.

12. The apparatus of claim 11, further comprising:

a bearing assembly rotating plate rotatably disposed with said housing and configured to rotate between a blocking position blocking removal of said bearing assembly from said housing, and an access position configured for removal of said bearing assembly from said housing while said bearing assembly rotating plate remains disposed with said housing.

13. The system of claim 11, further comprising:

wherein said support member threadedly attached with said bearing assembly; and a seal locking ring threadedly disposed with said bearing assembly and configured to rotate between a locked position blocking removal of said seal from said bearing assembly, and an access position configured for allowing removal of said seal locking ring from said bearing assembly to allow removal of said seal from said bearing assembly after removal of said seal locking ring.

14. The apparatus of claim 11, further comprising:

a plurality of accumulators completely disposed radially inwardly in said housing and configured to lubricate at least one of said plurality of bearings, and each of said accumulators spaced apart from each other accumulator and disposed radially outward from said plurality of bearings.

15. The apparatus of claim 11, wherein said housing flange outer diameter being at least seventy percent of said housing height.

16. A system for managing the pressure of a fluid in a borehole while sealing a rotatable tubular, the system comprising:

a housing communicating with the borehole, said housing having a height and a housing port;

a bearing assembly having an outer member and a rotatable inner member having a passage through which the tubular may extend, said bearing assembly removably disposed with said housing;

a plurality of bearings between said inner member and said outer member;

a seal supported by said inner member for sealing with the rotatable tubular;

said housing port communicating with and aligned with said seal;

a support member for removably supporting said seal with said inner member; and a seal retainer ring rotatably disposed with said inner member and configured to rotate between a blocking position blocking removal of said seal from said inner member, and an access position configured for removal of said seal retainer ring from said bearing assembly without moving said seal and to allow removal of said seal from said inner member after removal of said seal retainer ring.

17. The system of claim 16, wherein said housing further comprising a flange having a flange port with a flange port diameter, said housing port communicating with said flange port, and said flange port diameter being at least thirty percent of said housing height.

18. The system of claim 16, further comprising:

a bearing assembly rotating plate rotatably disposed with said housing and configured to rotate between a blocking position blocking removal of said bearing assembly from said housing, and an access position configured for removal of said bearing assembly from said housing while said bearing assembly rotating plate remains disposed with said housing.

19. The system of claim 16, wherein said support member further comprising a plurality of tabs corresponding with a plurality of slots in said inner member.

20. The system of claim 16, wherein said seal retainer ring further comprising:

a lock member movable between a locked position to block relative rotation between said seal retainer ring and said bearing assembly, and an unlocked position to allow relative rotation between said seal retainer ring and said bearing assembly.

21. A rotating control apparatus, the apparatus comprising:

a housing having a housing height and a housing port;

a bearing assembly having an inner member and an outer member and being removably positioned radially inwardly in said housing, wherein said inner member rotatable relative to the outer member and having a passage;

a seal having a seal height supported from said bearing assembly;

a plurality of bearings disposed between said inner member and said outer member; and a plurality of accumulators disposed in said bearing assembly and configured to lubricate at least one of said plurality of bearings, and each of said accumulators spaced apart from each other accumulator.

22. The apparatus of claim 21, wherein said seal height is greater than forty percent of said housing height.

23. The apparatus of claim 21, wherein each of said accumulators comprising a piston and a spring disposed in said bearing assembly outer member.

24. The apparatus of claim 21, wherein said plurality of accumulators comprising at least twenty accumulators spaced apart equidistance in said bearing assembly outer member.

25. The apparatus of claim 21, further comprising:

a bearing assembly rotating plate rotatably disposed with said housing and configured to rotate between a blocking position blocking removal of said bearing assembly from said housing, and an access position configured for removal of said bearing assembly from said housing while said bearing assembly rotating plate remains disposed with said housing.

26. A method for assembling a rotating control device, comprising the steps of:

aligning a bearing assembly rotating plate with a housing;

moving a bearing assembly having an inner member and an outer member with bearings therebetween through said bearing assembly rotating plate and into the housing, wherein said bearing assembly inner member is rotatable relative to said bearing assembly outer member;

rotating said bearing assembly rotating plate relative to said housing; and blocking removal of said bearing assembly from said housing after the step of rotating.

27. The method of claim 26, wherein the step of rotating is clockwise.

28. The method of claim 26, further comprising the steps of:

rotating said bearing assembly rotating plate counterclockwise to an access position; and removing said bearing assembly from said housing.

29. The method of claim 26, wherein said housing comprising a flange having a flange port, and further comprising the steps of:

aligning said flange port; and attaching said housing with a lower member after the step of aligning said flange port.

30. The method of claim 26, further comprising the steps of:

removably supporting a seal with said inner member with a seal support member;

aligning a seal retainer ring with the bearing assembly;

rotating said seal retainer ring relative to said inner member; and blocking removal of said seal from said inner member after the step of rotating said seal retainer ring.

31. The method of claim 30, further comprising the step of:

locking said seal retainer ring with said inner member.

32. The method of claim 26, further comprising the step of:

lubricating at least one of said bearings with one of a plurality of spaced apart accumulators disposed radially outward of said bearing assembly outer member.

33. A method for assembling a rotating control device, comprising the steps of:

aligning a seal with a bearing assembly having an inner member and an outer member with bearings therebetween, wherein said bearing assembly inner member is rotatable relative to said bearing assembly outer member;

supporting said seal from said inner member;

aligning a seal retainer ring with said inner member;

moving said seal retainer ring into said inner member;

rotating said seal retainer ring relative to said inner member without rotating said seal supported from said inner member; and blocking removal of said seal from said inner member after the step of rotating.

34. The method of claim 33, wherein the step of rotating is counterclockwise.

35. The method of claim 33, further comprising the step of:

rotating said seal retainer ring clockwise to an access position for removal of said seal retainer ring from said bearing assembly;

removing said seal from said inner member after the step of rotating said seal retainer ring clockwise.

36. The method of claim 33, further comprising the steps of:

rotating a bearing assembly rotating plate relative to said housing;

blocking removal of said bearing assembly from said housing after the step of rotating said bearing assembly rotating plate; and allowing access for removal of said bearing assembly from said housing while said bearing assembly rotating plate remains disposed with said housing.

37. The method of claim 33, further comprising the step of:

locking said seal retainer ring with said inner member.

* * * * *